US011208788B2

(12) United States Patent
Izumikawa

(10) Patent No.: US 11,208,788 B2
(45) Date of Patent: Dec. 28, 2021

(54) CONSTRUCTION MACHINE

(71) Applicant: SUMITOMO (S.H.I.) CONSTRUCTION MACHINERY CO., LTD., Tokyo (JP)

(72) Inventor: Takeya Izumikawa, Chiba (JP)

(73) Assignee: SUMITOMO (S.H.I) CONSTRUCTION MACHINERY CO., LTD., Tokyo (JP)

( * ) Notice: Subject to any disclaimer, the term of this patent is extended or adjusted under 35 U.S.C. 154(b) by 266 days.

(21) Appl. No.: 16/431,946

(22) Filed: Jun. 5, 2019

(65) Prior Publication Data

US 2019/0284782 A1 Sep. 19, 2019

Related U.S. Application Data

(63) Continuation of application No. PCT/JP2017/043327, filed on Dec. 1, 2017.

(30) Foreign Application Priority Data

Dec. 6, 2016 (JP) ..... JP2016-237042

(51) Int. Cl.
*E02F 9/24* (2006.01)
*E02F 9/20* (2006.01)
(Continued)

(52) U.S. Cl.
CPC ..... *E02F 9/24* (2013.01); *E02F 9/2004* (2013.01); *E02F 9/2033* (2013.01);
(Continued)

(58) Field of Classification Search
CPC . F15B 21/02; E02F 9/24; E02F 9/2033; E02F 9/2296; E02F 9/26
See application file for complete search history.

(56) References Cited

U.S. PATENT DOCUMENTS

2003/0151508 A1* 8/2003 Frame ..... E02F 9/24 340/540
2013/0088593 A1* 4/2013 Ishimoto ..... H04N 7/18 348/143
(Continued)

FOREIGN PATENT DOCUMENTS

DE 102010035937 3/2012
DE 102010035937 A1 * 3/2012 ..... E02F 9/2033
(Continued)

OTHER PUBLICATIONS

International Search Report for PCT/JP2017/043327 dated Feb. 13, 2018.
(Continued)

*Primary Examiner* — Thomas E Lazo
(74) *Attorney, Agent, or Firm* — IPUSA, PLLC

(57) ABSTRACT

A construction machine includes a hydraulic actuator and a processor. The processor is configured to detect a predetermined object present within a predetermined area around the construction machine, impose a motion restriction on the construction machine by decreasing the flow rate of hydraulic oil supplied to the hydraulic actuator, in response to detection of the object present within the predetermined area, and relax or cancel the motion restriction by increasing the flow rate to a level lower than before a start of the motion restriction or a level substantially same as before the start of the motion restriction, in response to a predetermined operation for relaxing or canceling the motion restriction being performed or in response to the object being no longer detected within the predetermined area, after the start of the motion restriction.

20 Claims, 29 Drawing Sheets

(51) Int. Cl.

| | |
|---|---|
| ***E02F 9/22*** | (2006.01) |
| ***E02F 9/26*** | (2006.01) |
| ***F15B 11/042*** | (2006.01) |
| ***F15B 11/10*** | (2006.01) |
| ***F15B 21/02*** | (2006.01) |

(52) U.S. Cl.
CPC ..... *E02F 9/2221* (2013.01); *E02F 9/2228* (2013.01); *E02F 9/2271* (2013.01); *E02F 9/2296* (2013.01); *E02F 9/26* (2013.01); *F15B 11/042* (2013.01); *F15B 11/10* (2013.01); *F15B 21/02* (2013.01); *E02F 9/2285* (2013.01); *E02F 9/2292* (2013.01); *F15B 2211/20523* (2013.01); *F15B 2211/20546* (2013.01); *F15B 2211/255* (2013.01); *F15B 2211/275* (2013.01); *F15B 2211/6651* (2013.01); *F15B 2211/6652* (2013.01); *F15B 2211/6654* (2013.01); *F15B 2211/75* (2013.01)

(56) References Cited

U.S. PATENT DOCUMENTS

2013/0222573 A1* 8/2013 Onuma ..... H04N 7/18 348/82
2014/0088824 A1* 3/2014 Ishimoto ..... B60R 1/00 701/34.4
2014/0212846 A1* 7/2014 Miller ..... E02F 9/24 434/29
2014/0293051 A1* 10/2014 Nakamura ..... G06K 9/00791 348/148
2015/0275483 A1* 10/2015 Tsukamoto ..... E02F 3/435 701/50

FOREIGN PATENT DOCUMENTS

| | | |
|---|---|---|
| JP | H10-331813 | 12/1998 |
| JP | 2014-181509 | 9/2014 |
| JP | 2014-218849 | 11/2014 |
| JP | 2014218849 A * | 11/2014 |
| JP | 2015-063864 | 4/2015 |
| JP | 2016-176289 | 10/2016 |
| JP | 2016176288 | 10/2016 |

OTHER PUBLICATIONS

Communication pursuant to Article 94(3) EPC for 17879112.5 dated Mar. 2, 2020.

* cited by examiner

CONSTRUCTION MACHINE

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2017/043327, filed on Dec. 1, 2017 and designating the U.S., which claims priority to Japanese patent application No. 2016-237042, filed on Dec. 6, 2016. The entire contents of the foregoing applications are incorporated herein by reference.

BACKGROUND

Technical Field

The present invention relates to construction machines.

Description of Related Art

A motion restricting device of a construction machine that includes detecting means for detecting a predetermined object (such as a person) within a predetermined area around the construction machine and restricts the motion of the construction machine by reducing the flow rate of a hydraulic pump in response to detection of the predetermined object by the detecting means is known.

SUMMARY

According to an aspect of the present invention, a construction machine includes a hydraulic actuator and a processor. The processor is configured to detect a predetermined object present within a predetermined area around the construction machine, impose a motion restriction on the construction machine by decreasing the flow rate of hydraulic oil supplied to the hydraulic actuator, in response to detection of the object present within the predetermined area, and relax or cancel the motion restriction by increasing the flow rate to a level lower than before a start of the motion restriction or a level substantially same as before the start of the motion restriction, in response to a predetermined operation for relaxing or canceling the motion restriction being performed or in response to the object being no longer detected within the predetermined area, after the start of the motion restriction.

DETAILED DESCRIPTION

From the viewpoint of work efficiency, when the motion of the construction machine is restricted in response to detection of an object around the construction machine, it is desired to thereafter cancel the motion restriction when the safety is ensured.

According to an aspect of the present invention, a construction machine that can further increase safety in the case of restricting the motion of a construction machine and canceling the motion restriction based on detection of an object around the construction machine is provided.

An embodiment of the invention is described below with reference to the drawings.

First, a construction machine according to this embodiment is described with reference to FIG. 1.

Figure 1:
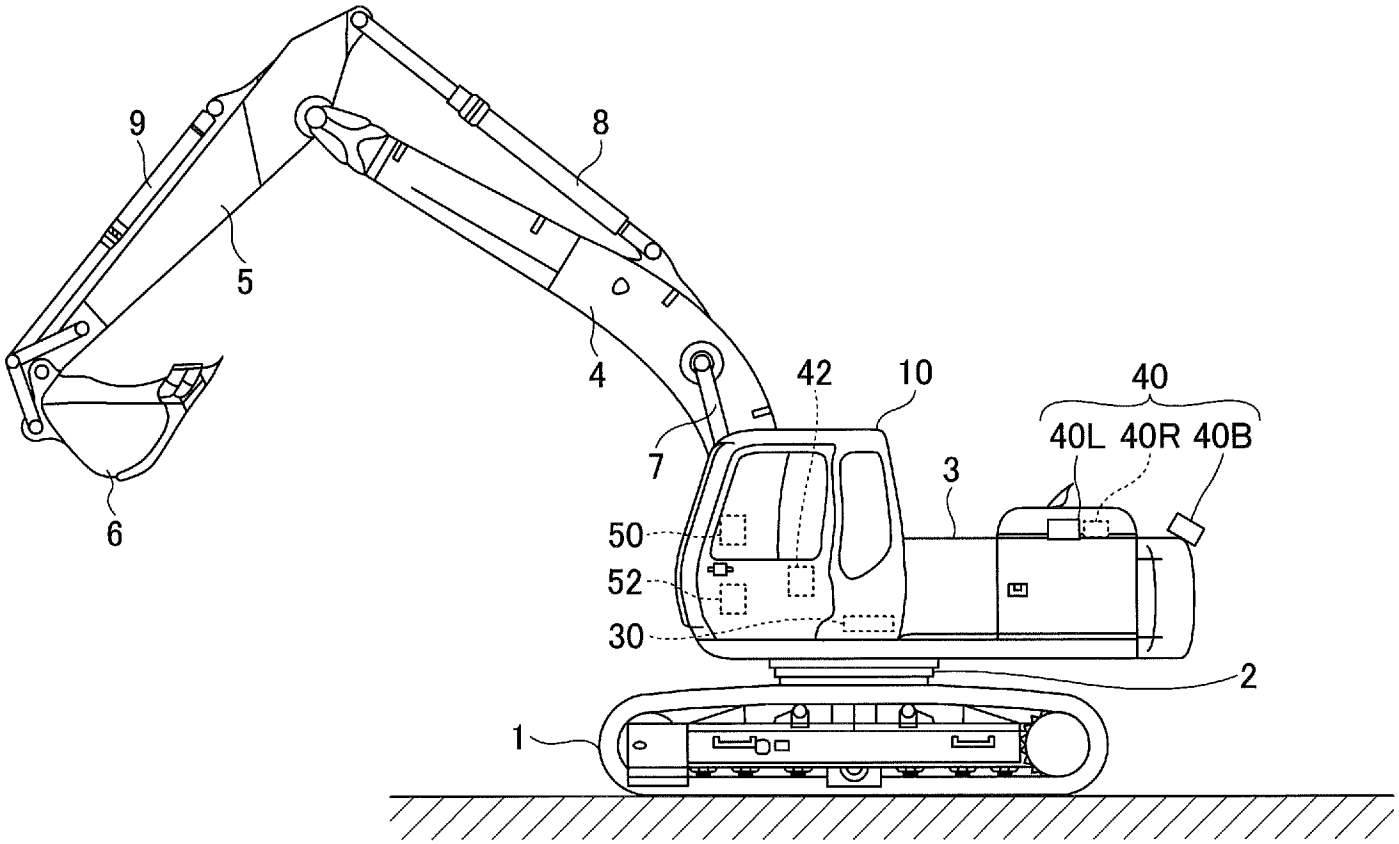
FIG. 1 is a diagram illustrating an example construction machine in which a surroundings monitoring system according to an embodiment is installed.

FIG. 1 is a diagram illustrating an example construction machine according to this embodiment, and specifically, is a side view of a shovel.

A surroundings monitoring system 100 according to this embodiment may be installed in construction machines other than shovels, such as wheel loaders and asphalt finishers.

The shovel according to this embodiment includes a lower traveling body 1; an upper turning body 3 turnably mounted on the lower traveling body 1 via a turning mechanism 2; a boom 4, an arm 5, and a bucket 6 serving as an attachment (work device); and a cabin 10 in which an operator sits.

The lower traveling body 1 includes, for example, a pair of right and left crawlers. Each crawler is hydraulically driven by a traveling hydraulic motor (not depicted) to cause the shovel to travel.

The upper turning body 3 is driven by a turning hydraulic motor or an electric motor (neither of which is depicted) to turn relative to the lower traveling body 1.

The boom 4 is pivotably attached to the front center of the upper turning body 3 to be movable upward and downward. The arm 5 is pivotably attached to the end of the boom 4 to be pivotable upward and downward. The bucket 6 is pivotably attached to the end of the arm 5 to be pivotable upward and downward. The boom 4, the arm 5, and the bucket 6 are hydraulically driven by a boom cylinder 7, an arm cylinder 8, and a bucket cylinder 9, respectively.

The cabin 10 is an operator room in which the operator sits, and is mounted on the front left of the upper turning body 3.

Furthermore, the shovel according to this embodiment includes a controller 30, an image capturing unit 40, a cancellation switch 42, a display device 50, and an audio output device 52 as constituent elements related to the surroundings monitoring system 100.

The controller 30 is a control device that controls the driving of the shovel. The controller 30 is installed in the cabin 10.

The image capturing unit 40 is attached to the top of the upper turning body 3 to capture images of the surroundings of the shovel. The image capturing unit 40 includes a back camera 40B, a left side camera 40L, and a right side camera 40R.

The back camera 40B is attached to the top of the back end of the upper turning body 3 to capture an image of an area behind the upper turning body 3.

The left side camera 40L is attached to the top of the left end of the upper turning body 3 to capture an image of an area to the left of the upper turning body 3.

The right side camera 40R is attached to the top of the right end of the upper turning body 3 to capture an image of an area to the right of the upper turning body 3.

The cancellation switch 42 is provided around an operator seat in the cabin 10, and receives an operation input by the operator or the like.

The cancellation switch 42 may be operated by a person other than the operator, such as a serviceperson, a worker or site supervisor at a work site where the shovel works, or a manager of a temporary management office at the work site. Furthermore, in this case, the cancellation switch 42 may be provided outside the cabin 10 to receive an operation by a person other than the operator.

The display device 50 is provided around the operator seat in the cabin 10, and displays various kinds of image information of which the operator is notified under the control of the controller 30 (a display controlling part 302 as described below).

The audio output device 52 is provided around the operator seat in the cabin 10, and outputs various kinds of audio information of which the operator is notified under the control of the controller 30. Examples of the audio output device 52 include a loudspeaker and a buzzer.

Next, a specific configuration of the surroundings monitoring system 100 installed in the construction machine according to this embodiment is described with reference to FIG. 2.

Figure 2:
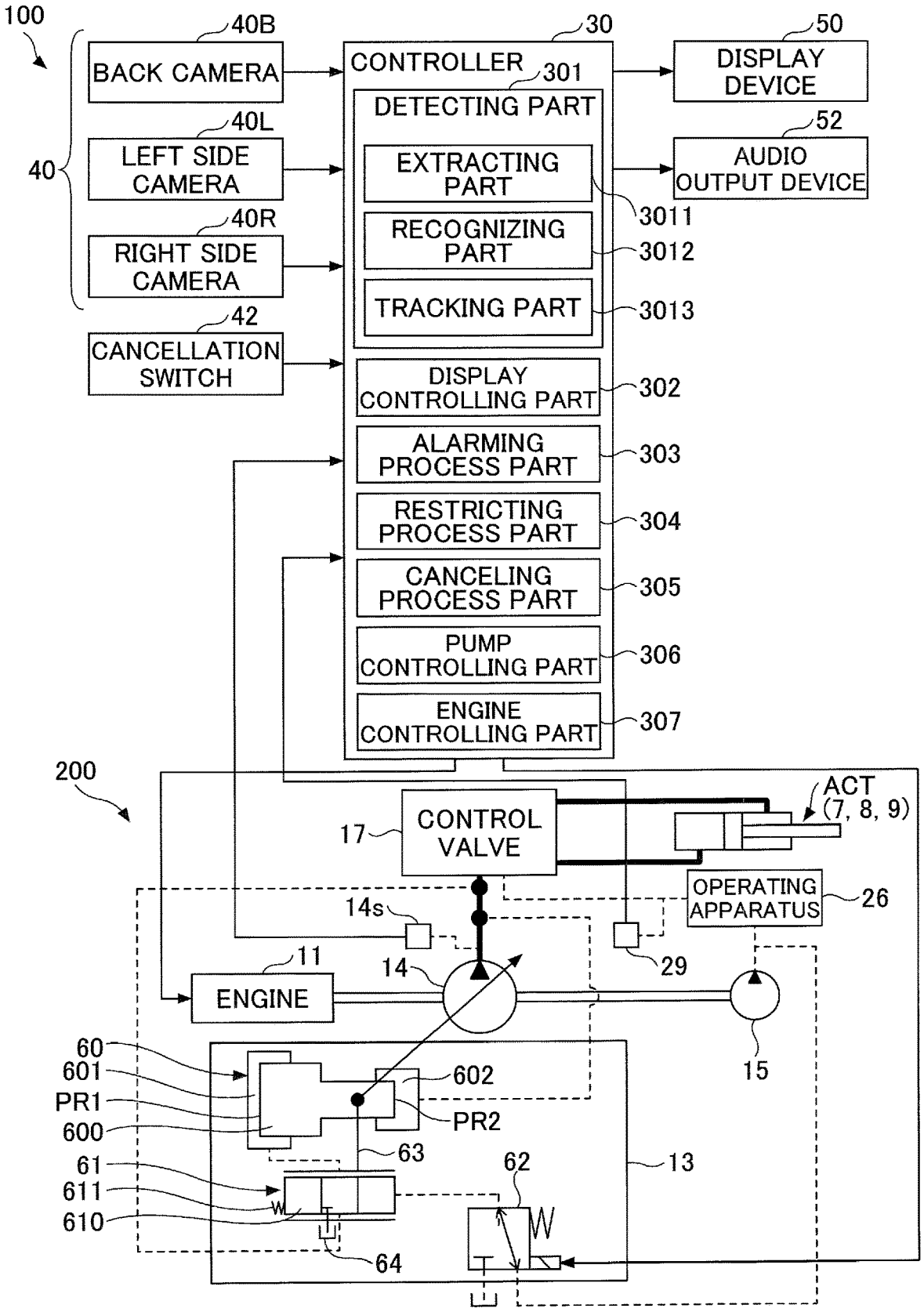
FIG. 2 is a diagram illustrating an example configuration of the surroundings monitoring system and a hydraulic drive system installed in the construction machine according to the embodiment.

FIG. 2 is a block diagram illustrating an example configuration of the surroundings monitoring system 100 and a hydraulic drive system 200 installed in the construction machine according to this embodiment. In the drawing, the thick solid line represents a high-pressure hydraulic line, the dotted line represents a pilot line, and the solid line represents an electrical signal line.

First, the hydraulic drive system 200, which is a constituent element related to the surroundings monitoring system 100 according to this embodiment is described.

The hydraulic drive system 200 hydraulically drives a hydraulic actuator ACT installed in the construction machine under the control of the controller 30. The hydraulic drive system 200 includes the hydraulic actuator ACT, an engine 11, a regulator 13, a main pump 14, a discharge pressure sensor 14*s*, a pilot pump 15, an operating apparatus 26, and a pressure sensor 29.

Examples of the hydraulic actuator ACT, which is a hydraulically driven object, include the boom cylinder 7, the arm cylinder 8, and the bucket cylinder 9 (see FIG. 1). Examples of the hydraulic actuator ACT, which is illustrated as a hydraulic cylinder in the drawing, may also include traveling hydraulic motors that drive the lower traveling body 1 and a turning hydraulic motor that drives the upper turning body 3.

The engine 11 is a power source of the shovel, and is, for example, a diesel engine fueled with diesel fuel. The engine 11 rotates constantly at a predetermined rotational speed (a target rotational speed Nset) under the control of the controller 30 (a below-described engine controlling part 307) to drive the main pump 14 and the pilot pump 15.

The regulator 13 controls the discharge flow rate of the main pump 14 by changing the tilt angle of a variable swash plate 14C (see FIG. 3) of the main pump 14. The regulator 13 includes a tilt actuator 60, a spool valve 61, and a proportional valve 62.

The tilt actuator 60 tilts the swash plate 14*c* that changes the pump displacement of the main pump 14. Specifically, the tilt actuator 60 includes an actuating piston 600 having a larger diameter pressure receiving portion PR1 at one end and a smaller diameter pressure receiving portion PR2 at the other end; a pressure receiving chamber 601 corresponding to the larger diameter pressure receiving portion PR1, and a pressure receiving chamber 602 corresponding to the smaller diameter pressure receiving portion PR2.

The actuating piston 600 is movable to both of the one end side on which the larger diameter pressure receiving portion PR1 is provided and the other end side on which the smaller diameter pressure receiving portion PR2 is provided. The actuating piston 600 is coupled to the swash plate 14C, and can change the tilt angle of the swash plate 14C by being driven to move in the direction of the one end or the direction of the other end in accordance with the magnitude relationship between a force acting on the larger diameter pressure receiving portion PR1 and a force acting on the smaller diameter pressure receiving portion PR2.

The pressure receiving chamber 601 is connected to the spool valve 61. Hydraulic oil discharged from the main pump 14 can be introduced into the pressure receiving chamber 601 via the spool valve 61. Hydraulic oil can be discharged from the pressure receiving chamber 601 via the spool valve 61.

The pressure receiving chamber 602 is connected to the discharge-side high-pressure hydraulic line of the main pump 14.

When hydraulic oil is introduced into the pressure receiving chamber 601 via the spool valve 61, hydraulic oil discharged from the main pump 14 is introduced to both the pressure receiving chambers 601 and 602. At this point, because the area on which the pressure of hydraulic oil acts is larger in the larger diameter pressure receiving portion PR1 than in the smaller diameter pressure receiving portion PR2, the actuating piston 600 moves to the other end side (the pressure receiving chamber 602 side) to tilt the swash plate 14C in such a manner as to reduce the flow rate, namely, to reduce a tilt angle $\alpha$. When hydraulic oil is discharged from the pressure receiving chamber 601 via the spool valve 61, hydraulic oil discharged from the main pump 14 is introduced only to the pressure receiving chamber 602. Therefore, the actuating piston 600 moves to the one end side (the pressure receiving chamber 601 side) to tilt the swash plate 14C in such a manner as to increase the flow rate, namely, to increase the tilt angle $\alpha$.

The spool valve 61 supplies hydraulic oil to and discharges hydraulic oil from the pressure receiving chamber 601 of the tilt actuator 60. The spool valve 61 includes a spool 610 and a spring 611. Furthermore, the spool valve 61 includes a first port connected to the main pump 14 on its discharge side, a second port connected to a hydraulic oil tank 64, and an output port connected to the pressure receiving chamber 601.

The spool 610 moves within the spool valve 61 between a first position at which the first port and the output port communicate and a second position at which the second port and the output port communicate, with reference to a neutral position at which neither the first port nor the second port communicates with the output port.

The spring 611 exerts a force on the spool 610 to urge the spool 610 toward the second position.

The proportional valve 62 moves the spool 610. The proportional valve 62 uses hydraulic oil discharged from the pilot pump 15 to generate a hydraulic pressure (secondary side pressure) commensurate with a command electric current from the controller 30 (a below-described pump controlling part 306).

Specifically, the proportional valve 62 increases the secondary side pressure as the command electric current increases. As the secondary side pressure increases, the spool 610 moves toward the first position. Thus, hydraulic oil is introduced into the pressure receiving chamber 601 from the main pump 14, so that the actuating piston 600 moves to the other end side (the pressure receiving chamber 602 side) to so tilt the swash plate 14C as to reduce the flow rate. As a result, the discharge flow rate of the main pump 14 decreases. When the secondary side pressure decreases, the spool 610 moves toward the second position. Thus, hydraulic oil is discharged from the pressure receiving chamber 601, so that the actuating piston 600 moves to the one end side (the pressure receiving chamber 601 side) to so tilt the swash plate 14C as to increase the flow rate. As a result, the discharge flow rate of the main pump 14 increases.

A feedback lever 63 is a link mechanism that feeds the movement of the tilt actuator 60 back to the spool 610. Specifically, when the actuating piston 600 moves, the feedback lever 63 mechanically feeds the amount of its movement back to the spool 610 to return the spool 610 to its neutral position.

The main pump 14 (an example of a hydraulic pump) is connected to a control valve 17 through a high-pressure hydraulic line, and supplies hydraulic oil to the hydraulic actuator ACT via the control valve 17. The main pump 14 is rotated by the power of the engine 11 to discharge hydraulic oil drawn from the hydraulic oil tank 64 to the high-pressure hydraulic line. The main pump 14 is a variable displacement hydraulic pump, and, as described above, its discharge flow rate can be changed by the regulator 13 tilting the swash plate 14C. A configuration of the main pump 14 is described below with reference to FIG. 3.

Figure 3:
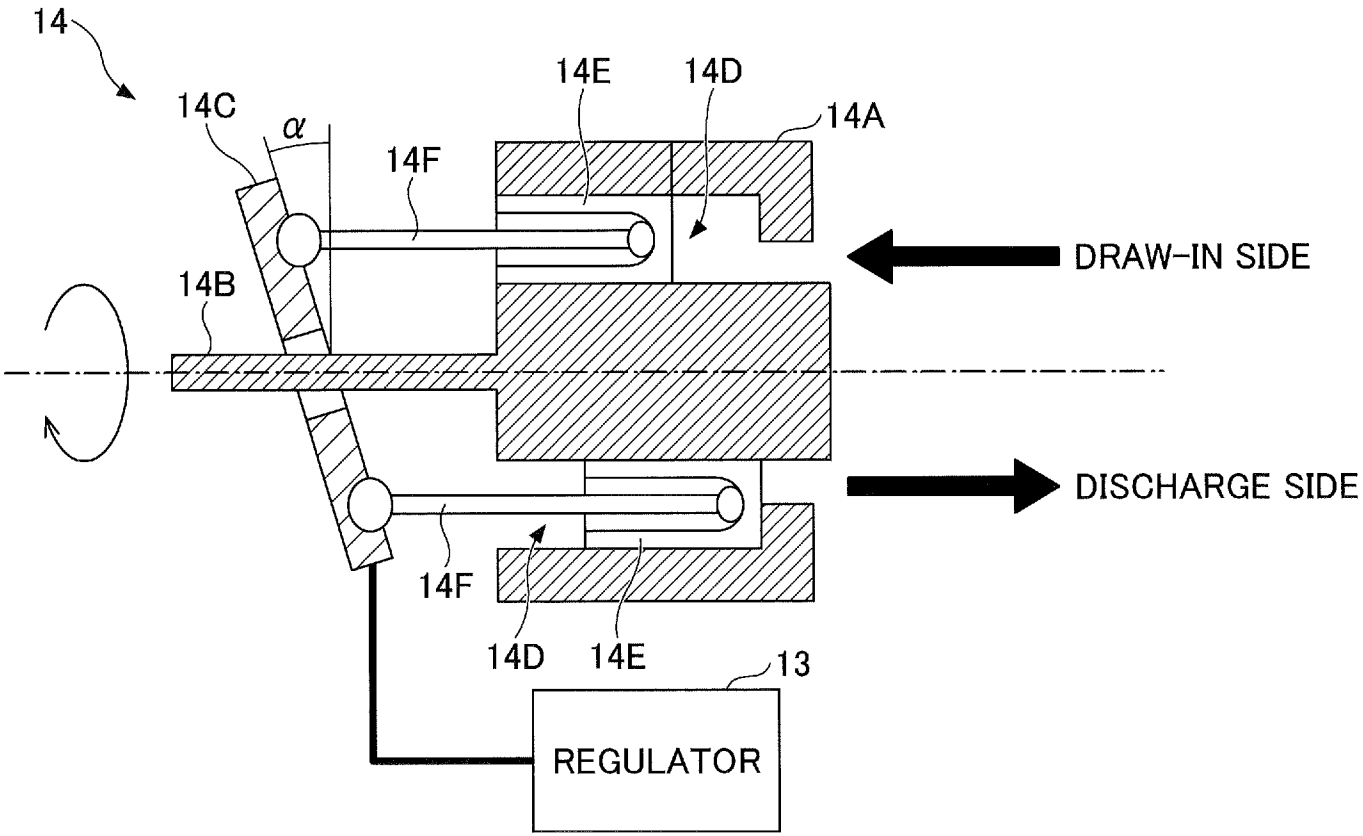
FIG. 3 is a schematic diagram illustrating an example configuration of a main pump.

FIG. 3 is a schematic diagram illustrating an example configuration of the main pump 14.

The main pump 14 includes a cylinder barrel 14A, an input shaft 14B, the swash plate 14C, cylinders 14D, pistons 14E, and rods 14F.

The cylinder barrel 14A has a generally cylindrical shape with the input shaft 14B extending axially from the center of one end of the generally cylindrical shape. The cylinders 14D are circumferentially provided at positions radially apart from the center of the cylinder barrel 14A by a predetermined distance. The generally cylindrical shape of each cylinder 14D allows communication between its one end side (the input shaft 14B side) and its other end side, and each cylinder 14D is connected to the hydraulic oil tank 64 or the high-pressure hydraulic line on its other end side.

The input shaft 14B is connected to the output shaft of the engine 11. As a result, the cylinder barrel 14A is rotated.

The swash plate 14C is generally disk-shaped, and is attached to the input shaft 14B such that the input shaft 14B pierces through its substantial center and a relative angle to the input shaft 14B (the tilt angle $\alpha$) can be changed. The tilt angle $\alpha$ is an angle formed by a plane perpendicular to the input shaft 14B and a plate surface of the swash plate 14C. As described above, the swash plate 14C is mechanically coupled to the regulator 13 (specifically, the actuating piston 600), and is tilted by the regulator 13.

The cylinder 14D is a generally cylindrical hole that accommodates the piston 14E. The cylinder 14D draws in hydraulic oil from the hydraulic oil tank 64 or discharges the drawn hydraulic oil to the high-pressure hydraulic line in accordance with the reciprocating motion of the piston 14E.

The piston 14E has a generally cylindrical shape and is accommodated in the cylinder 14D. The piston 14E is coupled via the rod 14F to a position radially apart from the center of the swash plate 14C by a predetermined distance. As described above, the swash plate 14C has the tilt angle $\alpha$ to the input shaft 14B. Therefore, the rod 14F repeatedly moves toward and away from the cylinder 14D according as the swash plate 14C rotates. Therefore, in the cylinder 14D, the piston 14E reciprocates in the directions of the input shaft 14B according to the rotation of the cylinder barrel 14A, the input shaft 14B, and the swash plate 14C, and draws in hydraulic oil in the hydraulic oil tank 64 to discharge it to the high-pressure hydraulic line. Furthermore, as the tilt angle $\alpha$ of the swash plate 14C becomes larger, the stroke of the reciprocating motion of the piston 14E becomes longer, so that the discharge flow rate of hydraulic oil becomes higher.

Referring back to FIG. 2, the discharge pressure sensor 14*s* detects the hydraulic pressure (discharge pressure) of hydraulic oil discharged from the main pump 14. The discharge pressure sensor 14*s* outputs a detection signal corresponding to the discharge pressure of the main pump 14, and the detection signal is fed into the controller 30.

The pilot pump 15 generates a pilot pressure for operating various hydraulic devices installed in the work machine, including the hydraulic actuator ACT. The pilot pump 15 is rotated by the power of the engine 11 to draw in hydraulic oil from the hydraulic oil tank 64 and discharge it to the pilot line. The pilot pump 15 is, for example, a fixed displacement hydraulic pump.

The control valve 17 is a hydraulic controller that controls the hydraulic actuator ACT in accordance with the operator's operation on the operating apparatus 26. Specifically, the control valve 17 is connected to the hydraulic actuator ACT through a high-pressure hydraulic line, and controls the flow rate and direction of hydraulic oil supplied to the hydraulic actuator ACT in accordance with the secondary side pilot pressure exerted from the operating apparatus 26.

The operating apparatus 26 includes levers, pedals, etc., provided near the operator seat in the cabin 10, and is operation inputting means for receiving the operator's operation of the hydraulic actuator ACT. The pilot pump 15 is connected to the operating apparatus 26 on its primary side, and the control valve 17 is connected to the operating apparatus 26 on its secondary side. The operating apparatus 26 outputs a pilot pressure corresponding to the amount of operation and the direction of operation to the control valve 17, using hydraulic oil discharged from the pilot pump 15 as a source pressure.

The pressure sensor 29 detects the pressure (pilot pressure) of hydraulic oil on the secondary side of the operating apparatus 26. That is, the pressure sensor 29 detects a pilot pressure corresponding to the state of the operator's operation (the direction of operation and the amount of operation) on the operating apparatus 26. The pressure sensor 29 outputs a detection signal corresponding to the secondary side pressure of the operating apparatus 26, and the detection signal is fed into the controller 30.

Next, the surroundings monitoring system 100 according to this embodiment is described.

The surroundings monitoring system 100 monitors entry of a predetermined object that is a monitoring target (hereinafter referred to as "monitoring target object") into a predetermined area around the shovel, and in the case of detecting the monitoring target object, issues an alarm and restricts the motion of the shovel. Monitoring target objects include persons such as workers working around the shovel and a supervisor at a work site and obstacles other than persons, including construction materials that are laid flat and construction vehicles such as trucks. The surroundings monitoring system 100 includes the controller 30, the image capturing unit 40, the cancellation switch 42, the display device 50, and the audio output device 52.

The controller 30 performs a primary control process in the surroundings monitoring system 100. The functions of the controller 30 may be implemented by any hardware, software, or their combination, and is, for example, composed mainly of a microcomputer including a CPU, a RAM, a ROM, and an I/O device. The controller 30 includes, for example, a detecting part 301, the display controlling part 302, an alarming process part 303, a restricting process part 304, a canceling process part 305, the pump controlling part 306, and the engine controlling part 307 as functional parts that are implemented by executing various programs stored in the ROM or the like on the CPU.

As described above, the image capturing unit 40 includes the back camera 40B, the left side camera 40L, and the right side camera 40R. The back camera 40B, the left side camera 40L, and the right side camera 40R are attached to the top of the upper turning body 3 such that their optical axes point obliquely downward, and have respective predetermined vertical imaging ranges (angles of view) covering the ground near the shovel to an area far from the shovel. While the shovel is in operation, the back camera 40B, the left side camera 40L, and the right side camera 40R output captured images at predetermined intervals (for example, every 1/30 seconds), and the captured images are fed into the controller 30.

The cancellation switch 42 (an example of an operating part) is operation inputting means with which the operation of canceling the output of an alarm by the alarming process part 303 and a motion restriction by the restricting process part 304 is performed. The following description proceeds based on the assumption that the cancellation switch 42 is as described above (the operation inputting means with which the operation of canceling a motion restriction is performed) unless otherwise specified. The cancellation switch 42 may be a hardware switch (for example, a push button switch or the like) or a software switch displayed on the operation screen of the display device 50 of a touchscreen type. Furthermore, operation inputting means for canceling the output of an alarm by the alarming process part 303 and operation inputting means for canceling a motion restriction by the restricting process part 304 may be separately provided.

Figure 4A:
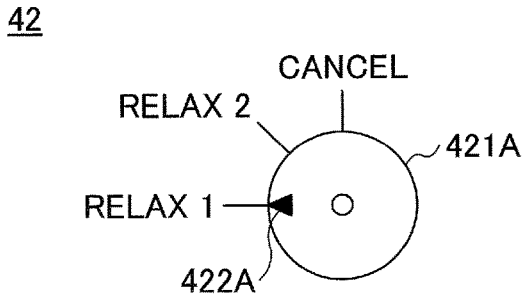
FIG. 4A is a diagram illustrating an example cancellation switch using hardware that enables selection from multiple options as to the degree of relaxation of a motion restriction.
Figure 4B:
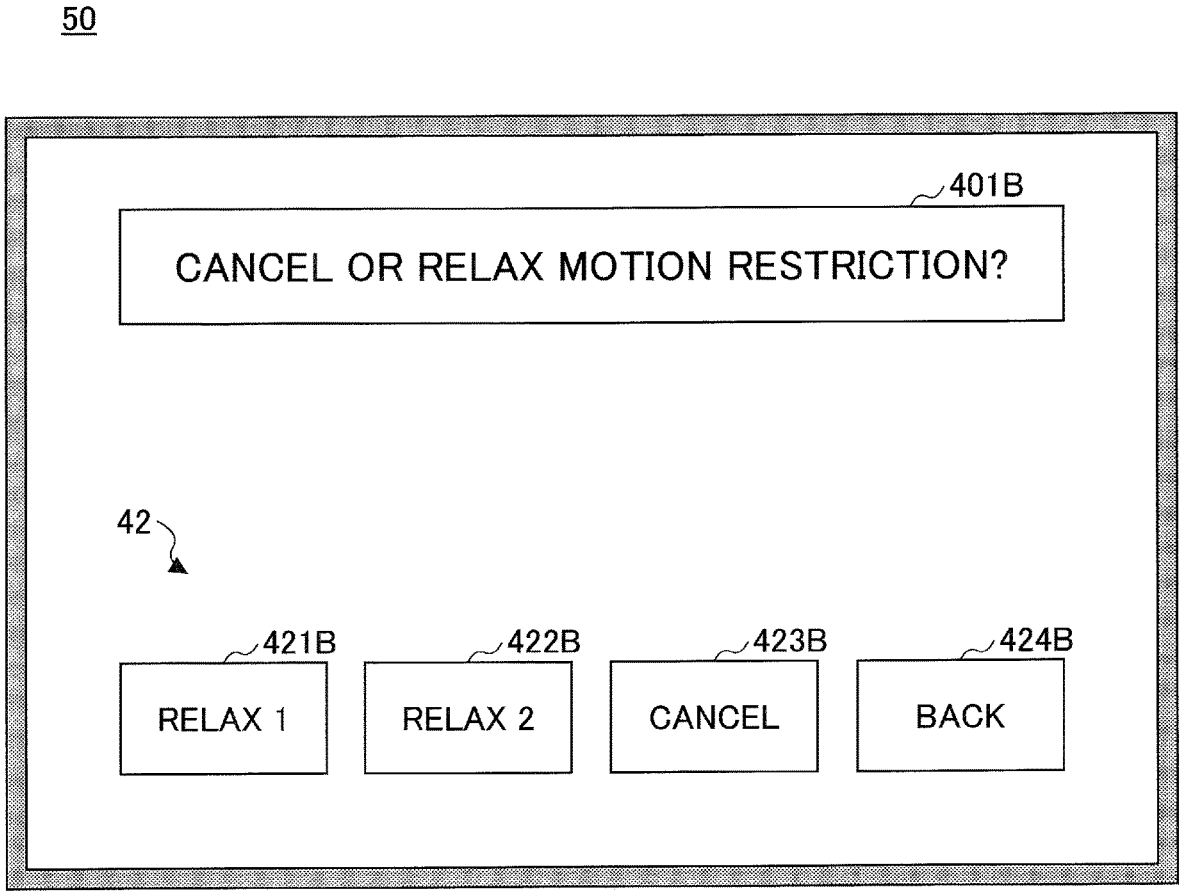
FIG. 4B is a diagram illustrating an example cancellation switch using software that enables selection from multiple options as to the degree of relaxation of a motion restriction.

Furthermore, the cancellation switch 42 may be operation inputting means with which the operation of canceling the output of an alarm by the alarming process part 303 and operation inputting means with which the operation of canceling or relaxing a motion restriction by the restricting process part 304. In this case, the cancellation switch 42 may be operation inputting means that enables the operator or the like to make a selection from multiple options as to the degree of relaxation of the motion restriction of the shovel. The maximum of the degree of relation of a motion restriction corresponds to the cancellation of a motion restriction. As the degree of relaxation decreases, the degree of motion restriction increases. For example, FIG. 4 (FIGS. 4A and 4B) is a diagram illustrating specific examples of the cancellation switch 42 that enable selection from multiple options as to the degree of relaxation of a motion restriction. Specifically, FIG. 4A is a diagram illustrating an example of the cancellation switch 42 using hardware that enables selection from multiple options as to the degree of relaxation of a motion restriction. FIG. 4B is a diagram illustrating an example of the cancellation switch 42 using software that enables selection from multiple options as to the degree of relaxation of a motion restriction.

The alarming process part 303 may cancel the output of an alarm in response to the operation of the cancellation switch 42 whichever option is selected by the cancellation switch 42.

As illustrated in FIG. 4A, according to this example, the cancellation switch 42 includes a turnable dial part 421A. A triangular mark 422A is provided along the periphery of the front end face (the end face visible to an operating person such as the operator) of the dial part 421A. The operator or the like can turn the dial part 421A stepwise to set the triangular mark 422A to one of "RELAX 1," "RELAX 2," and "CANCEL" noted along the periphery of the dial part 421A. The operator or the like can operate the cancellation switch 42 with one of "RELAX 1," "RELAX 2," and "CANCEL" being selected, by pushing the dial part 421A in that state.

"RELAX 1," "RELAX 2," and "CANCEL" each represent the degree of relaxation of a motion restriction, and increase in the degree of relaxation in that order. That is, "RELAX 1" has the lowest degree of relaxation, "RELAX 2" has the next lowest degree of relaxation, and "CANCEL" has the highest degree of relaxation (the maximum degree of relaxation). As the degree of relaxation of a motion restriction increases, the flow rate of hydraulic oil supplied to hydraulic actuators corresponding to various operating elements (that is, the discharge flow rate of the main pump 14) may increase.

Furthermore, as illustrated in FIG. 4B, in this example, the cancellation switch 42 is implemented by software as button icons 421B through 423B displayed on the operation screen of the display device 50 of a touchscreen type. The operation screen may be, for example, displayed in response to the operator's predetermined operation on a main screen displayed on the display device 50 or displayed automatically when the restricting process part 304 starts to restrict the motion of the shovel.

Character information 401B that "CANCEL OR RELAX MOTION RESTRICTION?" is described at the top of the operation screen. The character information 401B indicates that the operation screen is an operation screen related to the cancellation or relaxation of a motion restriction. In addition, the button icons 421B through 423B and a button icon 424B are laterally arranged at the bottom of the operation screen.

The button icons 421B through 423B are operation inputting means for relaxing or canceling the motion restriction of the shovel at a predetermined degree of relaxation. Specifically, the letters of "RELAX 1," "RELAX 2," and "CANCEL" are written on the button icons 421B through 423B, respectively, and the degree of relaxation increases in that order. The operator or the like can operate the cancellation switch 42 with one of "RELAX 1," "RELAX 2," and "CANCEL" being selected, by selecting and deciding on one of the button icons 421B through 423B (for example, touching the position of the button icon 421B, 422B or 423B on the operation screen of the display device 50).

The button icon 424B is operation inputting means for stopping the operation of relaxing or canceling the motion restriction of the shovel on the operation screen and switching the display contents of the display device 50 from the operation screen to a predetermined screen (for example, a predetermined main screen) by the operator or the like. Furthermore, the button icons 421B through 424B, which are displayed on a dedicated operation screen, may alternatively be displayed over another screen (for example, a monitoring image as described below) automatically when the restricting process part 304 starts to restrict the motion of the shovel with the other screen being displayed.

A signal related to the operational state of the cancellation switch 42 (an operational state signal) is fed into the controller 30.

The display device 50 displays a captured image (through-the-lens image) of the image capturing unit 40, a surrounding image (for example, a viewpoint transformed image as described below) that the controller 30 (the display controlling part 302) generates based on the image captured by the image capturing unit 40, etc.

The audio output device 52 outputs an alarm sound under the control of the controller 30 (the alarming process part 303).

The detecting part 301 detects a monitoring target object within a predetermined area around the shovel, for example, within a predetermined distance D1 (for example, 5 meters) from the shovel, based on a captured image captured by the image capturing unit 40. For example, by applying various known image processing techniques and machine learning-based identifiers as desired, the detecting part 301 can recognize a monitoring target object in the captured image and identify the actual position of the recognized monitoring target object (such as a distance D from the shovel to the recognized monitoring target object). Furthermore, for example, in recognizing a monitoring target object in the captured image, the detecting part 301 can also identify the type of the recognized monitoring target object. Specifically, the detecting part 301 can identify whether the recognized monitoring target object is a person or an obstacle other than a person.

The detecting part 301 may detect a monitoring target object around the shovel based on the detection result (such as a distance image) of another sensor such as a millimeter wave radar, LIDAR (Light Detection And Ranging), or a stereo camera instead of or in addition to the image captured by the image capturing unit 40. In this case, these other sensors are installed in the shovel.

The display controlling part 302 causes various information images to be displayed on the display device 50 in accordance with the operator's various operations. For example, the display controlling part 302 generates a surrounding image based on an image captured by the image capturing unit 40 and causes the surrounding image to be displayed on the display device 50 in accordance with the operator's predetermined operation. Specifically, the display controlling part 302 generates a viewpoint transformed image (an image as viewed from a virtual viewpoint) by performing a known viewpoint transformation process, based on images captured by the back camera 40B, the left side camera 40L, and the right side camera 40R, and causes the viewpoint transformed image to be displayed on the display device 50 as the surrounding image. Furthermore, in causing the surrounding image to be displayed on the display device 50, the display controlling part 302 causes a shovel image schematically representing the shovel to be displayed together on the display device 50 in order to clearly indicate the relative positional relationship between the imaging range of the image capturing unit 40 shown in the surrounding image and the shovel. That is, the display controlling part 302 generates a monitoring image including a shovel image and a surrounding image placed along the periphery of the shovel image in accordance with the relative positional relationship between the shovel and the imaging range of the image capturing unit 40, and causes the monitoring image to be displayed on the display device 50. The monitoring image displayed on the display device 50 is described below with reference to FIG. 5.

Figure 5:
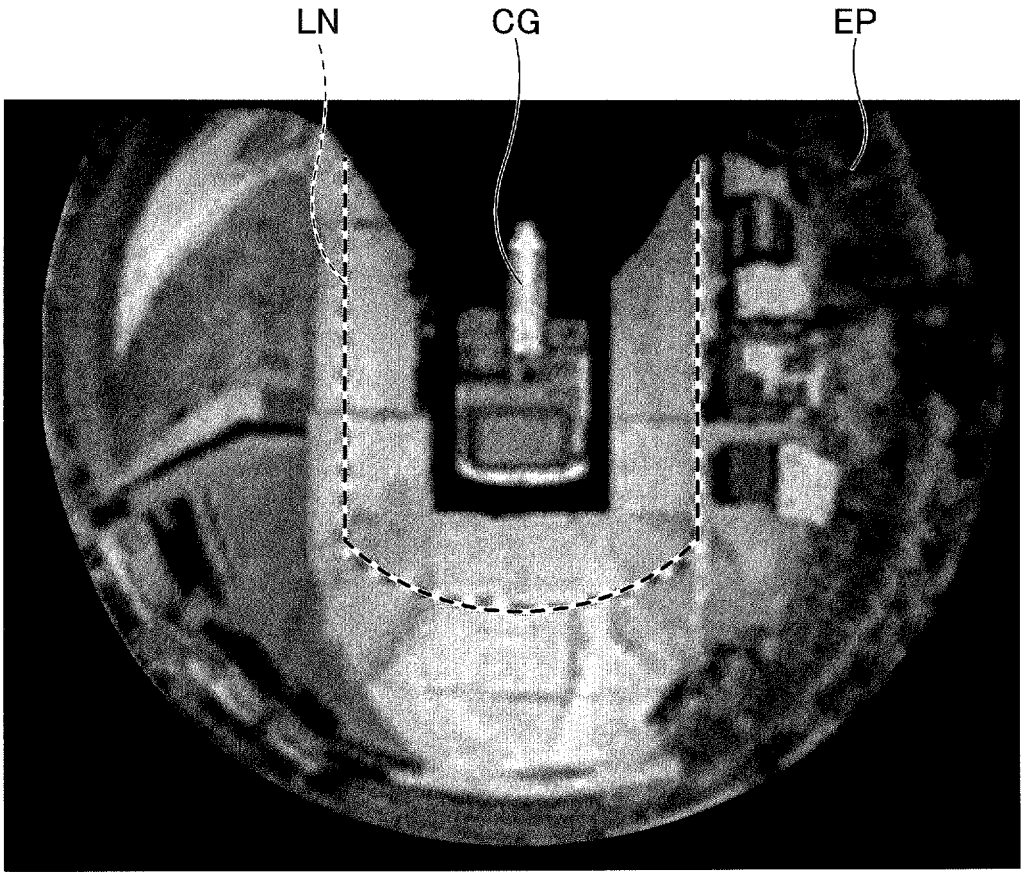
FIG. 5 is a diagram illustrating an example monitoring image displayed on a display device.

FIG. 5 is a diagram illustrating an example of the monitoring image displayed on the display device 50.

As illustrated in FIG. 5, a monitoring image including a shovel image CG and a surrounding image EP placed along the periphery of the shovel image CG is displayed on a laterally elongated rectangular screen (for example, a screen of an aspect ratio of 4:3) on the display device 50 as described above. This makes it possible for the operator to appropriately understand the positional relationship between a monitoring target image including a person shown in the surrounding image EP and the shovel.

The surrounding image EP according to this example is a viewpoint transformed image that is a combination of a road surface image looking at the surroundings of the shovel from directly above and a horizontal image looking horizontally at the surroundings of the shovel and placed along the periphery of the road surface image. A surrounding image (a viewpoint transformed image) is obtained by projecting respective captured images of the back camera 40B, the left side camera 40L, and the right side camera 40R onto a space model and re-projecting the projected images projected onto the space model onto a different two-dimensional plane. The space model is an object onto which a captured image is projected in a virtual space, and is composed of one or more plane surfaces or curved surfaces that include a plane surface or a curved surface different from a plane surface in which the captured image is positioned. The following description proceeds based on the assumption that a surrounding image according to this embodiment is a viewpoint transformed image that is a combination of the road surface image and the horizontal image.

A line segment LN is displayed over the monitoring image. The line segment LN represents positions where the distance from the shovel is a predetermined distance D2 described below. As a result, when a monitoring target object including a person is shown in the surrounding image, the operator can understand how far it is positioned from the shovel.

Referring back to FIG. 2, the alarming process part 303 alarms the operator when the detecting part 301 detects a monitoring target object (for example, a person) within the predetermined distance D1 from the shovel. For example, the alarming process part 303 transmits a display request to the display controlling part 302 to display an alarm about a monitoring target object present around the shovel on the display device 50 and causes an alarm sound to be output through the audio output device 52. Furthermore, for example, the alarming process part 303 may increase the alarm level of the alarm that represents the degree of danger as the distance between the shovel and the monitoring target object decreases within a predetermined area around the shovel (within the predetermined distance D1 from the shovel). Specifically, the alarming process part 303 may change the alarm level (the specifications of the alarm) depending on whether the distance D from the shovel to the monitoring target object detected by the detecting part 301 is less than or equal to the predetermined distance D2 (for example, 2.5 meters), which is smaller than the predetermined distance D1. For example, if the distance D from the shovel to the detected monitoring target object is less than or equal to the predetermined distance D1 and greater than the predetermined distance D2, the alarming process part 303 issues a preliminary alarm (for example, causes a loudspeaker to output an alarm sound of a relatively low volume), determining that the degree of danger is relatively low in attention state (at alarm level 1). Furthermore, if the distance D from the shovel to the detected monitoring target object is less than or equal to the predetermined distance D2, the alarming process part 303 issues a formal alarm (for example, causes a loudspeaker to output an alarm sound of a relatively high volume), determining that the degree of danger is relatively high in alert state (at alarm level 2).

When the detecting part 301 detects a monitoring target object within a predetermined area around the shovel (within the predetermined distance D1 from the shovel), the restricting process part 304 (an example of a restricting part) restricts the motion of the shovel by reducing the discharge flow rate of the main pump 14.

For example, the restricting process part 304 transmits a restriction request to the pump controlling part 306 to change (reduce) the tilt angle $\alpha$ of the swash plate 14C of the main pump 14, thereby reducing the discharge flow rate of the main pump 14. Specifically, the pump controlling part 306 sets an upper limit value (an upper limit tilt angle $\alpha$lim) smaller than a maximum tilt angle $\alpha$max corresponding to a maximum discharge flow rate Qmax for the tilt angle $\alpha$, and performs pump control (total power control and negative control described below) at or below the upper limit tilt angle $\alpha$lim.

Furthermore, for example, the restricting process part 304 outputs a restriction request to the engine controlling part 307 to reduce the rotational speed of the engine 11, namely, the target rotational speed Nset, and reduce the power of the engine 11, thereby reducing the discharge flow rate of the main pump 14.

Furthermore, for example, the restricting process part 304 outputs a restriction request to both the pump controlling part 306 and the engine controlling part 307, thereby restricting both the tilt angle $\alpha$ of the swash plate 14C and the rotational speed of the engine 11 (the target rotational speed Nset).

Furthermore, for example, when the detecting part 301 detects a monitoring target object within a predetermined area around the shovel, the restricting process part 304 may perform motion restriction differently in a non-uniform manner for each of operating elements whose motion is to be restricted (for example, the lower traveling body 1, the upper turning body 3, the boom 4, the arm 5, the bucket 6, etc.). In this case, the restricting process part 304 controls, independent of the state of the operator's operation, control valves provided one for each operating element in the control valve 17 and controlling the flow rate and direction of hydraulic oil supplied to the corresponding hydraulic actuator ACT. For example, a solenoid proportional valve that can restrict a pilot pressure in response to a control signal from the controller 30 may be provided in a pilot line between the operating apparatus 26 and the control valve with respect to each operating element. This makes it possible for the controller 30 (the restricting process part 304) to control a secondary side pilot pressure acting on the control valves independent of the state of the operator's operation.

Specifically, the restricting process part 304 may restrict the traveling motion of the lower traveling body 1 in a direction to move the shovel toward a monitoring target object detected by the detecting part 301 while not restricting the traveling motion of the lower traveling body 1 in a direction to move the shovel away from the monitoring target object detected by the detecting part 301. Furthermore, the restricting process part 304 may restrict the motion of (the hydraulic actuator ACT corresponding to) the lower traveling body 1 such that the degree of restriction is higher in the case where the lower traveling body 1 travels in a direction to move the shovel toward a monitoring target object detected by the detecting part 301 than in the case where the lower traveling body 1 travels in a direction to move the shovel away from the monitoring target object. That is, the restricting process part 304 may restrict the motion of the lower traveling body 1 such that the lower traveling body 1 does not move or moves at a relatively low speed in a direction toward a monitoring target object while moving at a relatively high speed in a direction away from the monitoring target object. In this case, the restricting process part 304 may determine the direction toward and the direction away from the monitoring target object between the two directions in which the lower traveling body 1 can travel, based on, for example, the turning angle of the upper turning body 3 that can be obtained by a turning angle sensor (not depicted) and the position of the monitoring target object as viewed from the upper turning body 3 that can be recognized by the detecting part 301. As a result, a situation where the shovel approaches a detected monitoring target can be prevented to ensure safety, and with respect to the movement of the shovel in a direction away from the monitoring target, the degree of restriction of the motion can be controlled to ensure the workability of the shovel. That is, it is possible to achieve both safety and workability of the shovel.

When monitoring target objects are present one on each lateral side of the lower traveling body 1, the distance between the shovel and the monitoring target objects hardly changes in whichever direction (the front or rear direction of the lower traveling body 1) the lower traveling body 1 travels. Therefore, in such a case, the restricting process part 304 may not restrict the traveling motion of the lower traveling body 1 or may impose a motion restriction whose degree of restriction is relatively low with respect to the movement in either direction.

Specifically, the restricting process part 304 may restrict only the motion of the lower traveling body 1, the upper turning body 3, etc., and may not restrict the motion of the attachment (the boom 4, the arm 5, and the bucket 6). Furthermore, the restricting process part 304 may restrict the motion of the attachment with a degree of restriction lower than a degree of restriction for the lower traveling body 1, the upper turning body 3, etc. (that is, in such a manner as to supply a relatively high flow rate to a corresponding hydraulic actuator to allow operation at a certain speed). This is because the attachment operates in a range visible from the operator in the cabin 10 (in front of the upper turning body 3) and the safety can be therefore visually ensured by the operator. As a result, the shovel can work with the attachment to a certain degree even under motion restriction. Therefore, it is possible to ensure a certain degree of workability while ensuring safety.

Furthermore, for example, the restricting process part 304 may change the degree of motion restriction (the degree of restriction) in accordance with other conditions (for example, a condition regarding the distance D between a detected monitoring target object and the shovel, etc.) as described above. The details of a process of changing the degree of motion restriction by the restricting process part 304 are described below (see, FIGS. 9 through 12 and FIGS. 14 through 19).

The canceling process part 305 cancels an alarm output by the alarming process part 303 when the cancellation switch 42 is operated after the start of the output of the alarm or when a monitoring target object is no longer detected by the detecting part 301.

Furthermore, the canceling process part 305 (an example of a restriction degree controlling part) relaxes or cancels a restriction on the motion of the shovel by the restricting process part 304 when the cancellation switch 42 is operated after the start of the motion restriction of the shovel by the restricting process part 304 or when a monitoring target object is no longer detected by the detecting part 301. The operator is believed to operate the cancellation switch 42 after checking the surroundings of the shovel in response to an alarm output by the alarming process part 303. Furthermore, when a monitoring target object is no longer detected by the detecting part 301, it can be considered that the safety around the shovel is ensured. Therefore, it is possible to relax or cancel the motion restriction of the shovel while ensuring safety.

For example, the canceling process part 305 transmits a cancellation request to the alarming process part 303. As a result, the alarming process part 303 cancels (stops) the outputting of an alarm.

Furthermore, for example, the canceling process part 305 transmits a relaxation request or a cancellation request to the pump controlling part 306 and/or the engine controlling part 307 as a functional part corresponding to an object (at least one of the tilt angle $\alpha$ of the swash plate 14C and the rotational speed of the engine 11) changed by the restricting process part 304 at the start of a motion restriction. As a result, the motion restriction of the shovel, that is, reduction in the discharge flow rate of the main pump 14, is relaxed or canceled.

Furthermore, for example, in the case where the restricting process part 304 has restricted the motion of the shovel by changing both the tilt angle $\alpha$ of the swash plate 14C and the rotational speed of the engine 11, the canceling process part 305 first increases the rotational speed of the engine 11 and thereafter increases the tilt angle $\alpha$ of the swash plate 14C.

Furthermore, for example, when relaxing or canceling the motion restriction of the shovel, the canceling process part 305 may change the specifications of a relaxation or cancellation (namely, the rate of increasing the discharge flow rate of the main pump 14, etc.) in accordance with other conditions. The process of changing the specifications of the relaxation or cancellation of a motion restriction by the canceling process part 305 is described in detail below (see FIGS. 20 through 27).

Furthermore, for example, when relaxing or canceling the motion restriction of the shovel, the canceling process part 305 may relax or cancel a motion restriction on a different operating element among multiple operating elements (such as, the lower traveling body 1, the upper turning body 3, the boom 4, the arm 5, and the bucket 6) in accordance with other conditions. In this case, the canceling process part 305 controls, independent of the state of the operator's operation, control valves provided one for each operating element in the control valve 17 and controlling the flow rate and direction of hydraulic oil supplied to the corresponding hydraulic actuator ACT as described above. This makes it possible for the controller 30 (the canceling process part 305) to control a secondary side pilot pressure acting on the control valves independent of the state of the operator's operation. Therefore, even when a restriction on the flow rate of the main pump 14 is canceled, it is possible to continue to restrict the motion of only one or some operating elements. The process of relaxing or canceling a motion restriction on a different operating element in accordance with conditions by the canceling process part 305 is described in detail below (see FIG. 28).

Furthermore, for example, when relaxing or canceling the motion restriction of the shovel, the canceling process part 305 may cause the mode of cancellation to differ from operating element to operating element. In this case, the canceling process part 305 controls, independent of the state of the operator's operation, control valves provided one for each operating element in the control valve 17 and controlling the flow rate and direction of hydraulic oil supplied to the corresponding hydraulic actuator ACT as described above. This makes it possible for the controller 30 (the canceling process part 305) to control a secondary side pilot pressure acting on the control valves independent of the state of the operator's operation. Therefore, it is possible to relax or cancel the motion restriction in a mode that differs from operating element to operating element. The process of causing the mode of cancellation to differ for each operating element by the canceling process part 305 is described in detail below (see FIG. 29).

The pump controlling part 306 controls the discharge flow rate of the main pump 14. For example, the pump controlling part 306 controls the discharge flow rate of the main pump 14 by performing negative control (negative control) and power control.

Specifically, the pump controlling part 306 performs negative control according to a pressure (negative control pressure) upstream of the negative control throttle provided between the control valve 17 and the hydraulic oil tank 64 in an oil passage from the main pump 14 to the hydraulic oil tank 64 via the control valve 17. More specifically, the pump controlling part 306 decreases the target value (negative control target value) of the discharge flow rate as the negative control pressure increases, and increases the negative control target value as the negative control pressure decreases.

The pump controlling part 306 performs power control such that the absorbed power of the main pump 14 does not exceed the output (power) of the engine 11, based on the discharge pressure P of the main pump 14 detected by the discharge pressure sensor 14*s*. The power control is described below with reference to FIG. 6.

Figure 6:
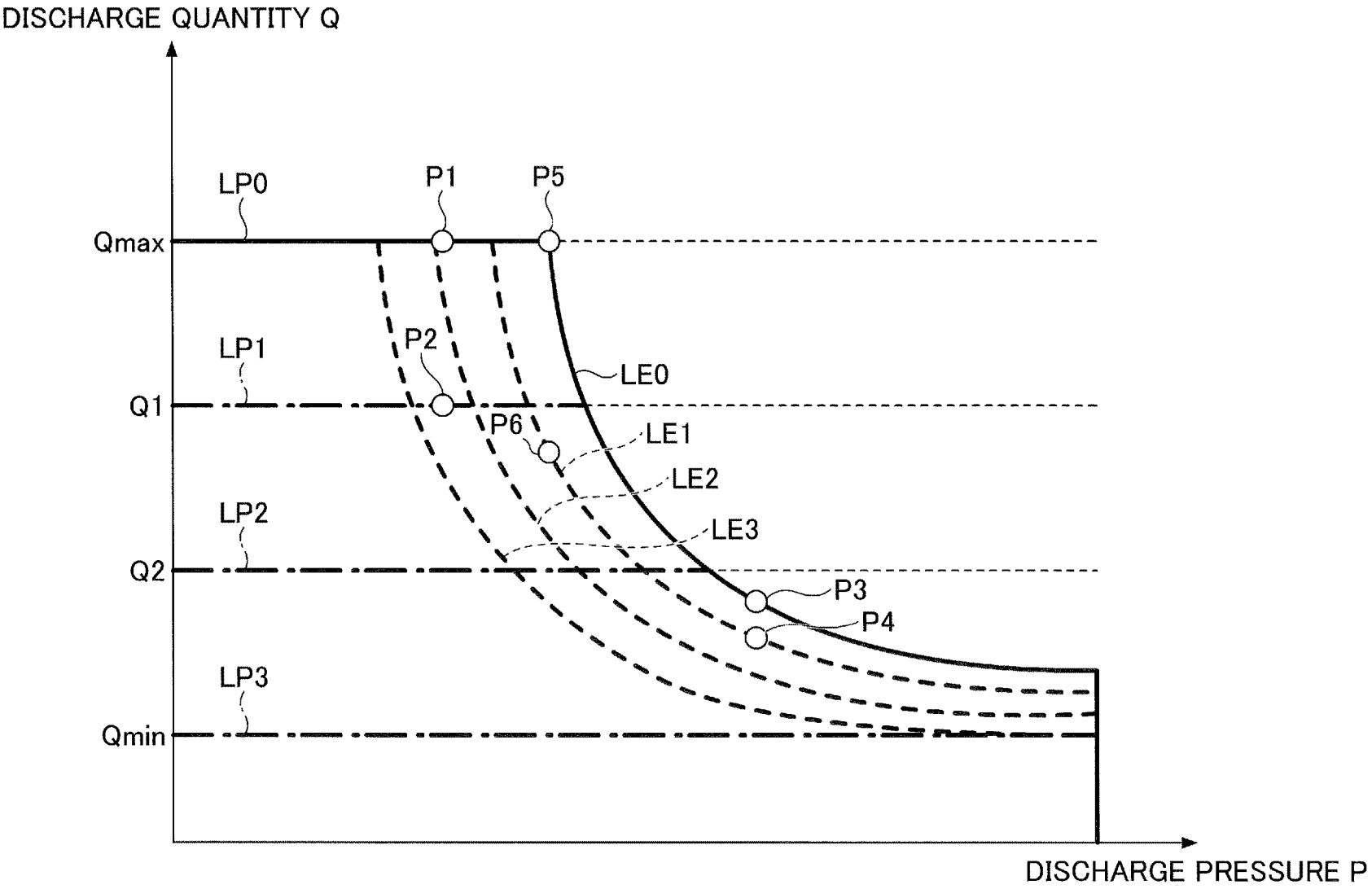
FIG. 6 is a diagram illustrating the relationship between the discharge pressure and the discharge flow rate of the main pump.

FIG. 6 is a diagram illustrating an example of the relationship between the discharge pressure P and the discharge flow rate Q of the main pump 14.

The absorbed power of the main pump 14 is expressed as the product of the discharge pressure P and the discharge flow rate Q. Accordingly, in order for the absorbed power of the main pump 14 not to exceed the output of the engine 11, the pump controlling part 306 determines the target value (power control target value) of the discharge flow rate Q such that the target value does not exceed a curve LE0 at which the product of the discharge pressure P and the discharge flow rate Q is constant. In addition, the tilt angle $\alpha$ of the swash plate 14C has a maximum tilt angle $\alpha$max, and the main pump 14 has a maximum discharge flow rate Qmax (a line segment LP0 in the drawing) corresponding to the maximum tilt angle $\alpha$max as the limit of the discharge flow rate Q. Accordingly, the pump controlling part 306 determines the power control target value such that the power control target value does not exceed the line segment LP0 corresponding to the maximum discharge flow rate Qmax and the curve LE0 at which the absorbed power (the product of the discharge pressure P and the discharge flow rate Q) is constant. That is, the pump controlling part 306 sets the power control target value substantially to the maximum discharge flow rate Qmax in the range where the discharge pressure P is less than or equal to a predetermined pressure, and determines the power control target value by decreasing the discharge flow rate Q as the discharge pressure P increases in the range where the discharge pressure P exceeds the predetermined pressure.

The pump controlling part 306 outputs a command electric current to the regulator 13 (the proportional valve 62), determining the smaller of the negative control target value and the power control target value as the target value of the discharge flow rate Q.

Furthermore, in response to a restriction request from the restricting process part 304, the pump controlling part 306 controls the discharge flow rate Q such that the discharge flow rate Q is at or below an upper limit discharge flow rate Qlim (corresponding to the upper limit tilt angle $\alpha$lim) smaller than the maximum discharge flow rate Qmax (corresponding to the maximum tilt angle $\alpha$max). For example, in the case where a predetermined flow rate Q1 (<Qmax) is set as the upper limit discharge flow rate Qlim, the pump controlling part 306 decreases the discharge flow rate Q to the predetermined flow rate Q1 (Point P2) when the restriction request is output with the discharge flow rate Q corresponding to the maximum discharge flow rate Qmax (Point P1) as illustrated in FIG. 6. Then, the pump controlling part 306 performs negative control and power control, setting the predetermined flow rate Q1 as the upper limit of the discharge flow rate Q, during motion restriction. When the restriction request is output with the discharge flow rate Q being lower than the predetermined flow rate Q1 (Point P3), however, the pump controlling part 306 does not change the discharge flow rate Q (Point P3).

Furthermore, as illustrated in FIG. 6, even when restricting the upper limit of the discharge flow rate Q of the main pump 14 to the predetermined flow rate Q1 or a predetermined flow rate Q2 (particularly in the case where the output of the engine 11 is not restricted), the pump controlling part 306 can cause the main pump 14 to output the discharge pressure P to a certain extent commensurate with the motion of the attachment or the like. That is, for example, by transmitting a control request to the pump controlling part 306, the restricting process part 304, through the pump controlling part 306, can cause the main pump 14 to output the discharge pressure P that enables an excavating motion by the attachment even when restricting the discharge flow rate Q of the main pump 14. As a result, even under motion restriction, the shovel can continue an excavating motion by the attachment although at low speed.

Furthermore, when receiving a cancellation request from the canceling process part 305 after receiving a restriction request from the restricting process part 304, the pump controlling part 306 returns the upper limit of the discharge flow rate Q to the maximum discharge flow rate Qmax from the upper limit discharge flow rate Qlim. When receiving a relaxation request from the canceling process part 305 after receiving a restriction request from the restricting process part 304, the pump controlling part 306 may relax the upper limit of the discharge flow rate Q from the upper limit discharge flow rate Qlim at the time to a newly set higher upper limit discharge flow rate Qlim.

The engine controlling part 307 performs such control as to cause the engine 11 to constantly rotate at the preset target rotational speed Nset by controlling the amount of fuel injection, etc. The engine controlling part 307 may directly transmit a control command to the fuel injector of the engine 11 or control the engine 11 by transmitting a control request to an engine controller that controls the operation of the engine 11.

Furthermore, the engine controlling part 307 decreases the discharge flow rate of the main pump 14 by decreasing the target rotational speed Nset of the engine 11 in response to a restriction request from the restricting process part 304. Specifically, when the target rotational speed Nset of the engine 11 decreases, the output of the engine 11 decreases. Therefore, for example, as illustrated in FIG. 6, the curve LE0 of the constant absorbed power of the main pump 14 changes to a curve LE1 closer to the origin. At this point, when the restriction request is output with the discharge pressure P being within the range of the curve LE0 (Point P3), the discharge flow rate Q drops from the curve LE0 (Point P3) to the curve LE1 (Point P4) with the same discharge pressure P through the power control of the pump controlling part 306 according to a decrease in the target rotational speed of the engine 11.

When the target rotational speed Nset of the engine 11 is reduced, a change from the discharge flow rate Q corresponding to the curve LE0 to the discharge flow rate Q corresponding to the curve LE1 may be relatively large depending on the discharge pressure P at that time. For example, when the restriction request is output with the discharge pressure P being near the lower limit of the range of the curve LE0 (Point P5), the difference between the discharge flow rates Q corresponding to the curve LE0 and the curve LE1 is relatively large. Therefore, when the target rotational speed Nset is dropped at once to a rotational speed corresponding to the curve LE1, a change in the tilt angle $\alpha$ of the swash plate 14C due to the power control of the pump controlling part 306 cannot respond to a change in the rotational speed of the engine 11 caused by the engine controlling part 307, so that an engine stall may occur. Therefore, the engine controlling part 307 may prevent an engine stall by controlling the rotational speed of the engine 11 based on the discharge pressure P detected by the discharge pressure sensor 14*s*. For example, the engine controlling part 307 calculates a decrease in the discharge flow rate Q due to a decrease in the target rotational speed Nset of the engine 11 from a control map or the like corresponding to FIG. 6, based on the discharge pressure P detected by the discharge pressure sensor 14*s* and the decrease in the target rotational speed Nset corresponding to the restriction request. When the decrease in the discharge flow rate Q due to the decrease in the target rotational speed Nset of the engine 11 is more than or equal to a predetermined threshold, the engine controlling part 307 changes the target rotational speed Nset of the engine 11 in a stepwise manner. This makes it possible to prevent a large change in the discharge flow rate Q and prevent an engine stall.

Furthermore, the engine controlling part 307 increases the discharge flow rate Q of the main pump 14 by restoring (returning to an original state) the target rotational speed Nset of the engine 11 in response to a cancellation request from the canceling process part 305. Furthermore, the engine controlling part 307 may perform relaxation such that the target rotational speed Nset of the engine 11 is not returned to its original state but is somewhat increased, in response to a relaxation request from the canceling process part 305.

Next, a process by the surroundings monitoring system 100 in the case where the detecting part 301 detects a monitoring target object within a predetermined area around the shovel (at the time of detecting a monitoring target object) is described with reference to FIG. 7.

Figure 7:
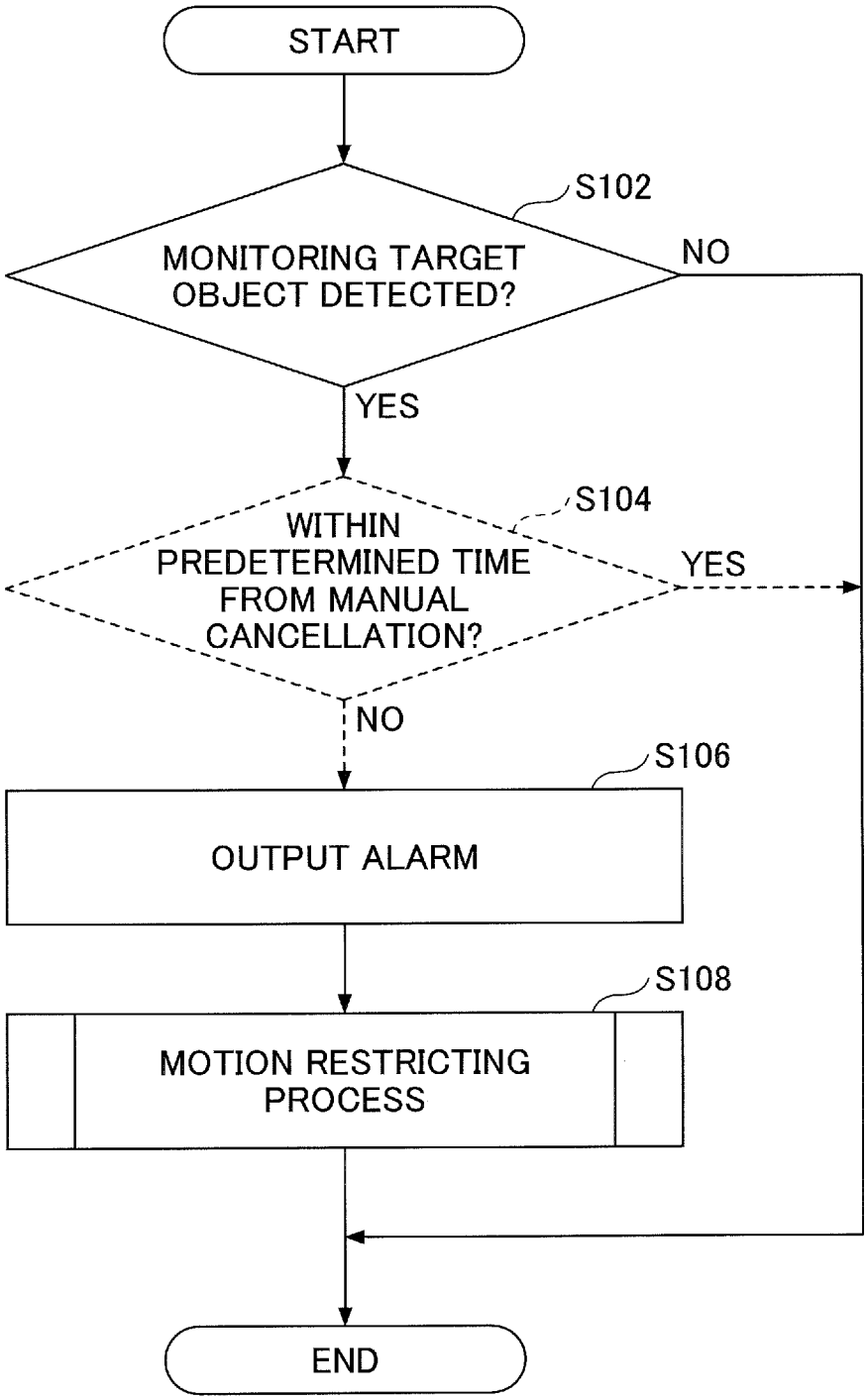
FIG. 7 is a flowchart schematically illustrating an example of a process (alarming process) by the surroundings monitoring system.

FIG. 7 is a flowchart schematically illustrating an example of the process by the surroundings monitoring system 100 at the time of detecting a monitoring target object. The process according to this flowchart is repeatedly executed at predetermined control intervals during the operation of the shovel, for example.

At step S102, the detecting part 301 determines whether a monitoring target object is detected within a predetermined area around the shovel (specifically, within the predetermined distance D1 from the shovel). The detecting part 301 proceeds to step S104 in response to detecting a monitoring target object, and otherwise, ends the process of this time.

At step S104, the alarming process part 303 determines whether the elapsed time from the previous cancellation of an alarm and a motion restriction by the operation of the cancellation switch 42 is less than or equal to a predetermined time (for example, one minute). This is for preventing, for example, when an alarm is issued because of wrong detection of a monitoring target object by the detecting part 301, an alarm from being issued immediately because of continuation of the wrong detection of a monitoring target object by the detecting part 301 despite a user's cancellation of the alarm with the cancellation switch 42. The alarming process part 303 ends the process of this time if the elapsed time from the previous cancellation of an alarm, etc., by the operation of the cancellation switch 42 is less than or equal to a predetermined time, and otherwise, proceeds to step S106.

As indicated by the dotted line in FIG. 7, the process of step S104 may be omitted. In this case, in response to detecting a monitoring target object within a predetermined area around the shovel at step S102, the detecting part 301 proceeds to step S106.

At step S106, the alarming process part 303 outputs an alarm.

At step S108, the restricting process part 304 transmits a restriction request to at least one of the pump controlling part 306 and the engine controlling part 307 to execute a motion restricting process to decrease the discharge flow rate of the main pump 14, and ends the process of this time.

Next, the process of canceling an alarm and a motion restriction by the surroundings monitoring system 100 is described with reference to FIG. 8.

Figure 8:
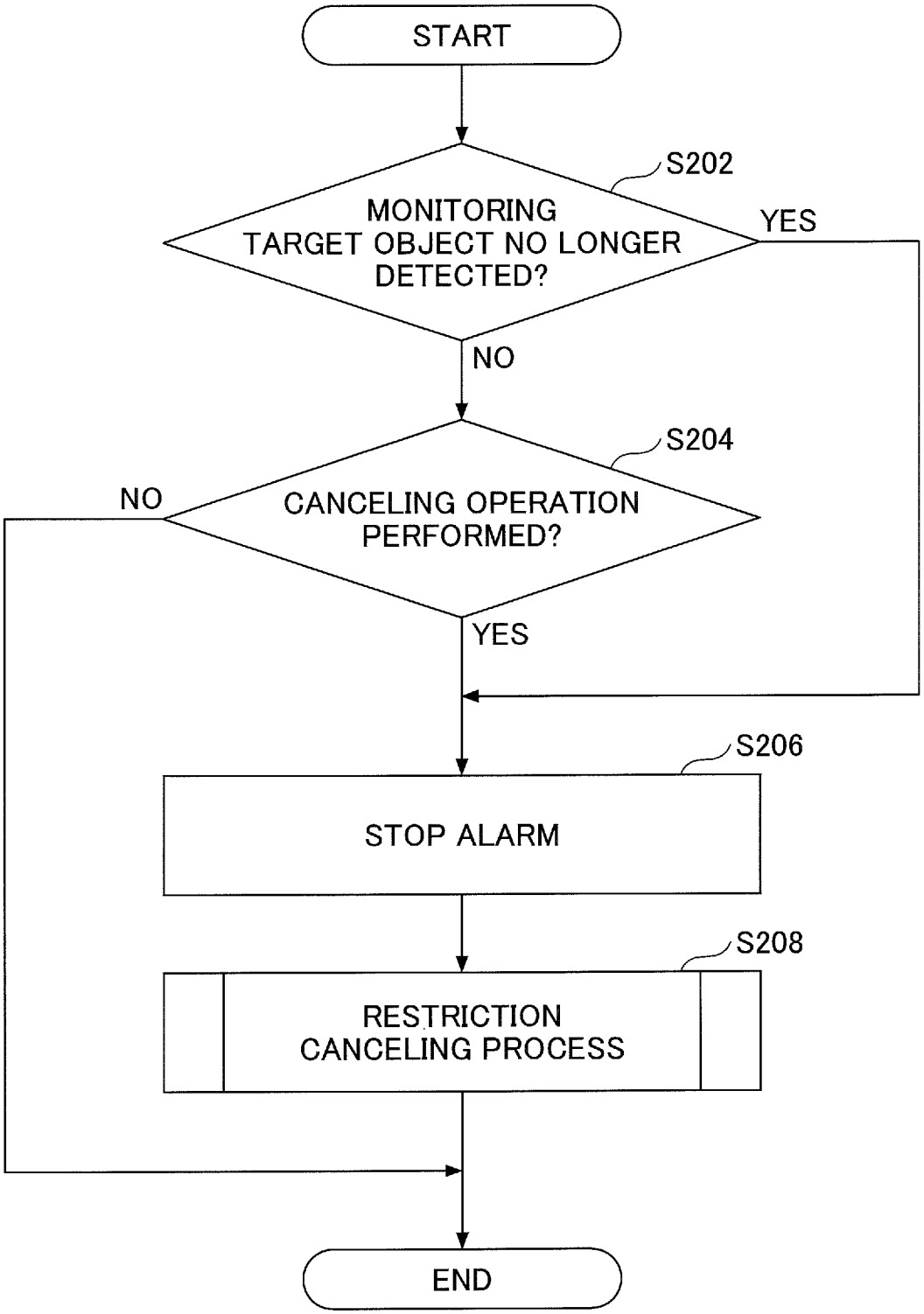
FIG. 8 is a flowchart schematically illustrating an example of a process (canceling process) by the surroundings monitoring system.

FIG. 8 is a flowchart schematically illustrating an example of the process of canceling an alarm and a motion restriction by the surroundings monitoring system 100. The process according to this flowchart is repeatedly executed at predetermined control intervals when the process of FIG. 7 starts an alarm and a motion restriction, for example.

At step S202, the detecting part 301 determines whether the monitoring target object is no longer detected within a predetermined area around the shovel (within the predetermined distance D1 from the shovel). The detecting part 301 proceeds to step S202 if the monitoring target object continues to be detected, and proceeds to step S206 if the monitoring target object is no longer detected.

At step S204, the alarming process part 303 determines whether the cancellation switch 42 has been operated. The alarming process part 303 proceeds to step S206 if the cancellation switch 42 has been operated, and ends the process of this time if the cancellation switch 42 has not been operated.

At step S206, the alarming process part 303 cancels (stops) the alarm output.

At step S208, the canceling process part 305 transmits a cancellation request to one or both of the pump controlling part 306 and the engine controlling part 307 to which the restriction request was transmitted in the previous motion restricting process to execute a restriction canceling process to relax or cancel the motion restriction of the shovel, and ends the process of this time.

Next, specific examples of the motion restricting process (step S108) of FIG. 7 are described with reference to FIGS. 9 through 12 and 14 through 19.

Figure 9:
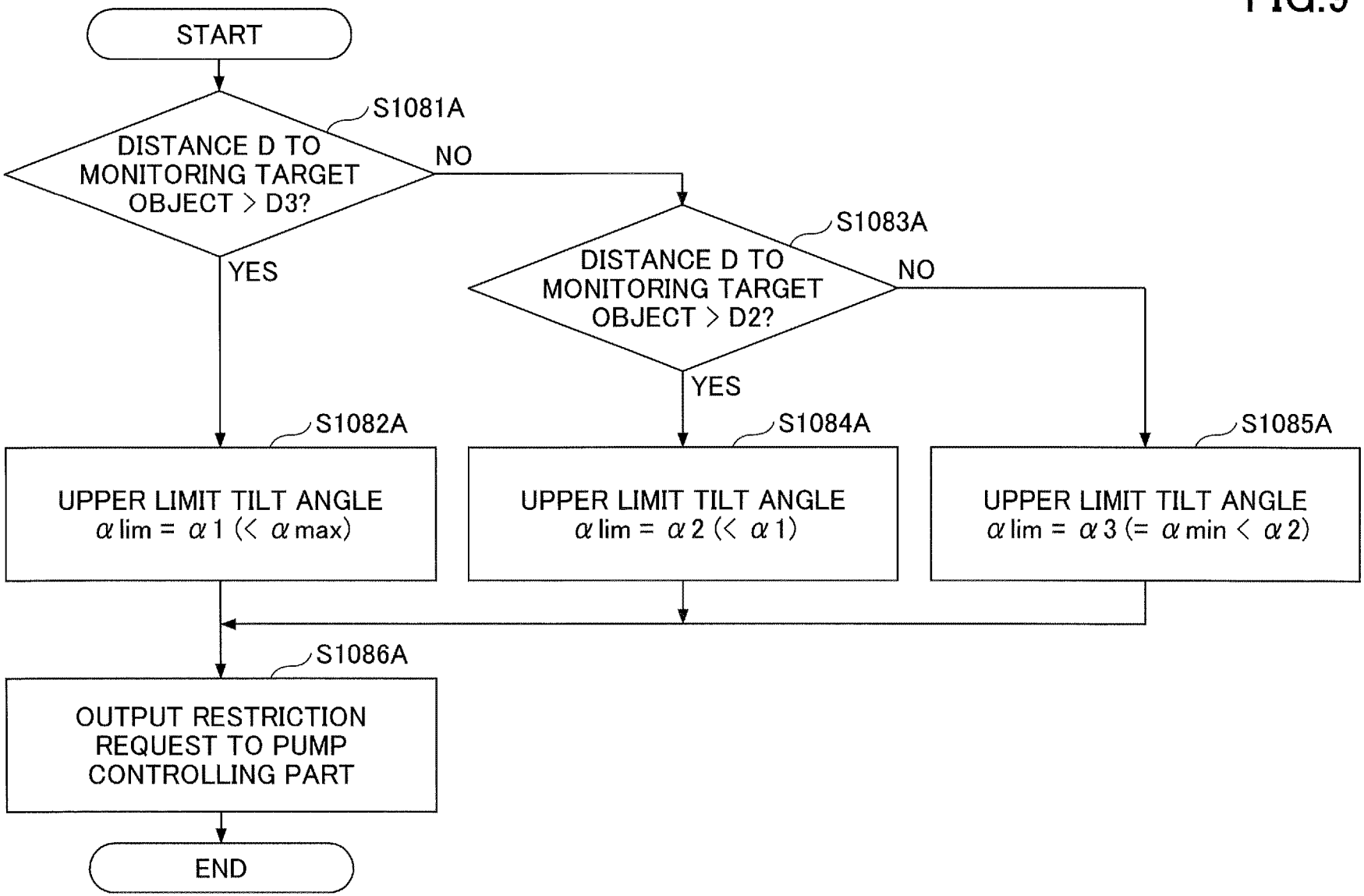
FIG. 9 is a flowchart schematically illustrating a first example of a motion restricting process by the surroundings monitoring system.

First, FIG. 9 is a flowchart schematically illustrating a first example of the motion restricting process by the restricting process part 304.

A predetermined distance D3 is smaller than the predetermined distance D1 and greater than the predetermined distance D2 (D1>D3>D2). Furthermore, predetermined angles $\alpha 1$ through $\alpha 3$ are tilt angles $\alpha$ of the swash plate 14C corresponding to the predetermined flow rates Q1 through Q3 in FIG. 6 ($\alpha 1>\alpha 2>\alpha 3$, Q1>Q2>Q3). Furthermore, the predetermined angle $\alpha 3$ is the minimum tilt angle $\alpha$min of the swash plate 14C, and corresponds to the minimum flow rate Qmin of the main pump 14 ($\alpha 3=\alpha$min, Q3=Qmin).

At step S1081A, the restricting process part 304 determines whether the distance D between the monitoring target object detected by the detecting part 301 and the shovel is greater than the predetermined distance D3. The restricting process part 304 proceeds to step S1082A if the distance D between the detected monitoring target object and the shovel is greater than the predetermined distance D3 (namely, if D1>D>D3), and otherwise, proceeds to step S1083A.

At step S1082A, the restricting process part 304 sets the upper limit tilt angle $\alpha$lim to the predetermined angle $\alpha 1$.

At step S1083A, the restricting process part 304 determines whether the distance D between the monitoring target object detected by the detecting part 301 and the shovel is greater than the predetermined distance D2. The restricting process part 304 proceeds to step S1084A if the distance D between the detected monitoring target object and the shovel is greater than the predetermined distance D2 (namely, if D3≥D>D2), and otherwise (namely, if D≤D2), proceeds to step S1085A.

At step S1084A, the restricting process part 304 sets the upper limit tilt angle $\alpha$lim to the predetermined angle $\alpha 2$.

At step S1085A, the restricting process part 304 sets the upper limit tilt angle $\alpha$lim to the predetermined angle $\alpha 3$ (the minimum tilt angle $\alpha$min).

At step S1086A, the restricting process part 304 transmits a restriction request including the upper limit tilt angle $\alpha$lim set at one of steps S1082A, S1084A, and S1085A to the pump controlling part 306. As a result, the pump controlling part 306 limits the tilt angle $\alpha$ to the upper limit tilt angle $\alpha$lim smaller than the maximum tilt angle $\alpha$max, or less, to perform control (negative control and power control) of the discharge flow rate of the main pump 14. Therefore, it is possible to slow the motion of the shovel, so that it is possible to control approach to a person (for example, a worker or a supervisor) or the like as a monitoring target object present around the shovel to increase the safety of the shovel.

Thus, according to this example, the restricting process part 304 decreases the upper limit tilt angle $\alpha$lim to increase reduction in the discharge flow rate Q of the main pump 14 as the distance D between the monitoring target object detected by the detecting part 301 and the shovel decreases. As a result, as the distance D between the monitoring target object and the shovel becomes smaller, the motion of the shovel becomes slower. Therefore, it is possible to further increase the safety of a person as a monitoring target object present around the shovel.

Figure 10:
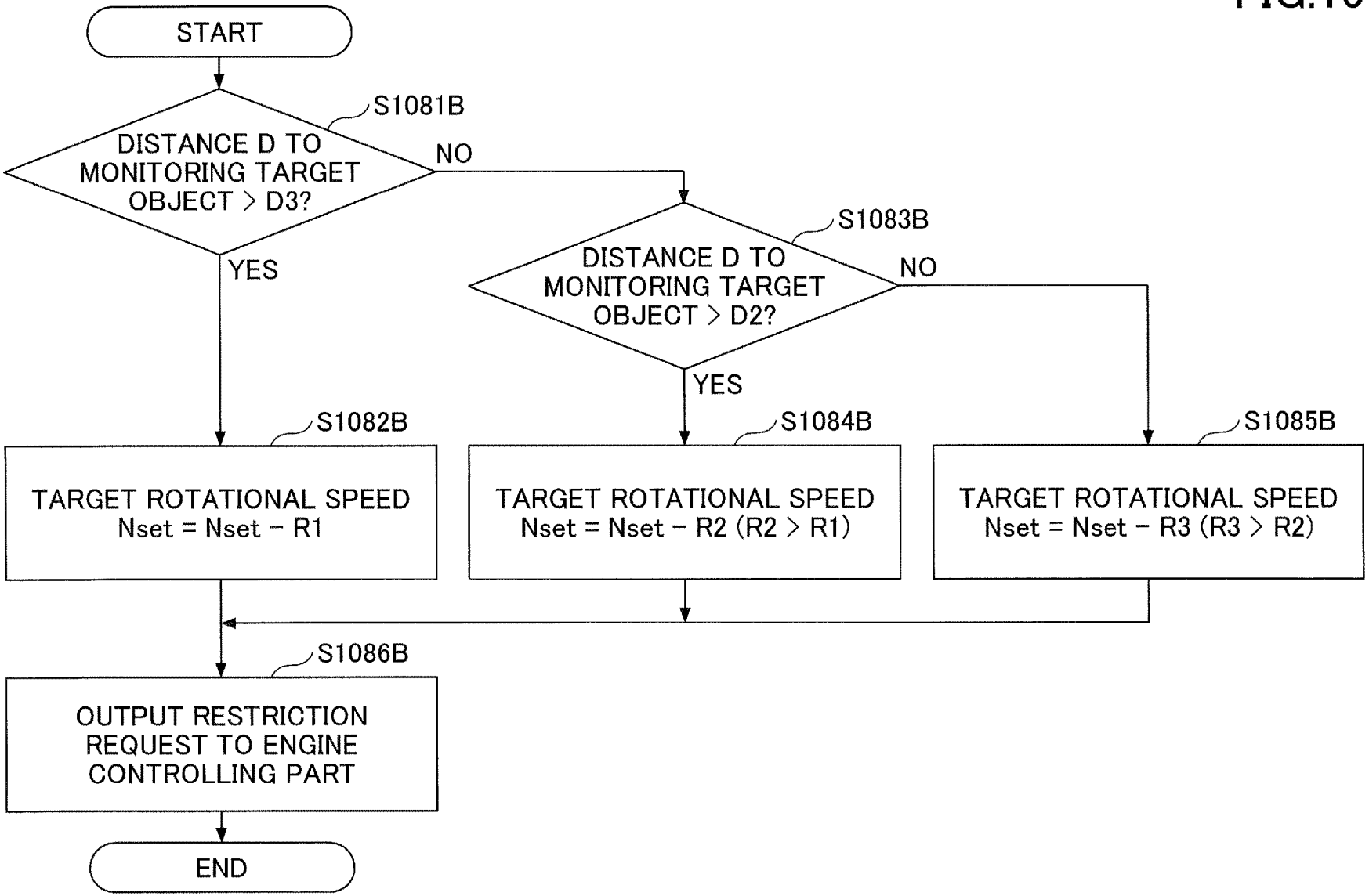
FIG. 10 is a flowchart schematically illustrating a second example of the motion restricting process by the surroundings monitoring system.

Next, FIG. 10 is a flowchart schematically illustrating a second example of the motion restricting process by the restricting process part 304. This example is different from the first example (FIG. 9) in decreasing the discharge flow rate Q of the main pump 14 by decreasing the rotational speed (the target rotational speed Nset) of the engine 11.

New target rotational speeds Nset lower than the preset target rotational speed Nset by predetermined rotational speeds R1 through R3 correspond to the curves LE1 through LE3, respectively, in FIG. 6 (R1<R2<R3).

At step S1081B, the restricting process part 304 executes the same determining process as at step S1081A. The restricting process part 304 proceeds to step S1082B if the distance D between the detected monitoring target object and the shovel is greater than the predetermined distance D3 (namely, if D1>D>D3), and otherwise (namely, if D≤D3), proceeds to step S1083B.

At step S1082B, the restricting process part 304 sets the new target rotational speed Nset lower than the preset target rotational speed Nset of the engine 11 by the predetermined rotational speed R1 (Nset=Nset−R1).

At step S1083B, the restricting process part 304 executes the same determining process as at step S1083A. The restricting process part 304 proceeds to step S1084B if the distance D between the detected monitoring target object and the shovel is greater than the predetermined distance D2 (namely, if D3≥D>D2), and otherwise (namely, if D≤D2), proceeds to step S1085B.

At step S1084B, the restricting process part 304 sets the new target rotational speed Nset lower than the preset target rotational speed Nset of the engine 11 by the predetermined rotational speed R2 (Nset=Nset−R2).

At step S1085B, the restricting process part 304 sets the new target rotational speed Nset lower than the preset target rotational speed Nset of the engine 11 by the predetermined rotational speed R3 (Nset=Nset−R3).

At step S1086B, the restricting process part 304 transmits a restriction request including the new target rotational speed Nset set at one of steps S1082B, S1084B, and S1085B to the engine controlling part 307. As a result, the engine controlling part 307 rotates the engine 11 constantly at the new target rotational speed Nset limited to be relatively low. Therefore, it is possible to slow the motion of the shovel, so that it is possible to increase the safety of a person as a monitoring target object present around the shovel.

Thus, according to this example, the restricting process part 304 decreases the target rotational speed Nset of the engine 11 to increase reduction in the discharge flow rate Q of the main pump 14 as the distance D between the monitoring target object detected by the detecting part 301 and the shovel decreases. As a result, the same as in the case of FIG. 9, it is possible to control approach to a person or the like as a monitoring target object present around the shovel to further increase the safety of the shovel.

Figure 11:
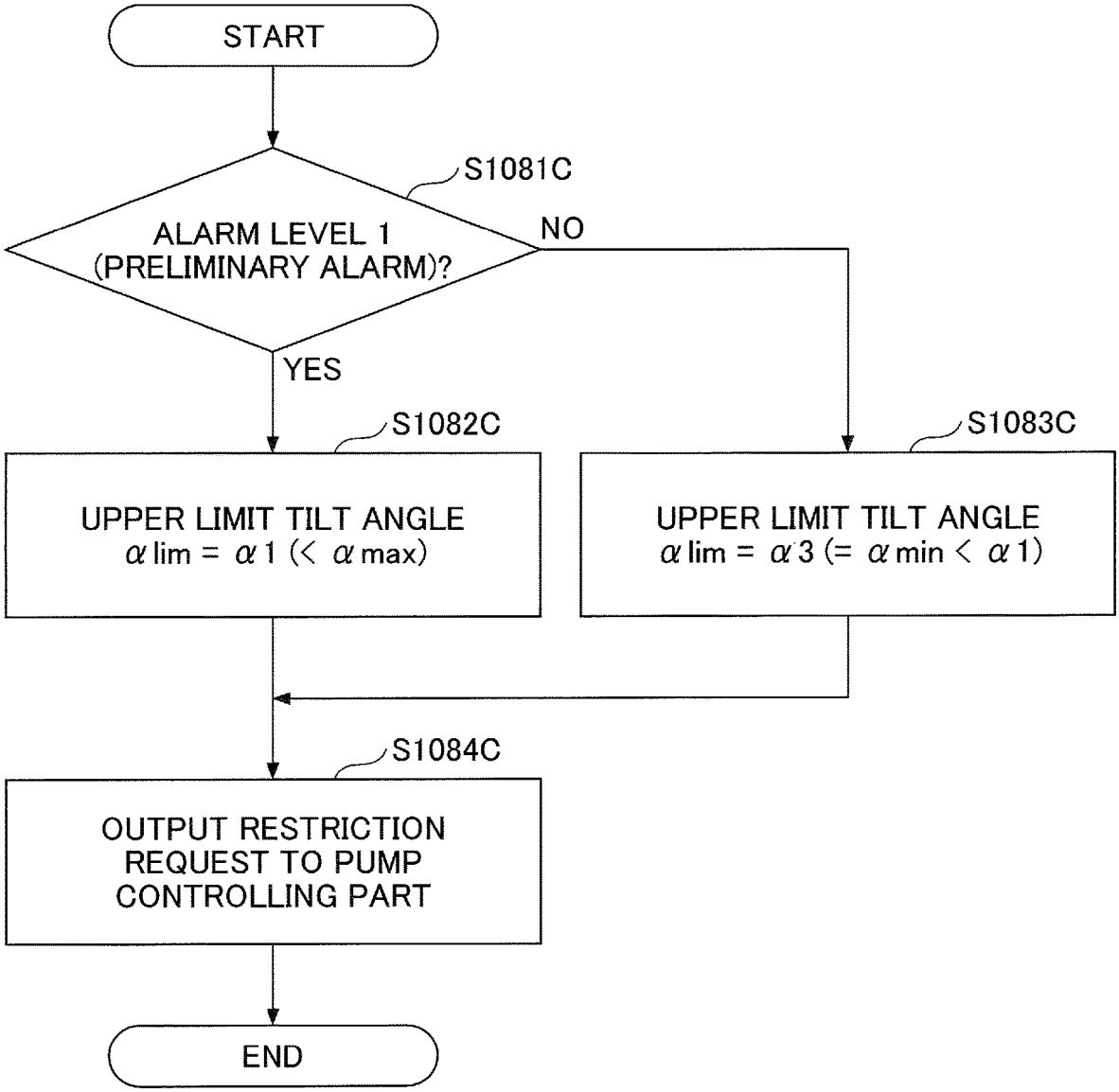
FIG. 11 is a flowchart schematically illustrating a third example of the motion restricting process by the surroundings monitoring system.

Next, FIG. 11 is a flowchart schematically illustrating a third example of the motion restricting process by the restricting process part 304.

At step S1081C, the restricting process part 304 determines whether the alarm by the alarming process part 303 is of alarm level 1 (namely, whether the alarm issued by the alarming process part 303 is a preliminary alarm). The restricting process part 304 proceeds to step S1082C if it is of alarm level 1, and proceeds to step S1083C if it is not of alarm level 1 (namely, it is of alarm level 2).

At step S1082C, the restricting process part 304 sets the upper limit tilt angle αlim to the predetermined angle α1.

At step S1083C, the restricting process part 304 sets the upper limit tilt angle αlim to the predetermined angle α3 (=αmin<α1).

At step S1084C, the restricting process part 304 transmits a restriction request including the upper limit tilt angle αlim set at one of steps S1082C and S1083C to the pump controlling part 306, and ends the process of this time.

Thus, according to this example, the restricting process part 304 decreases the upper limit tilt angle αlim to increase reduction in the discharge flow rate Q of the main pump 14 as the alarm level of the alarm issued by the alarming process part 303 increases. As a result, as the alarm level becomes higher, the motion of the shovel becomes slower. Therefore, it is possible to control approach to a person or the like as a monitoring target object present around the shovel to further increase the safety of the shovel.

According to this example (FIG. 11), the restricting process part 304 may decrease the target rotational speed of the engine 11 to increase reduction in the discharge flow rate Q of the main pump 14 as the alarm level of the alarm issued by the alarming process part 303 increases.

Figure 12:
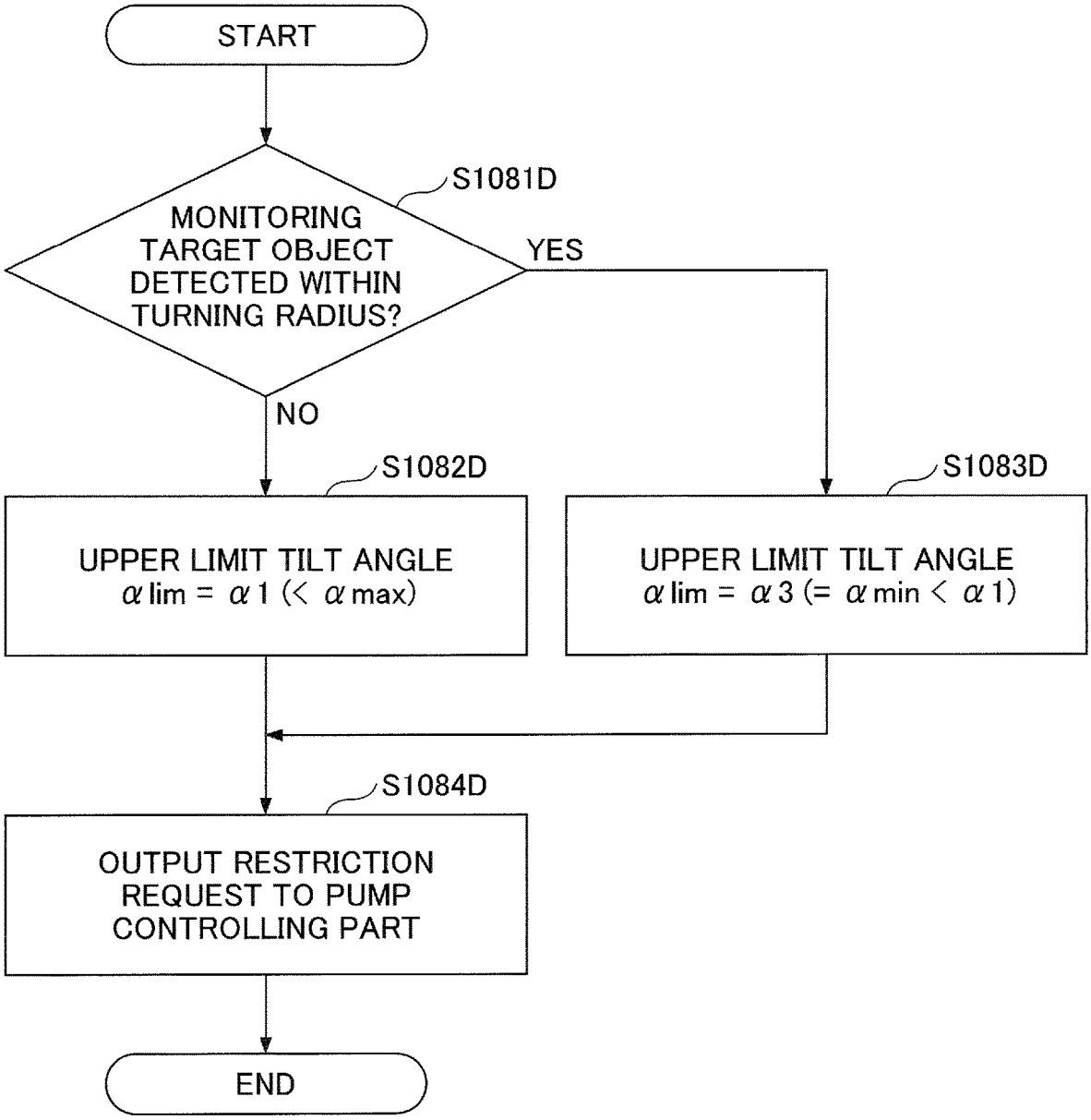
FIG. 12 is a flowchart schematically illustrating a fourth example of the motion restricting process by the surroundings monitoring system.

Next, FIG. 12 is a flowchart schematically illustrating a fourth example of the motion restricting process by the restricting process part 304.

Figure 13:
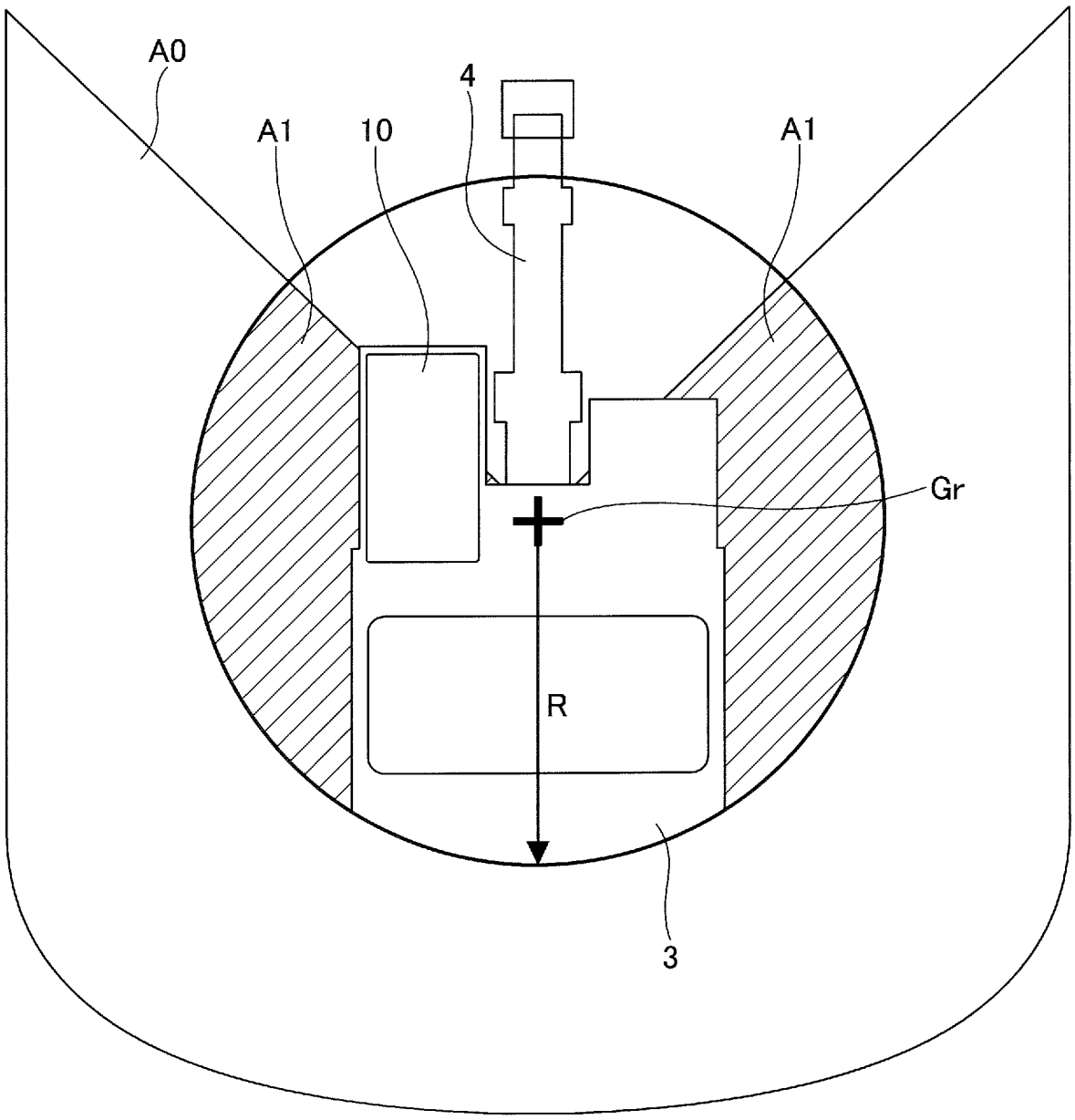
FIG. 13 is a diagram illustrating the turning radius of an upper turning body.

At step S1081D, the restricting process part 304 determines whether the monitoring target object detected by the detecting part 301 is within the turning radius of the upper turning body 3. For example, FIG. 13 is a diagram illustrating the turning radius R of the upper turning body 3. As illustrated in FIG. 13, the turning radius R of the upper turning body 3 represents the distance from the turning center (axis) to the most distant portion of the upper turning body 3 in a plan view of the shovel. That is, the turning radius R of the upper turning body 3 is the radius of a circle corresponding to the outer edge of an area covered by the upper turning body 3 in a plan view as the upper turning body 3 turns 360°. At this step, the restricting process part 304 determines whether the detected monitoring target object is included in an area A1 corresponding to the turning radius R or less, namely, the area A1 corresponding to a range that the upper turning body 3 covers as it turns (hereinafter referred to as "turning range"), within a detection area A0 in which the detecting part 301 detects a monitoring target object. The restricting process part 304 proceeds to step S1082D if the detected monitoring target object is not within the turning radius (that is, within the turning range) (namely, is outside the turning radius) of the upper turning body 3 in a plan view of the shovel taken from above along the turning axis of the upper turning body 3, and proceeds to step S1083D if the detected monitoring target object is within the turning radius (that is, within the turning range).

As illustrated in FIG. 13, according to this embodiment, the detecting part 301 detects a monitoring target object based on the images captured by the back camera 40B, the left side camera 40L, and the right side camera 40R. Therefore, the detection area A0 in which the detecting part 301 detects a monitoring target object does not include an area corresponding to the front of the shovel. Furthermore, while representing the radius of a circle corresponding to the outer edge of an area covered by the upper turning body 3 in a plan view as the upper turning body 3 turns 360° according to this example, the turning radius R (that is, the turning range) of the upper turning body 3 may be the turning radius of a circle corresponding to the outer edge of an area covered by a portion including the work device (the boom 4, the arm 5, and the bucket 6) and the like mounted on the upper turning body 3.

At step S1082D, the restricting process part 304 sets the upper limit tilt angle αlim to the predetermined angle α1.

At step S1083D, the restricting process part 304 sets the upper limit tilt angle αlim to the predetermined angle α3 (<α1).

At step S1084D, the restricting process part 304 transmits a restriction request including the upper limit tilt angle αlim set at one of steps S1082D and S1083D to the pump controlling part 306, and ends the process of this time.

Thus, according to this example, when the detected monitoring target object is within the turning radius (within the turning range) of the upper turning body 3, the restricting process part 304 decreases the upper limit tilt angle αlim to increase reduction in the discharge flow rate Q of the main pump 14 compared with the case where the detected monitoring target object is not within the turning radius of the upper turning body 3. As a result, when the upper turning body 3 turns, which could cause the monitoring target object present within the turning radius of the upper turning body 3 to rapidly approach the upper turning body 3, the motion of the shovel becomes slower if the detected monitoring target object is within the turning radius of the upper turning body 3. Therefore, it is possible to control approach to a person or the like as a monitoring target object present around the shovel to further increase the safety of the shovel.

According to this example, when the detected monitoring target object is within the turning radius of the upper turning body 3, the restricting process part 304 may decrease the target rotational speed of the engine 11 to increase reduction in the discharge flow rate Q of the main pump 14 compared with the case where the detected monitoring target object is outside the turning radius.

Figure 14:
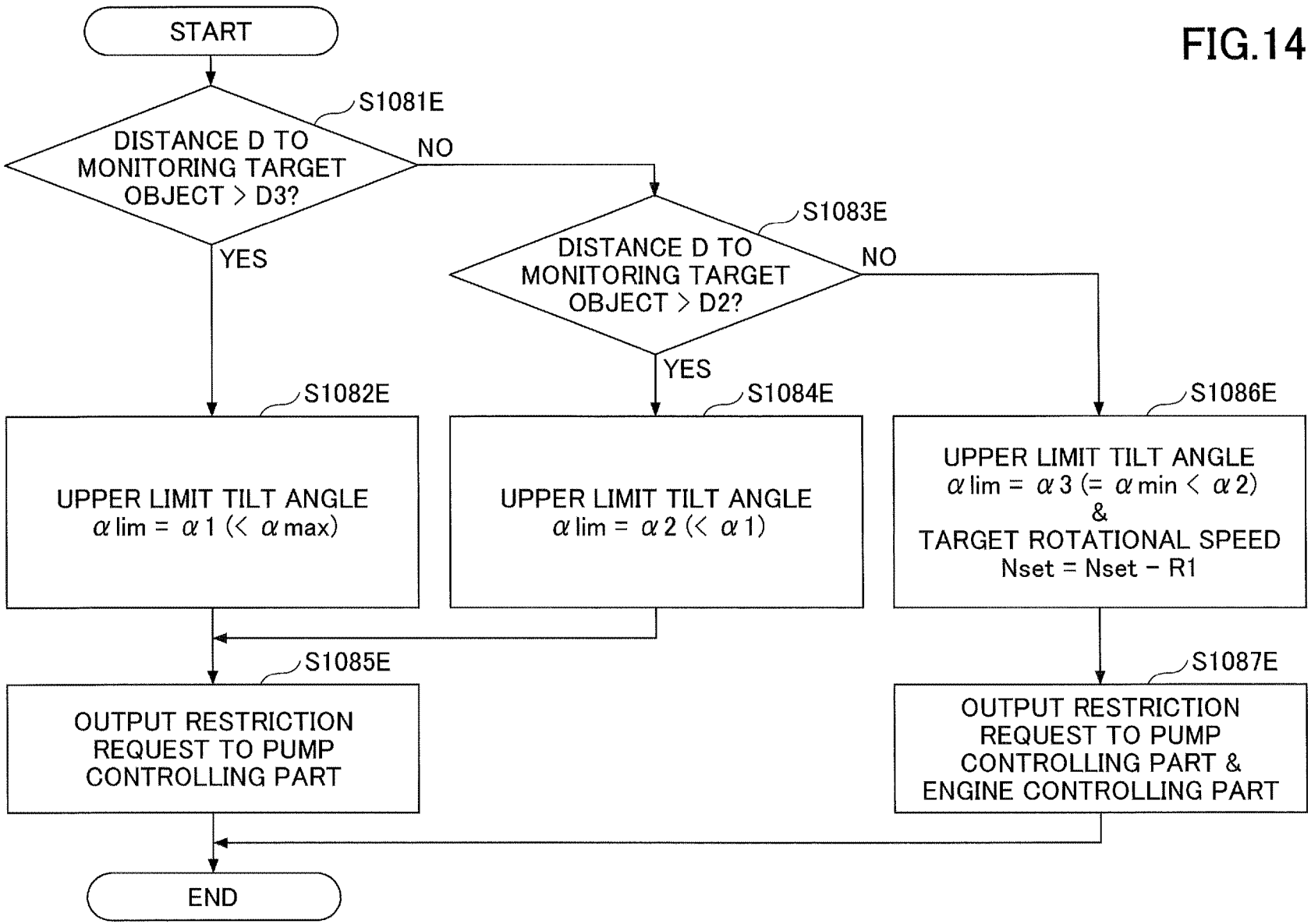
FIG. 14 is a flowchart schematically illustrating a fifth example of the motion restricting process by the surroundings monitoring system.

Next, FIG. 14 is a flowchart schematically illustrating a fifth example of the motion restricting process by the restricting process part 304.

At step S1081E, the restricting process part 304 determines whether the distance D between the monitoring target object detected by the detecting part 301 and the shovel is greater than the predetermined distance D3. The restricting process part 304 proceeds to step S1082E if the distance D between the detected monitoring target object and the shovel is greater than the predetermined distance D3 (namely, if D1>D>D3), and otherwise, proceeds to step S1083E.

At step S1082E, the restricting process part 304 sets the upper limit tilt angle αlim to the predetermined angle α1.

At step S1083E, the restricting process part 304 determines whether the distance D between the monitoring target object detected by the detecting part 301 and the shovel is greater than the predetermined distance D2. The restricting process part 304 proceeds to step S1084E if the distance D between the detected monitoring target object and the shovel is greater than the predetermined distance D2 (namely, if D3≥D>D2), and otherwise (namely, if D≤D2), proceeds to step S1086E.

At step S1084E, the restricting process part 304 sets the upper limit tilt angle αlim to the predetermined angle α2.

At step S1085E, the restricting process part 304 transmits a restriction request including the upper limit tilt angle αlim set at one of steps S1082E and S1084E to the pump controlling part 306, and ends the process of this time.

At step S1086E, the restricting process part 304 sets the upper limit tilt angle αlim to the predetermined angle α3, and sets a new target rotational speed Nset lower than the preset target rotational speed Nset of the engine 11 by the predetermined rotational speed R1.

At step S1087E, the restricting process part 304 transmits a restriction request including the upper limit tilt angle αlim to the pump controlling part 306 and transmits a restriction request including the new target rotational speed Nset to the engine controlling part 307, and ends the process of this time.

Thus, according to this example, when the distance D between the detected monitoring target object and the shovel is greater than D2, the restricting process part 304 decreases the discharge flow rate Q of the main pump 14 by changing the tilt angle α of the swash plate 14C. When the distance D between the detected monitoring target object and the shovel is less than or equal to D2, the restricting process part 304 decreases the discharge flow rate Q of the main pump 14 by changing the tilt angle α of the swash plate 14C and decreasing the target rotational speed Nset of the engine 11. In terms of workability, because a response to a change in the target rotational speed Nset of the engine 11 is poorer than a response to a change in the swash plate 14C of the main pump 14, it may take time before the shovel returns to its original operating state when a restriction is canceled by the canceling process part 305. Furthermore, in the case of decreasing the target rotational speed Nset of the engine 11, the hydraulic actuator ACT cannot withstand a load because of reduction in the power of the engine 11 and may return in a direction opposite to the operating direction, depending on the operating state of the shovel. On the other hand, in terms of safety, it is preferable to decrease the target rotational speed Nset of the engine 11 to decrease the power of the engine 11. Thus, according to the restricting process part 304 of this example, it is possible to achieve both safety and workability of the shovel.

Figure 15:
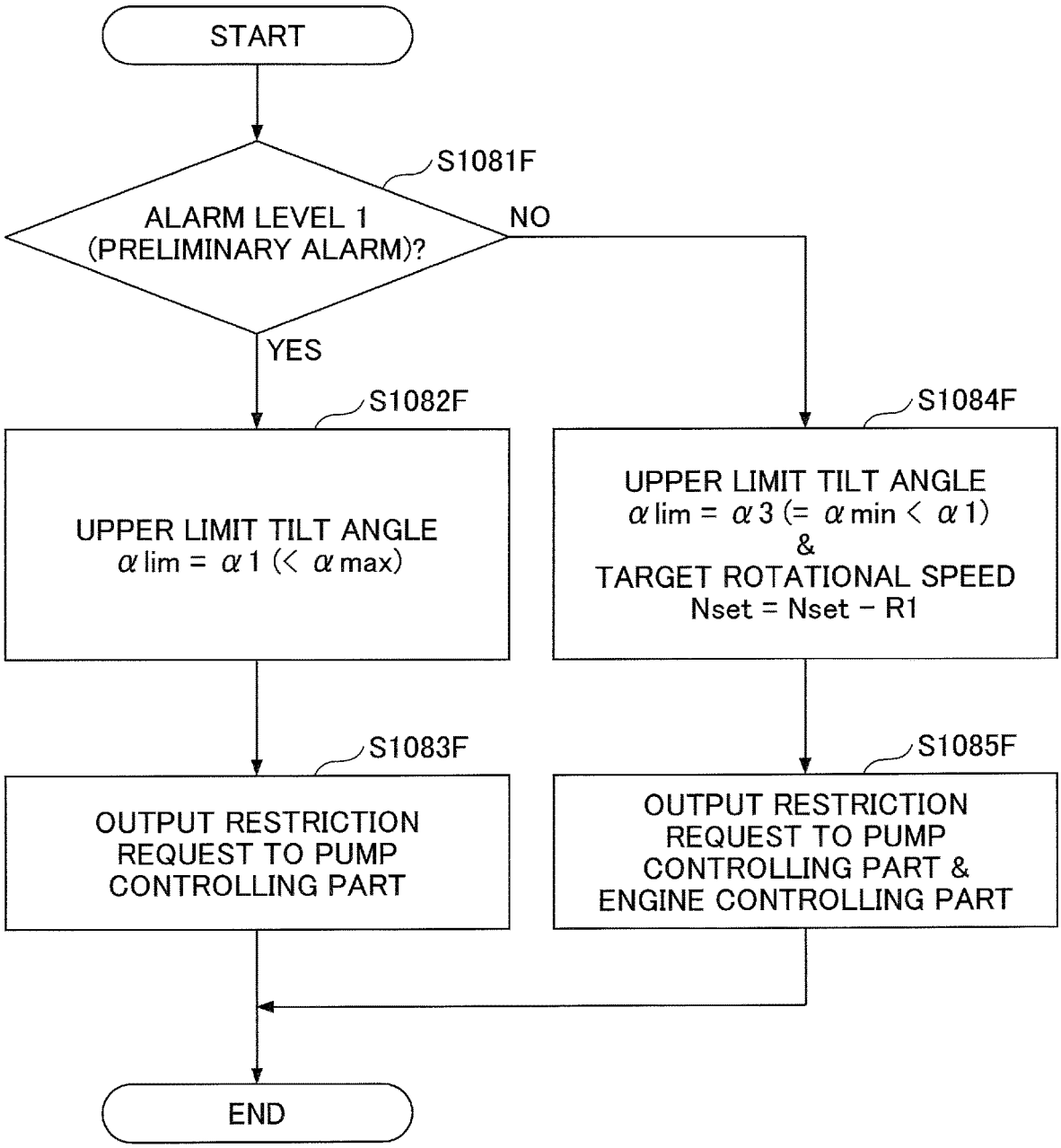
FIG. 15 is a flowchart schematically illustrating a sixth example of the motion restricting process by the surroundings monitoring system.

Next, FIG. 15 is a flowchart schematically illustrating a sixth example of the motion restricting process by the restricting process part 304.

At step S1081F, the restricting process part 304 determines whether the alarm by the alarming process part 303 is of alarm level 1 (namely, whether the alarm issued by the alarming process part 303 is a preliminary alarm). The restricting process part 304 proceeds to step S1082F if it is of alarm level 1, and proceeds to step S1084F if it is not of alarm level 1 (namely, it is of alarm level 2).

At step S1082F, the restricting process part 304 sets the upper limit tilt angle αlim to the predetermined angle α1.

At step S1083F, the restricting process part 304 transmits a restriction request including the set upper limit tilt angle αlim to the pump controlling part 306, and ends the process of this time.

At step S1084F, the restricting process part 304 sets the upper limit tilt angle αlim to the predetermined angle α3 (=αmin<α1), and sets a new target rotational speed Nset lower than the preset target rotational speed Nset of the engine 11 by the predetermined rotational speed R1.

At step S1085F, the restricting process part 304 transmits a restriction request including the upper limit tilt angle αlim to the pump controlling part 306 and transmits a restriction request including the new target rotational speed Nset to the engine controlling part 307, and ends the process of this time.

Thus, according to this example, when the alarm issued by the alarming process part 303 is below alarm level 2, the restricting process part 304 decreases the discharge flow rate Q of the main pump 14 by changing the tilt angle α of the swash plate 14C. When the alarm issued by the alarming process part 303 is at or above alarm level 2, the restricting process part 304 decreases the discharge flow rate Q of the main pump 14 by changing the tilt angle α of the swash plate 14C and decreasing the target rotational speed Nset of the engine 11. This makes it possible to achieve both safety and workability of the shovel the same as in the above-described case of the fifth example (FIG. 14).

Figure 16:
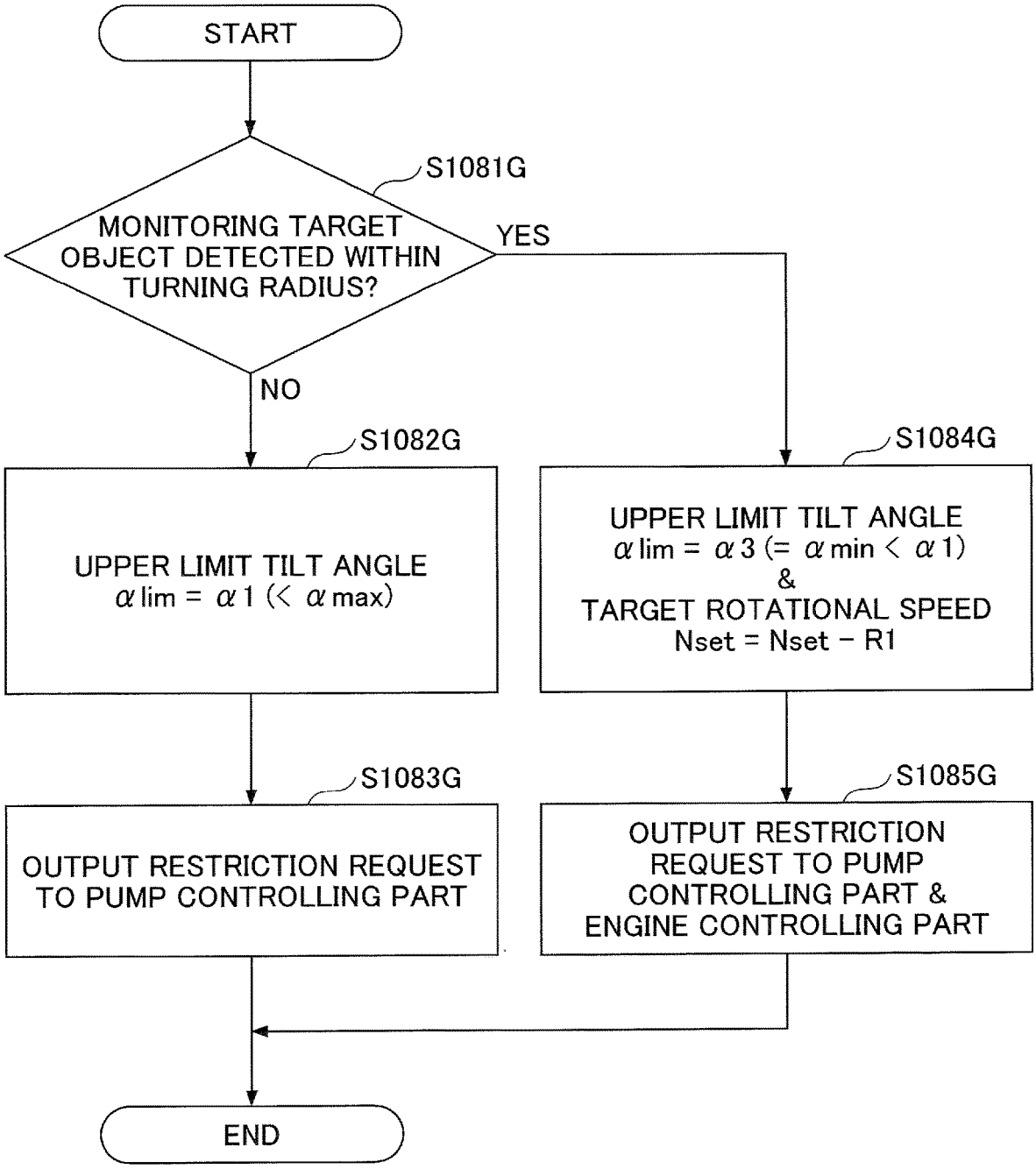
FIG. 16 is a flowchart schematically illustrating a seventh example of the motion restricting process by the surroundings monitoring system.

Next, FIG. 16 is a flowchart schematically illustrating a seventh example of the motion restricting process by the restricting process part 304.

At step S1081G, the restricting process part 304 determines whether the monitoring target object detected by the detecting part 301 is within the turning radius (within the turning range) of the upper turning body 3. The restricting process part 304 proceeds to step S1082G if the detected monitoring target object is not within the turning radius of the upper turning body 3, and proceeds to step S1084G if the detected monitoring target object is within the turning radius.

At step S1082G, the restricting process part 304 sets the upper limit tilt angle αlim to the predetermined angle α1.

At step S1083G, the restricting process part 304 transmits a restriction request including the set upper limit tilt angle αlim to the pump controlling part 306, and ends the process of this time.

At step S1084G, the restricting process part 304 sets the upper limit tilt angle αlim to the predetermined angle α3 (<α1), and sets a new target rotational speed Nset lower than the preset target rotational speed Nset of the engine 11 by the predetermined rotational speed R1.

At step S1085G, the restricting process part 304 transmits a restriction request including the set upper limit tilt angle αlim to the pump controlling part 306 and transmits a restriction request including the new target rotational speed Nset to the engine controlling part 307, and ends the process of this time.

Thus, according to this example, when the detected monitoring target object is outside the turning radius (turning range) of the upper turning body 3, the restricting process part 304 decreases the discharge flow rate Q of the main pump 14 by changing the tilt angle α of the swash plate 14C. When the detected monitoring target object is within the turning radius (within the turning range) of the upper turning body 3, the restricting process part 304 decreases the discharge flow rate Q of the main pump 14 by changing the tilt angle α of the swash plate 14C and decreasing the target rotational speed Nset of the engine 11. This makes it possible to achieve both safety and workability of the shovel the same as in the above-described case of the fifth example (FIG. 14) and the like.

Figure 17:
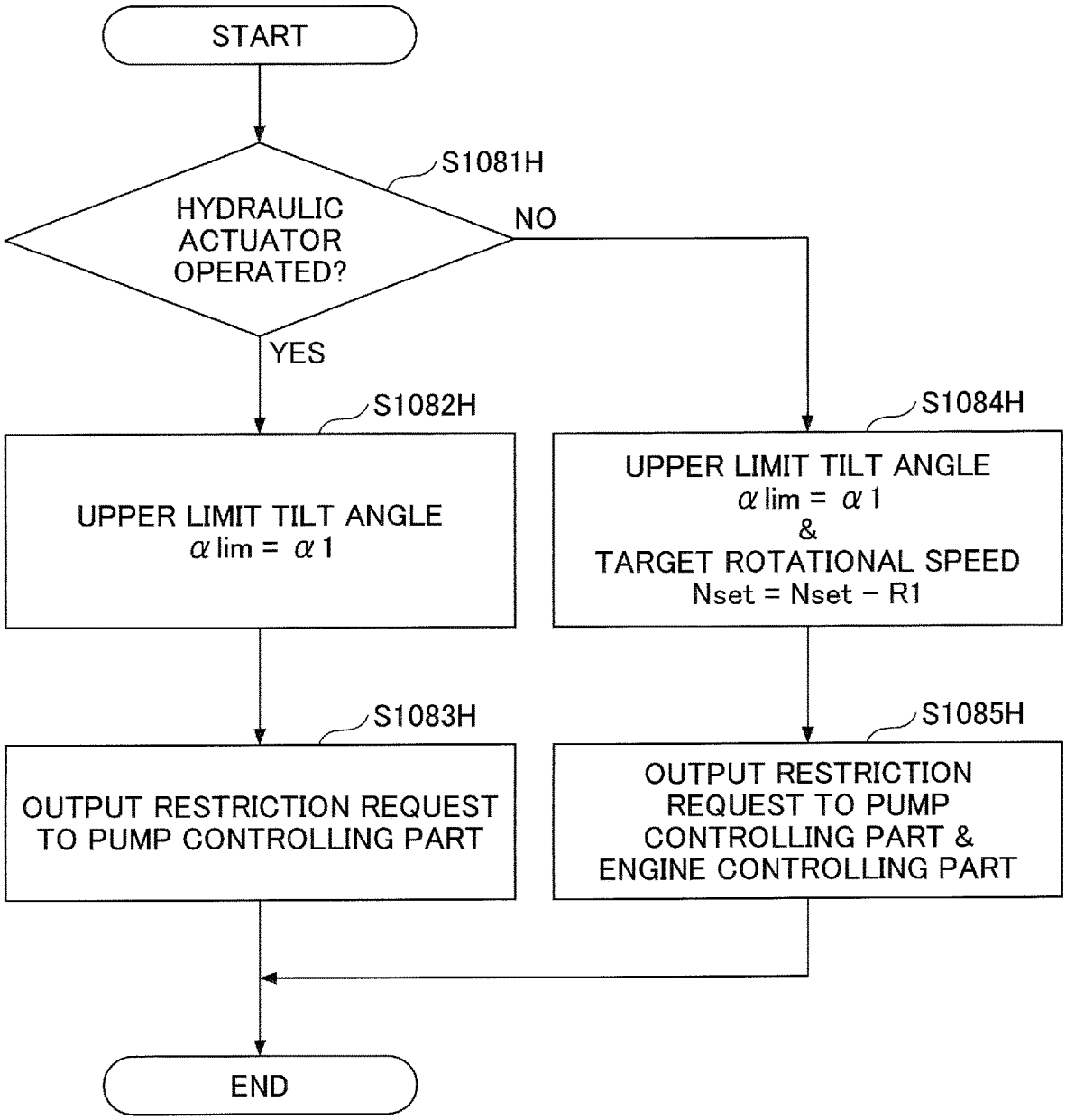
FIG. 17 is a flowchart schematically illustrating an eighth example of the motion restricting process by the surroundings monitoring system.

Next, FIG. 17 is a flowchart schematically illustrating an eighth example of the motion restricting process by the restricting process part 304.

At step S1081H, the restricting process part 304 determines whether the operating apparatus 26 is being operated for (an operating element corresponding to) the hydraulic actuator ACT. The restricting process part 304 proceeds to step S1082H if the operating apparatus 26 is being operated, and proceeds to step S1084H if the operating apparatus 26 is not being operated.

At step S1082H, the restricting process part 304 sets the upper limit tilt angle αlim to the predetermined angle α1.

At step S1083H, the restricting process part 304 transmits a restriction request including the set upper limit tilt angle αlim to the pump controlling part 306, and ends the process of this time.

At step S1084H, the restricting process part 304 sets the upper limit tilt angle αlim to the predetermined angle α1, and sets a new target rotational speed Nset lower than the preset target rotational speed Nset of the engine 11 by the predetermined rotational speed R1.

At step S1085H, the restricting process part 304 transmits a restriction request including the set upper limit tilt angle αlim to the pump controlling part 306 and transmits a restriction request including the new target rotational speed Nset to the engine controlling part 307, and ends the process of this time.

Thus, according to this example, when the operating apparatus 26 is being operated for the hydraulic actuator ACT, the restricting process part 304 decreases the discharge flow rate Q of the main pump 14 by changing the tilt angle α of the swash plate 14C. When the operating apparatus 26 is not being operated for the hydraulic actuator ACT, the restricting process part 304 decreases the discharge flow rate Q of the main pump 14 by changing the tilt angle α of the swash plate 14C and decreasing the target rotational speed Nset of the engine 11. This makes it possible to achieve both safety and workability of the shovel the same as in the above-described case of the fifth example (FIG. 14) and the like.

Figure 18:
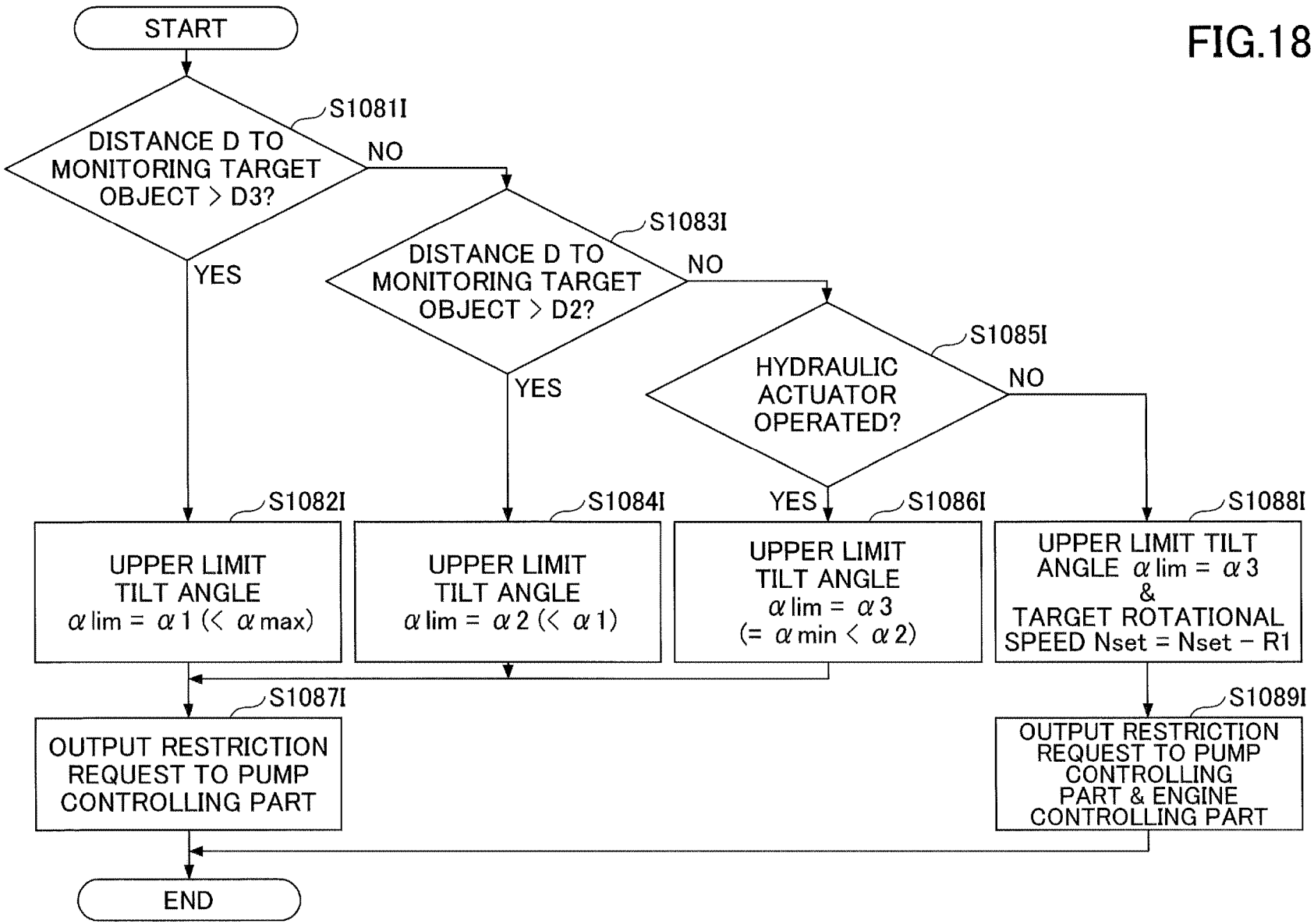
FIG. 18 is a flowchart schematically illustrating a ninth example of the motion restricting process by the surroundings monitoring system.

Next, FIG. 18 is a flowchart schematically illustrating a ninth example of the motion restricting process by the restricting process part 304.

At step S1081I, the restricting process part 304 determines whether the distance D between the monitoring target object detected by the detecting part 301 and the shovel is greater than the predetermined distance D3. The restricting process part 304 proceeds to step S1082I if the distance D between the detected monitoring target object and the shovel is greater than the predetermined distance D3 (namely, if D1>D>D3), and otherwise, proceeds to step S1083I.

At step S1082I, the restricting process part 304 sets the upper limit tilt angle αlim to the predetermined angle α1.

At step S1083I, the restricting process part 304 determines whether the distance D between the monitoring target object detected by the detecting part 301 and the shovel is greater than the predetermined distance D2. The restricting process part 304 proceeds to step S1084I if the distance D between the detected monitoring target object and the shovel is greater than the predetermined distance D2 (namely, if D3≥D>D2), and otherwise (namely, if D≤D2), proceeds to step S1085I.

At step S1084I, the restricting process part 304 sets the upper limit tilt angle αlim to the predetermined angle α2.

At step S1085I, the restricting process part 304 determines whether the operating apparatus 26 is being operated for the hydraulic actuator ACT. The restricting process part 304 proceeds to step S1086I if the operating apparatus 26 is being operated, and otherwise, proceeds to step S1088I.

At step S1086I, the restricting process part 304 sets the upper limit tilt angle αlim to the predetermined angle α3 (the minimum tilt angle αmin).

At step S1087I, the restricting process part 304 transmits a restriction request including the upper limit tilt angle αlim set at one of steps S1082I, S1084I, and S1086I to the pump controlling part 306, and ends the process of this time.

At step S1088I, the restricting process part 304 sets the upper limit tilt angle αlim to the predetermined angle α3, and sets a new target rotational speed Nset lower than the preset target rotational speed Nset of the engine 11 by the predetermined rotational speed R1.

At step S1089I, the restricting process part 304 transmits a restriction request including the set upper limit tilt angle αlim to the pump controlling part 306 and transmits a restriction request including the new target rotational speed Nset to the engine controlling part 307, and ends the process of this time.

Thus, according to this example, even when a condition for changing the target rotational speed Nset of the engine 11 holds (NO at step S1083I), the flow rate of the main pump 14 is reduced by changing the tilt angle α of the swash plate 14C without decreasing the target rotational speed Nset of the engine 11 if the operating apparatus 26 is being operated. This makes it possible to achieve both safety and workability of the shovel.

The same process as in this example (specifically, the process of steps S1085I, S1086I, and S1088I) may be employed in the above-described sixth example (FIG. 15) and seventh example (FIG. 16).

Figure 19:
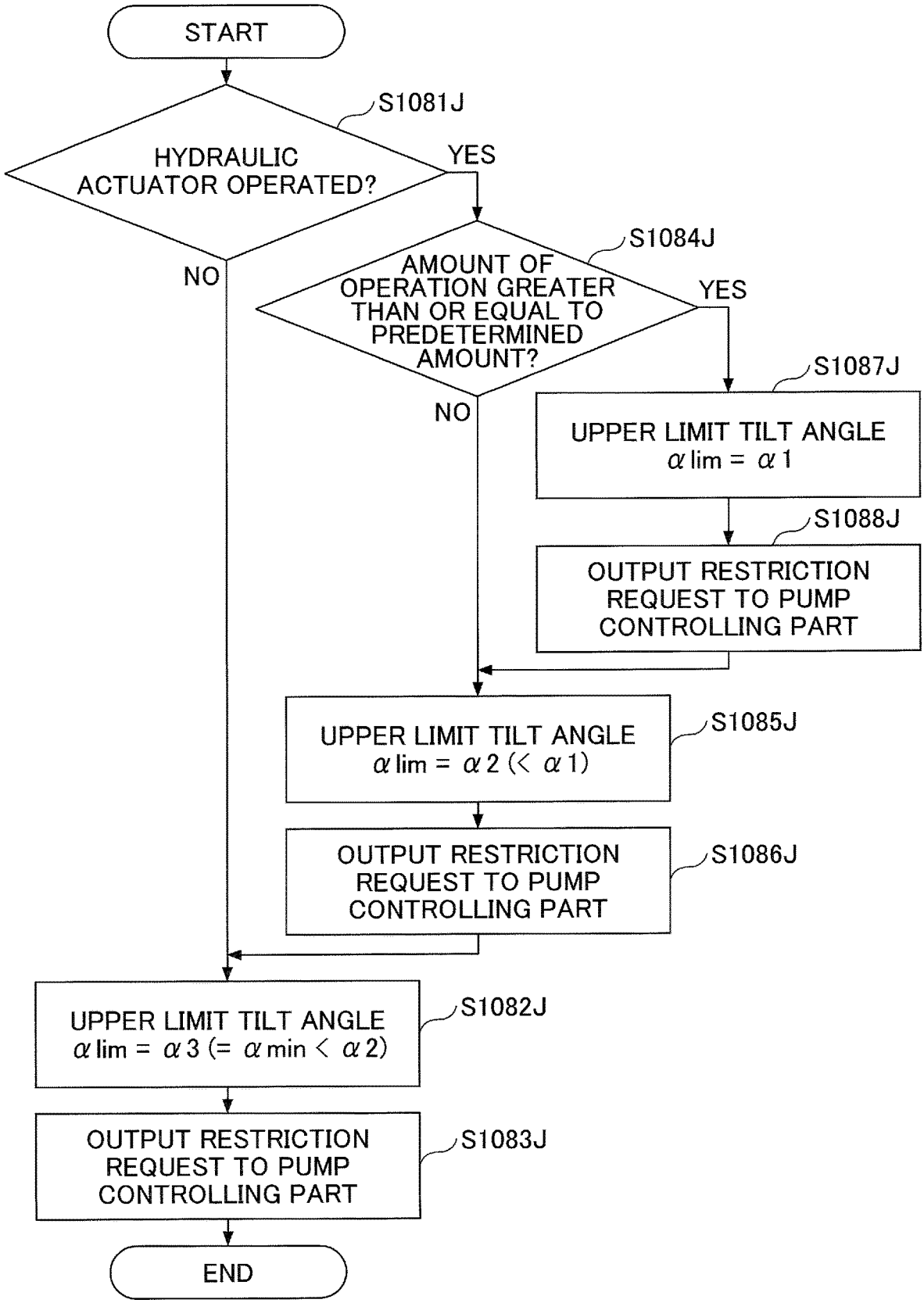
FIG. 19 is a flowchart schematically illustrating a tenth example of the motion restricting process by the surroundings monitoring system.

Next, FIG. 19 is a flowchart schematically illustrating a tenth example of the motion restricting process by the restricting process part 304.

At step S1081J, the restricting process part 304 determines whether the operating apparatus 26 is being operated for the hydraulic actuator ACT. The restricting process part 304 proceeds to step S1082J if the operating apparatus 26 is not being operated, and proceeds to step S1084J if the operating apparatus 26 is being operated.

At step S1082J, the restricting process part 304 sets the upper limit tilt angle αlim to the predetermined angle α3.

At step S1083J, the restricting process part 304 transmits a restriction request including the set upper limit tilt angle αlim to the pump controlling part 306, and ends the process of this time.

At step S1084J, the restricting process part 304 determines whether the amount of operation of the operating apparatus 26 is greater than or equal to a predetermined amount. At this point, when multiple hydraulic actuators ACT are being operated, their maximum value may be used. The restricting process part 304 proceeds to step S1085J if the amount of operation is not greater than or equal to a predetermined amount, and proceeds to step S1087J if the amount of operation is greater than or equal to a predetermined amount.

At step S1085J, the restricting process part 304 sets the upper limit tilt angle αlim to the predetermined angle α2.

At step S1086J, the restricting process part 304 transmits a restriction request including the set upper limit tilt angle αlim to the pump controlling part 306, and thereafter, proceeds to step S1082J to execute the process of steps S1082J and S1083J. That is, the restricting process part 304 changes (decreases) the upper limit tilt angle αlim to the predetermined angle α3 in two stages.

At step S1087J, the restricting process part 304 sets the upper limit tilt angle αlim to the predetermined angle α1.

At step S1088J, the restricting process part 304 transmits a restriction request including the set upper limit tilt angle αlim to the pump controlling part 306, thereafter proceeds to step S1085J to execute the process of steps S1085J and S1086J, and thereafter further executes the process of steps S1082J and S1083J. That is, the restricting process part 304 changes (decreases) the upper limit tilt angle αlim to the predetermined angle α3 in three stages.

Thus, according to this example, the restricting process part 304 gradually decreases the discharge flow rate Q of the main pump 14 by more gradually changing the tilt angle α of the swash plate 14C as the amount of operation of the operating apparatus 26 is greater. This makes it possible to reduce the impact caused by reduction in the discharge flow rate Q of the main pump 14 (the deceleration of the hydraulic actuator ACT) and control the degradation of operability, when the operating apparatus 26 is being operated for a hydraulic actuator.

According to this example, the discharge flow rate Q of the main pump 14 may be gradually decreased by more gradually changing (decreasing) the target rotational speed Nset of the engine 11 as the amount of operation of the operating apparatus 26 is greater.

Specific examples of the restriction canceling process (step S208) of FIG. 8 are described with reference to FIGS. 20 through 29.

FIGS. 20 through 29 are based on the assumption that the motion of the shovel is restricted by changing the tilt angle α of the swash plate 14C, namely, setting the upper limit tilt angle αlim.

Figure 20:
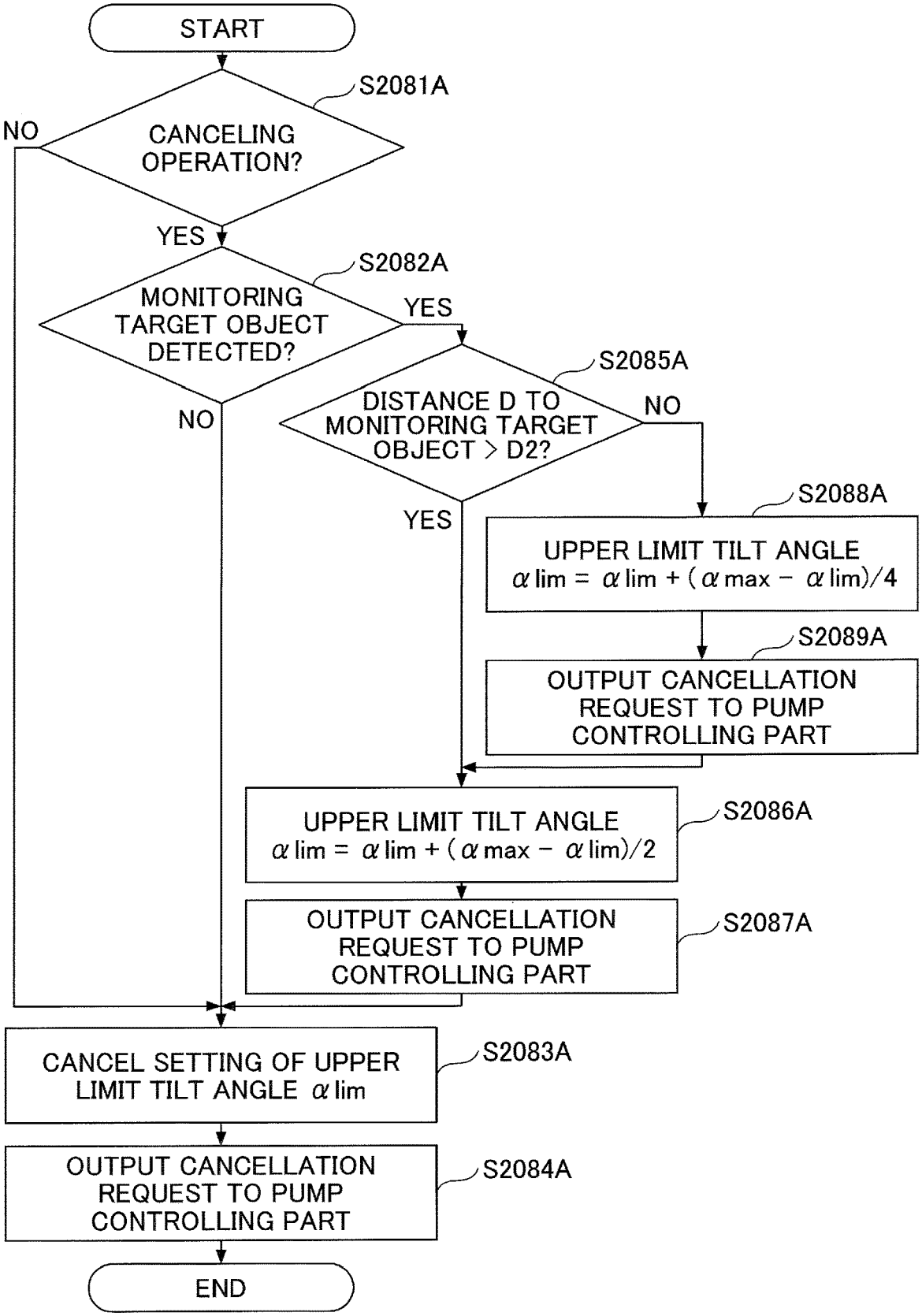
FIG. 20 is a flowchart schematically illustrating a first example of a restriction canceling process by the surroundings monitoring system.

First, FIG. 20 is a flowchart schematically illustrating a first example of the restriction canceling process by the canceling process part 305.

At step S2081A, the canceling process part 305 determines whether the cancellation switch 42 has been operated, that is, whether it is the restriction canceling process triggered by an operation on the cancellation switch 42. The canceling process part 305 proceeds to step S2082A if the cancellation switch 42 has been operated, and otherwise, proceeds to step S2083A.

At step S2082A, the canceling process part 305 determines whether the monitoring target object is detected within a predetermined area around the shovel by the detecting part 301. The canceling process part 305 proceeds to step S2083A if the monitoring target object is not detected within a predetermined area around the shovel by the detecting part 301, and proceeds to step S2085A if the monitoring target object is detected by the detecting part 301.

At step S2083A, the canceling process part 305 cancels the setting of the upper limit tilt angle αlim.

At step S2084A, the canceling process part 305 transmits a cancellation request to cancel the setting of the upper limit tilt angle αlim to the pump controlling part 306, and ends the process of this time. As a result, the pump controlling part 306 performs negative control and power control using the maximum tilt angle αmax as the upper limit of the tilt angle α of the swash plate 14C as normal. Therefore, the motion restriction of the shovel is completely canceled.

At step S2085A, the canceling process part 305 determines whether the distance D between the monitoring target object detected by the detecting part 301 and the shovel is greater than the predetermined distance D2. The canceling process part 305 proceeds to step S2086A if the distance D between the detected monitoring target object and the shovel is greater than the predetermined distance D2, and otherwise, proceeds to step S2088A.

At step S2086A, the canceling process part 305 sets a new upper limit tilt angle αlim (=αlim+(αmax−αlim)/2) obtained by adding ½ of the difference between the maximum tilt angle αmax and the upper limit tilt angle αlim at the time of motion restriction to the upper limit tilt angle αlim at the time of motion restriction.

At step S2087A, the canceling process part 305 transmits a cancellation request including the set upper limit tilt angle αlim to the pump controlling part 306, and thereafter, proceeds to step S2083A to execute the process of steps S2083A and S2084A. That is, the canceling process part 305 cancels the upper limit tilt angle αlim and returns the upper limit of the tilt angle α of the swash plate 14C to the maximum tilt angle αmax while relaxing the upper limit tilt angle αlim in two stages.

At step S2088A, the canceling process part 305 sets a new upper limit tilt angle αlim (=αlim+(αmax−αlim)/4) obtained by adding ¼ of the difference between the maximum tilt angle αmax and the upper limit tilt angle αlim at the time of motion restriction to the upper limit tilt angle αlim at the time of motion restriction.

At step S2089A, the canceling process part 305 transmits a cancellation request including the set upper limit tilt angle αlim to the pump controlling part 306, thereafter proceeds to step S2086A to execute the process of steps S2086A and S2087A, and thereafter further executes the process of steps S2083A and S2084A. That is, the canceling process part 305 cancels the upper limit tilt angle αlim and returns the upper limit of the tilt angle α of the swash plate 14C to the maximum tilt angle αmax while relaxing the upper limit tilt angle αlim in three stages.

Thus, according to this example, when the cancellation switch 42 is operated, the canceling process part 305 more gradually increases the discharge flow rate Q of the main pump 14 in the case where the monitoring target object is detected by the detecting part 301 than in the case where the monitoring target object is not detected. Furthermore, when the cancellation switch 42 is operated, the canceling process part 305 more gradually increases the discharge flow rate Q of the main pump 14 as the distance D between the monitoring target object and the shovel is smaller when the monitoring target object is detected by the detecting part 301. As a result, even when the cancellation switch 42 is operated, the motion restriction of the shovel is gradually canceled in a situation where there may be a monitoring target object around the shovel. Therefore, it is possible to further increase the safety of the shovel.

According to this example, the restricted target rotational speed Nset may be returned to the preset target rotational speed Nset in a stepwise manner in accordance with the presence or absence of the monitoring target object detected by the detecting part 301 or the distance between the detected monitoring target object and the shovel.

Figure 21:
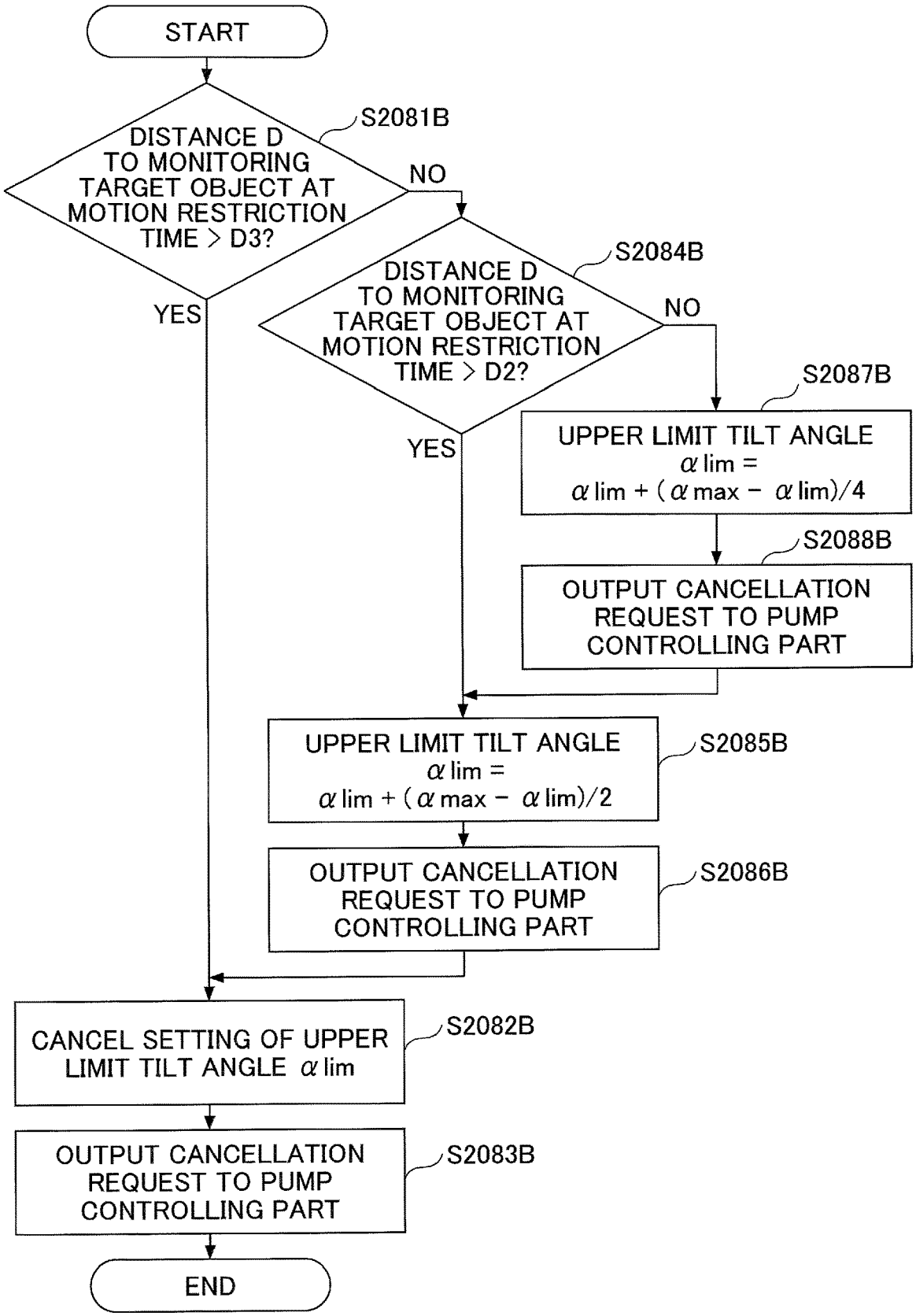
FIG. 21 is a flowchart schematically illustrating a second example of the restriction canceling process by the surroundings monitoring system.

Next, FIG. 21 is a flowchart schematically illustrating a second example of the restriction canceling process by the canceling process part 305.

At step S2081B, the canceling process part 305 determines whether the distance D between the monitoring target object detected by the detecting part 301 at the time of motion restriction and the shovel is greater than the predetermined distance D3. The canceling process part 305 proceeds to step S2082B if the distance D between the monitoring target object detected by the detecting part 301 at the time of motion restriction and the shovel is greater than the predetermined distance D3 (namely, if D1>D>D3), and otherwise, proceeds to step S2084B.

At step S2082B, the canceling process part 305 cancels the setting of the upper limit tilt angle αlim.

At step S2083B, the canceling process part 305 transmits a cancellation request to cancel the setting of the upper limit tilt angle αlim to the pump controlling part 306, and ends the process of this time.

At step S2084B, the canceling process part 305 determines whether the distance D between the monitoring target object detected by the detecting part 301 at the time of motion restriction and the shovel is greater than the predetermined distance D2. The canceling process part 305 proceeds to step S2085B if the distance D between the monitoring target object detected by the detecting part 301 at the time of motion restriction and the shovel is greater than the predetermined distance D2 (namely, if D3≥D>D2), and otherwise (namely, if D≤D2), proceeds to step S2087B.

At step S2085B, the canceling process part 305 sets a new upper limit tilt angle αlim (=αlim+(αmax−αlim)/2) obtained by adding ½ of the difference between the maximum tilt angle αmax and the upper limit tilt angle αlim at the time of motion restriction to the upper limit tilt angle αlim at the time of motion restriction.

At step S2086B, the canceling process part 305 transmits a cancellation request including the set upper limit tilt angle αlim to the pump controlling part 306, and thereafter, proceeds to step S2082B to execute the process of steps S2082B and S2083B. That is, the canceling process part 305 cancels the upper limit tilt angle αlim and returns the upper limit of the tilt angle α of the swash plate 14C to the maximum tilt angle αmax while relaxing the upper limit tilt angle αlim in two stages.

At step S2087B, the canceling process part 305 sets a new upper limit tilt angle αlim (=αlim+(αmax−αlim)/4) obtained by adding ¼ of the difference between the maximum tilt angle αmax and the upper limit tilt angle αlim at the time of motion restriction to the upper limit tilt angle αlim at the time of motion restriction.

At step S2088B, the canceling process part 305 transmits a cancellation request including the set upper limit tilt angle αlim to the pump controlling part 306, thereafter proceeds to step S2085B to execute the process of steps S2085B and S2086B, and thereafter further executes the process of steps S2082B and S2083B. That is, the canceling process part 305 cancels the upper limit tilt angle αlim and returns the upper limit of the tilt angle α of the swash plate 14C to the maximum tilt angle αmax while relaxing the upper limit tilt angle αlim in three stages.

Thus, according to this example, as the distance D between the monitoring target object detected by the detecting part 301 at the time of motion restriction and the shovel is smaller, the discharge flow rate Q of the main pump 14 is increased more gradually to cancel the motion restriction of the shovel. As a result, while the monitoring target object may continue to be present in the blind spot of the operator or the image capturing unit 40, etc., even after the cancellation switch 42 is operated or the monitoring target object is no longer detected by the detecting part 301, it is possible to further increase safety at the time of canceling the motion restriction of the shovel.

According to this example, the restricted target rotational speed Nset may be returned to the preset target rotational speed Nset in a stepwise manner in accordance with the distance between the detected monitoring target object at the time of motion restriction and the shovel.

Figure 22:
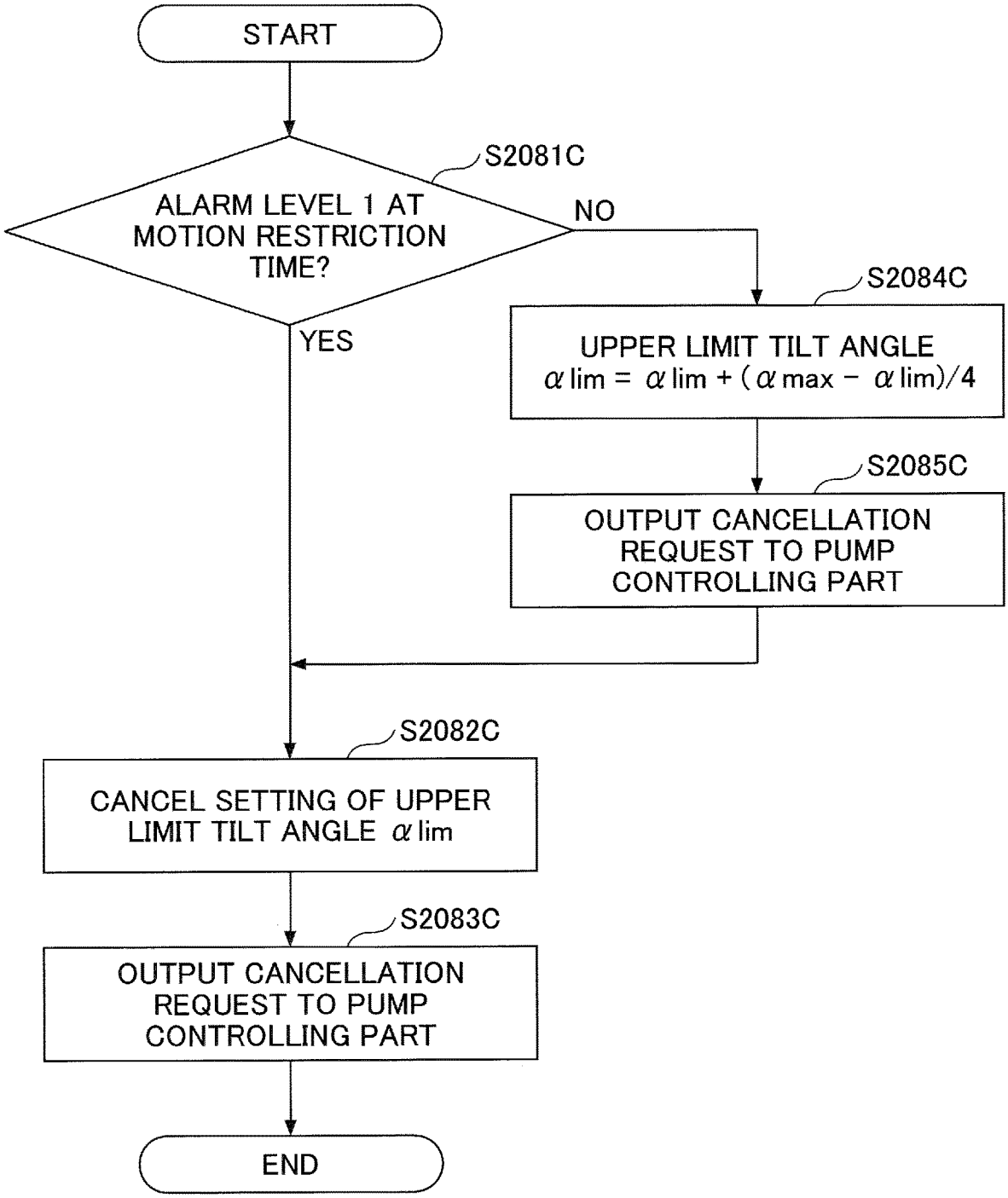
FIG. 22 is a flowchart schematically illustrating a third example of the restriction canceling process by the surroundings monitoring system.

Next, FIG. 22 is a flowchart schematically illustrating a third example of the restriction canceling process by the canceling process part 305.

At step S2081C, the canceling process part 305 determines whether the alarm by the alarming process part 303 at the time of motion restriction is of alarm level 1 (namely, whether the alarm issued by the alarming process part 303 is a preliminary alarm). The canceling process part 305 proceeds to step S2082C if it is of alarm level 1, and proceeds to step S2084C if it is not of alarm level 1 (namely, it is of alarm level 2).

At step S2082C, the canceling process part 305 cancels the setting of the upper limit tilt angle αlim.

At step S2083C, the canceling process part 305 transmits a cancellation request to cancel the setting of the upper limit tilt angle αlim to the pump controlling part 306, and ends the process of this time.

At step S2084C, the canceling process part 305 sets a new upper limit tilt angle αlim (=αlim+(αmax−αlim)/4) obtained by adding ¼ of the difference between the maximum tilt angle αmax and the upper limit tilt angle αlim at the time of motion restriction to the upper limit tilt angle αlim at the time of motion restriction.

At step S2085C, the canceling process part 305 transmits a cancellation request including the set upper limit tilt angle αlim to the pump controlling part 306, and thereafter, proceeds to step S2082C to execute the process of steps S2082C and S2083C. That is, the canceling process part 305 cancels the upper limit tilt angle αlim and returns the upper limit of the tilt angle α of the swash plate 14C to the maximum tilt angle αmax while relaxing the upper limit tilt angle αlim in two stages.

Thus, according to this example, as the alarm level of the alarm issued at the time of motion restriction is higher, the discharge flow rate Q of the main pump 14 is increased more gradually to cancel the motion restriction. As a result, while the monitoring target object may continue to be present in the blind spot of the operator or the image capturing unit 40, etc., even after the cancellation switch 42 is operated or the monitoring target object is no longer detected by the detecting part 301, it is possible to further increase safety at the time of canceling the motion restriction of the shovel.

According to this example, the restricted target rotational speed Nset may be returned to the preset target rotational speed Nset in a stepwise manner in accordance with the alarm level of the alarm issued at the time of motion restriction.

Figure 23:
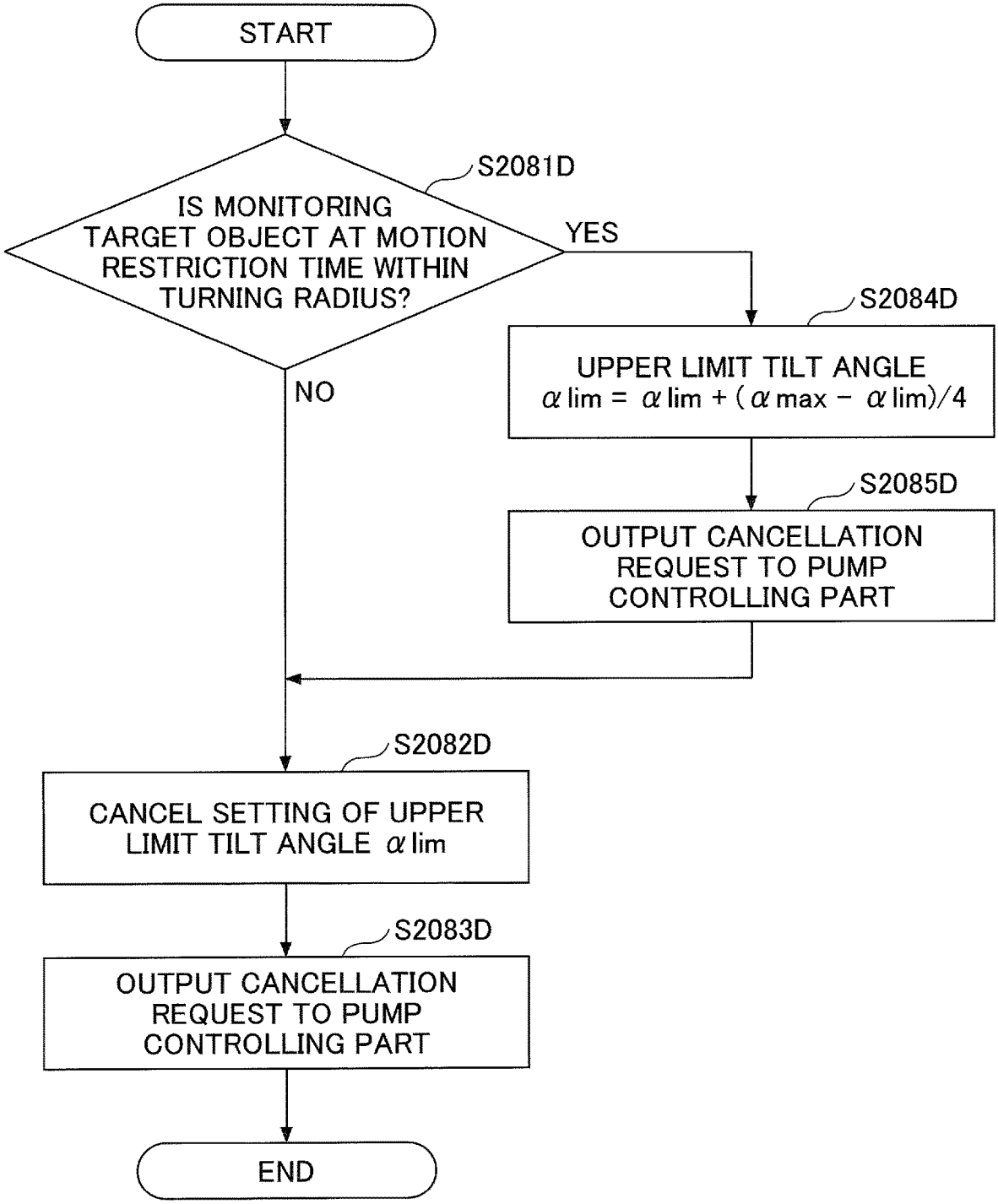
FIG. 23 is a flowchart schematically illustrating a fourth example of the restriction canceling process by the surroundings monitoring system.

Next, FIG. 23 is a flowchart schematically illustrating a fourth example of the restriction canceling process by the canceling process part 305.

At step S2081D, the canceling process part 305 determines whether the monitoring target object detected by the detecting part 301 at the time of motion restriction is within the turning radius (within the turning range) of the upper turning body 3. The canceling process part 305 proceeds to step S2082D if it is outside the turning radius, and proceeds to step S2084D if it is within the turning radius.

At step S2082D, the canceling process part 305 cancels the setting of the upper limit tilt angle αlim.

At step S2083D, the canceling process part 305 transmits a cancellation request to cancel the setting of the upper limit tilt angle αlim to the pump controlling part 306, and ends the process of this time.

At step S2084D, the canceling process part 305 sets a new upper limit tilt angle αlim (=αlim+((αmax−αlim)/4) obtained by adding ¼ of the difference between the maximum tilt angle αmax and the upper limit tilt angle αlim at the time of motion restriction to the upper limit tilt angle αlim at the time of motion restriction.

At step S2085D, the canceling process part 305 transmits a cancellation request including the set upper limit tilt angle αlim to the pump controlling part 306, and thereafter, proceeds to step S2082D to execute the process of steps S2082D and S2083D. That is, the canceling process part 305 cancels the upper limit tilt angle αlim and returns the upper limit of the tilt angle α of the swash plate 14C to the maximum tilt angle αmax while relaxing the upper limit tilt angle αlim in two stages.

Thus, according to this example, if the monitoring target object detected at the time of motion restriction has been present within the turning radius (namely, within the turning range), the canceling process part 305 increases the discharge flow rate Q of the main pump 14 more gradually than in the case where the monitoring target object detected at the time of motion restriction has been present outside the turning radius (namely, outside the turning range). As a result, while the monitoring target object may continue to be present in the blind spot of the operator or the image capturing unit 40, etc., even after the cancellation switch 42 is operated or the monitoring target object is no longer detected by the detecting part 301, it is possible to further increase safety at the time of canceling the motion restriction of the shovel.

According to this example, the restricted target rotational speed Nset may be returned to the preset target rotational speed Nset in a stepwise manner in accordance with whether the monitoring target object detected at the time of motion restriction is within the turning radius (within the turning range).

Figure 24:
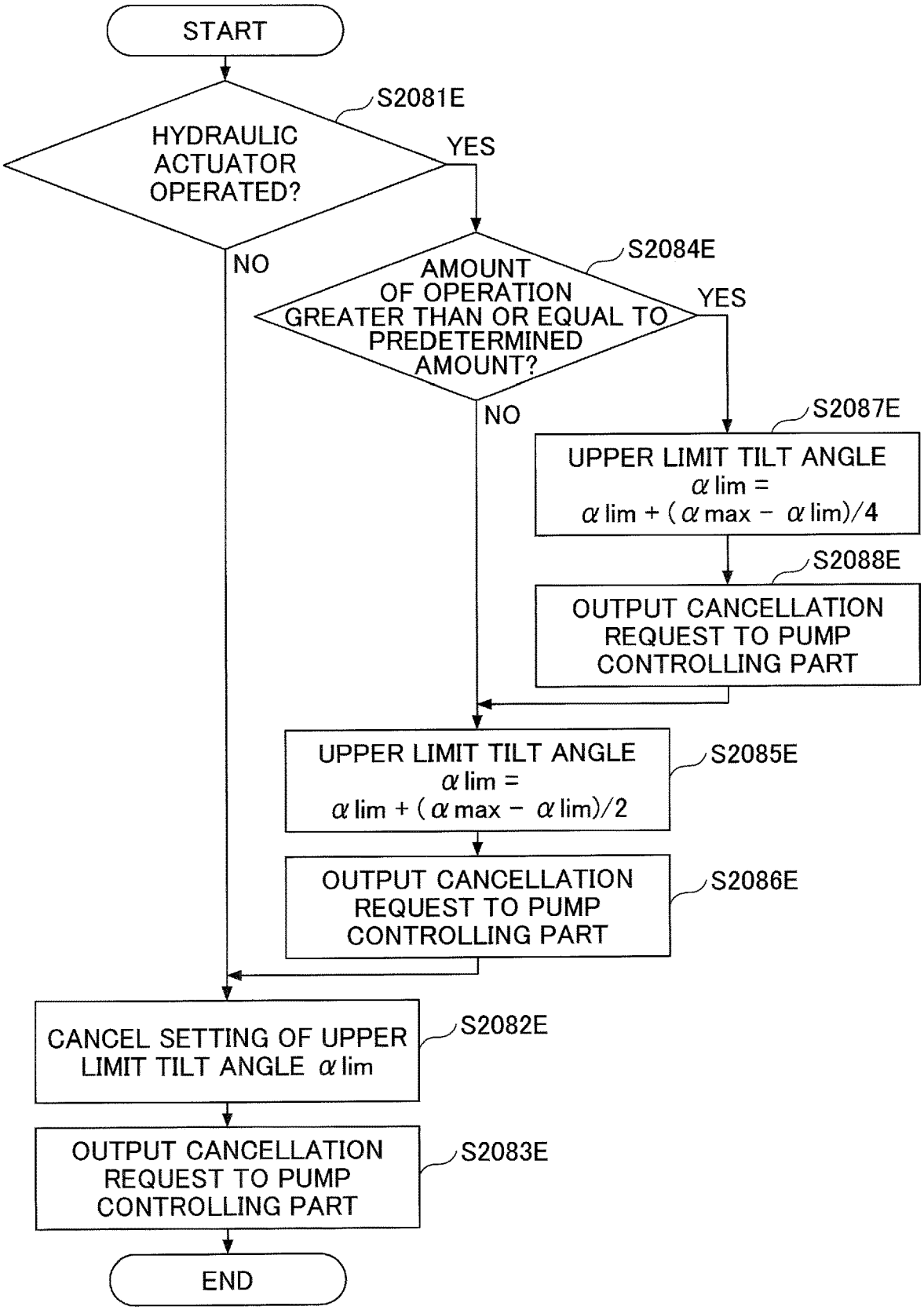
FIG. 24 is a flowchart schematically illustrating a fifth example of the restriction canceling process by the surroundings monitoring system.

Next, FIG. 24 is a flowchart schematically illustrating a fifth example of the restriction canceling process by the canceling process part 305.

At step S2081E, the canceling process part 305 determines whether the operating apparatus 26 is being operated for the hydraulic actuator ACT. The canceling process part 305 proceeds to step S2082B if the operating apparatus 26 is not being operated, and proceeds to step S2084B if the operating apparatus 26 is being operated.

At step S2082E, the canceling process part 305 cancels the setting of the upper limit tilt angle αlim.

At step S2083E, the canceling process part 305 transmits a cancellation request to cancel the setting of the upper limit tilt angle αlim to the pump controlling part 306, and ends the process of this time.

At step S2084E, the canceling process part 305 determines whether the amount of operation of the hydraulic actuator ACT on the operating apparatus 26 is greater than or equal to a predetermined amount. The canceling process part 305 proceeds to step S2085E if the amount of operation is not greater than or equal to a predetermined amount, and proceeds to step S2087E if the amount of operation is greater than or equal to a predetermined amount.

At step S2085E, the canceling process part 305 sets a new upper limit tilt angle αlim (=αlim+(αmax−αlim)/2) obtained by adding ½ of the difference between the maximum tilt angle αmax and the upper limit tilt angle αlim at the time of motion restriction to the upper limit tilt angle αlim at the time of motion restriction.

At step S2086E, the canceling process part 305 transmits a cancellation request including the set upper limit tilt angle αlim to the pump controlling part 306, and thereafter, proceeds to step S2082E to execute the process of steps S2082E and S2083E. That is, the canceling process part 305 cancels the upper limit tilt angle αlim and returns the upper limit of the tilt angle α of the swash plate 14C to the maximum tilt angle αmax while relaxing the upper limit tilt angle αlim in two stages.

At step S2087E, the canceling process part 305 sets a new upper limit tilt angle αlim (=αlim+(αmax−αlim)/4) obtained by adding ¼ of the difference between the maximum tilt angle αmax and the upper limit tilt angle αlim at the time of motion restriction to the upper limit tilt angle αlim at the time of motion restriction.

At step S2088E, the canceling process part 305 transmits a cancellation request including the set upper limit tilt angle αlim to the pump controlling part 306, thereafter proceeds to step S2085E to execute the process of steps S2085E and S2086E, and thereafter further executes the process of steps S2082E and S2083E. That is, the canceling process part 305 cancels the upper limit tilt angle αlim and returns the upper limit of the tilt angle α of the swash plate 14C to the maximum tilt angle αmax while relaxing the upper limit tilt angle αlim in three stages.

Thus, according to this example, as the amount of operation of the hydraulic actuator ACT on the operating apparatus 26 is greater, the discharge flow rate Q of the main pump 14 is increased more gradually to cancel the motion restriction of the shovel. This makes it possible to reduce the impact caused by an increase in the discharge flow rate Q of the main pump 14 (the acceleration of the hydraulic actuator ACT) and control the degradation of operability, when the operating apparatus 26 is being operated for a hydraulic actuator at the time of canceling the motion restriction. Furthermore, it is possible to prevent sudden acceleration of the hydraulic actuator ACT at the time of canceling the motion restriction to further increase the safety of the shovel.

According to this example, the restricted target rotational speed Nset may be returned to the preset target rotational speed Nset in a stepwise manner in accordance with the amount of operation of the operating apparatus 26.

Figure 25:
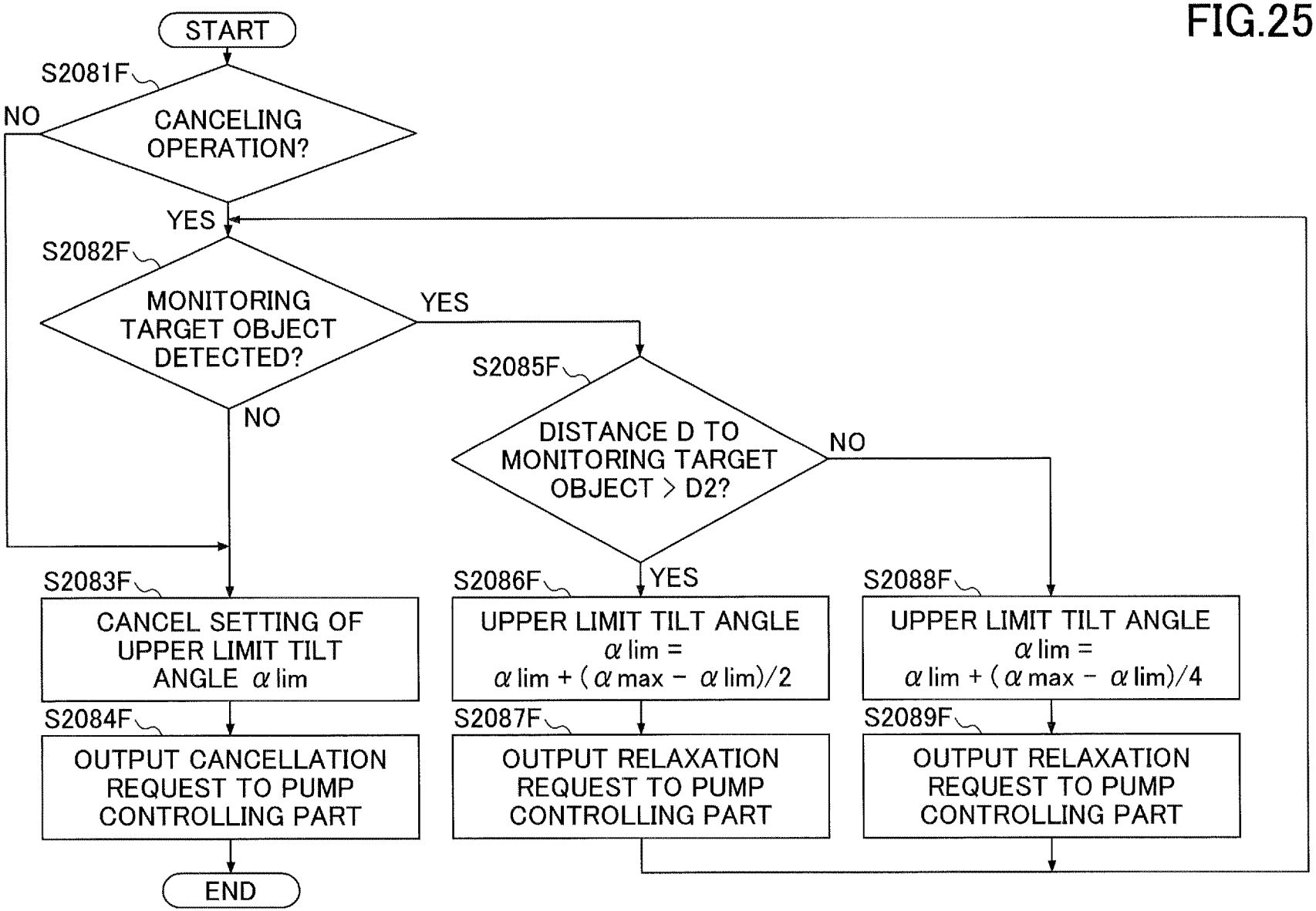
FIG. 25 is a flowchart schematically illustrating a sixth example of the restriction canceling process by the surroundings monitoring system.

Next, FIG. 25 is a flowchart schematically illustrating a sixth example of the restriction canceling process by the canceling process part 305.

A description of the process of steps S2081F through S2084F, which is the same as that of steps S2081A through 2084A of FIG. 20, is omitted.

If the monitoring target object is detected by the detecting part 301 at step S2082F, the canceling process part 305 proceeds to step S2085F.

At step S2085F, the canceling process part 305 determines whether the distance D between the monitoring target object detected by the detecting part 301 and the shovel is greater than the predetermined distance D2. The canceling process part 305 proceeds to step S2086F if the distance D between the detected monitoring target object and the shovel is greater than the predetermined distance D2, and otherwise, proceeds to step S2088F.

At step S2086F, the canceling process part 305 sets a new upper limit tilt angle αlim (=αlim+(αmax−αlim)/2) obtained by adding ½ of the difference between the maximum tilt angle αmax and the upper limit tilt angle αlim at the time of motion restriction to the upper limit tilt angle αlim at the time of motion restriction.

At step S2087F, the canceling process part 305 transmits a relaxation request including the set upper limit tilt angle αlim to the pump controlling part 306, and returns to step S2082F.

At step S2088F, the canceling process part 305 sets a new upper limit tilt angle αlim (=αlim+(αmax−αlim)/4) obtained by adding ¼ of the difference between the maximum tilt angle αmax and the upper limit tilt angle αlim at the time of motion restriction to the upper limit tilt angle αlim at the time of motion restriction. That is, the upper limit tilt angle αlim newly set at step S2088F is lower in the degree of relaxation with respect to the former upper limit tilt angle αlim than the upper limit tilt angle αlim newly set at step S2086F.

At step S2089F, the canceling process part 305 transmits a relaxation request including the set upper limit tilt angle αlim to the pump controlling part 306, and returns to step S2082F.

Thus, according to this example, in the case where the cancellation switch 42 is operated after the restricting process part 304 starts to restrict the motion of the shovel, the canceling process part 305 cancels the motion restriction of the shovel when the monitoring target object is not detected by the detecting part 301. When the monitoring target object is detected by the detecting part 301, the canceling process part 305 relaxes the motion restriction of the shovel, but does not completely cancel the motion restriction of the shovel and restricts the maximum value of the discharge flow rate Q of the main pump 14. That is, in the case where the cancellation switch 42 is operated after the restricting process part 304 starts to restrict the motion of the shovel, the canceling process part 305 relaxes or cancels the motion restriction of the shovel such that the degree of relaxation (namely, the flow rate supplied to the hydraulic actuator ACT) is lower when the monitoring target object is detected by the detecting part 301 than when the monitoring target object is not detected. As a result, in a situation where the monitoring target object may be present around the shovel although the cancellation switch 42 is operated, the motion restriction of the shovel is relaxed but continues to be restricted to some extent. Therefore, it is possible to further increase the safety of the shovel.

Furthermore, according to this example, in the case where the cancellation switch 42 is operated after the restricting process part 304 starts to restrict the motion of the shovel, the canceling process part 305 cancels the motion restriction of the shovel such that the degree of relaxation of the motion restriction increases as the distance D between the monitoring target object and the shovel increases when the monitoring target object is detected by the detecting part 301. As a result, when the cancellation switch 42 is operated, the degree of relaxation of the motion restriction of the shovel is relatively high, so that the operating speed of the shovel is relatively high, if the monitoring target is at a certain distance from the shovel, even in a situation where the monitoring target object may be present around the shovel. Accordingly, it is possible to ensure the workability of the shovel while ensuring the safety of the shovel.

The degree of relaxation of the motion restriction (namely, the flow rate of hydraulic oil supplied to the hydraulic actuator ACT), which changes in a stepwise manner in accordance with the distance D between the monitoring target object and the shovel according to this example, may also change continuously. Furthermore, the same as in this example, the motion restriction of the shovel may be relaxed or canceled such that the degree of relaxation of the restricted target rotational speed Nset differs according to the presence or absence of the monitoring target object detected by the detecting part 301 or the distance between the detected monitoring target object and the shovel.

Figure 26:
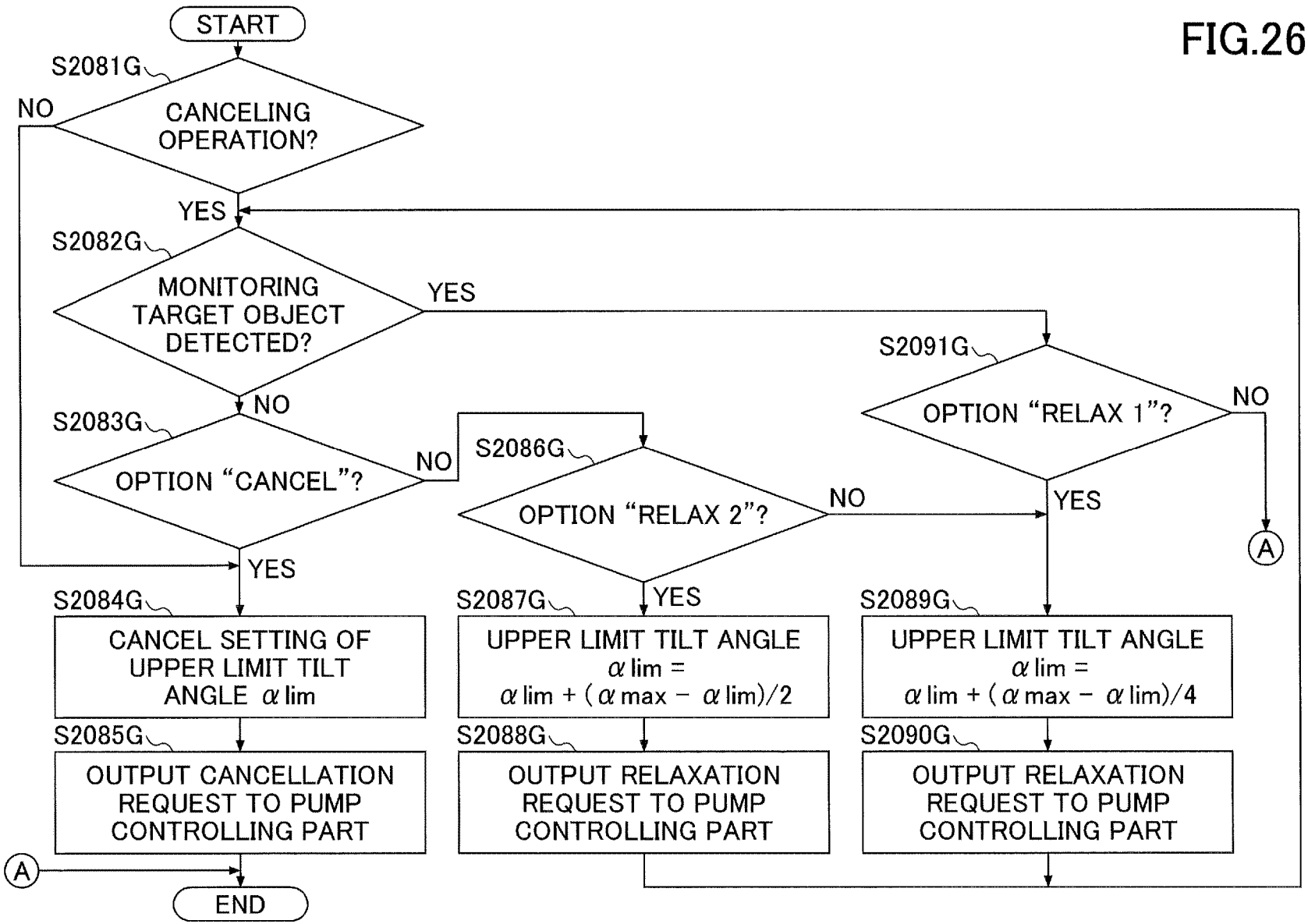
FIG. 26 is a flowchart schematically illustrating a seventh example of the restriction canceling process by the surroundings monitoring system.

Next, FIG. 26 is a flowchart schematically illustrating a seventh example of the restriction canceling process by the canceling process part 305. This example is described based on the assumption that the cancellation switch 42 is operating inputting means (see FIGS. 4A and 4B) that enables selection from multiple options as to the degree of relaxation of the motion restriction, specifically, the three stages of "CANCEL," "RELAX 1," and "RELAX 2."

At step S2081G, the canceling process part 305 determines whether the cancellation switch 42 has been operated, that is, whether it is the restriction canceling process triggered by an operation on the cancellation switch 42. The canceling process part 305 proceeds to step S2082G if the cancellation switch 42 has been operated, and otherwise, proceeds to step S2084G.

At step S2082G, the canceling process part 305 determines whether the monitoring target object is detected within a predetermined area around the shovel by the detecting part 301. The canceling process part 305 proceeds to step S2083G if the monitoring target object is not detected within a predetermined area around the shovel by the detecting part 301, and proceeds to step S2091G if the monitoring target object is detected by the detecting part 301.

At step S2083G, the canceling process part 305 determines whether the option selected at the time of operation of the cancellation switch 42 is "CANCEL." The canceling process part 305 proceeds to step S2084G if the option selected at the time of operation of the cancellation switch 42 is "CANCEL," and proceeds to step S2086G if the option selected at the time of operation of the cancellation switch 42 is other than "CANCEL" (namely, "RELAX 1" or "RELAX 2").

A description of the process of steps S2084G and S2085G, which is the same as that of steps S2083A and S2084A of FIG. 20, is omitted.

At step S2086G, the canceling process part 305 determines whether the option selected at the time of operation of the cancellation switch 42 is "RELAX 2." The canceling process part 305 proceeds to step S2087G if the option selected at the time of operation of the cancellation switch 42 is "RELAX 2," and proceeds to step S2089G if the option selected at the time of operation of the cancellation switch 42 is other than "RELAX 2" (namely, "RELAX 1").

A description of the process of steps S2087G through S2090G, which is the same as that of steps S2086F and S2089F of FIG. 25, is omitted.

At step S2091G, the canceling process part 305 determines whether the option selected at the time of operation of the cancellation switch 42 is "RELAX 1." The canceling process part 305 proceeds to step S2089G if the option selected at the time of operation of the cancellation switch 42 is "RELAX 1," and ends the process of this time without relaxing or canceling the motion restriction if the option selected at the time of operation of the cancellation switch 42 is other than "RELAX 1" (namely, "CANCEL" or "RELAX 2" higher in the degree of relaxation of the motion restriction than "RELAX 1").

Thus, according to this example, the canceling process part 305 relaxes the motion restriction of the shovel with a maximum degree of relaxation, that is, completely cancels the motion restriction of the shovel, in response to the selection of "CANCEL" at the time of operation of the cancellation switch 42, relaxes the motion restriction of the shovel with a relatively high degree of relaxation in response to the selection of "RELAX 2" at the time of operation of the cancellation switch 42, and relaxes the motion restriction of the shovel with a relatively low degree of relaxation in response to the selection of "RELAX 1" at the time of operation of the cancellation switch 42. That is, when the cancellation switch 42 is operated after the start of the motion restriction of the shovel, the canceling process part 305 cancels or relaxes the motion restriction according to a degree of relaxation corresponding to the option ("CANCEL," "RELAX 2," or "RELAX 1") selected with the cancellation switch 42. This makes it possible for the operator or the like to relax or cancel the motion restriction of the shovel after setting the degree of relaxation of the motion restriction on each occasion in accordance with actual site conditions. Therefore, it is possible to increase the operator's convenience. Furthermore, because it is possible to change the degree of relaxation in accordance with the understanding of site conditions or the like by the operator or the like, it is possible to further increase safety.

Furthermore, according to this example, even when the cancellation switch 42 is operated, the canceling process part 305 does not cancel or relax the motion restriction of the shovel if "CANCEL" or "RELAX 2" is selected at the time of operation of the cancellation switch 42. That is, the canceling process part 305 does not cancel or relax the motion restriction of the shovel if the cancellation switch 42 has been operated to select an option whose degree of relaxation exceeds a predetermined level. As a result, in a situation where the monitoring target object may be present around the shovel, the motion restriction of the shovel is not relaxed or canceled based on an option whose degree of relaxation is relatively high ("CANCEL" or "RELAX 2"). Therefore, it is possible to ensure the safety of the shovel while considering the convenience of the operator or the like.

According to this example, the operation of the cancellation switch 42 with "CANCEL" or "RELAX 2" being selected is treated as invalid. Alternatively, when the monitoring target object is detected by the detecting part 301 after the start of the motion restriction of the shovel, "CANCEL" and "RELAX 2" may be made unselectable by the cancellation switch 42. Specifically, according to the cancellation switch 42 illustrated in FIG. 4A, the triangular mark 422A of the dial part 421A may be automatically moved to a state indicating "RELAX 2" by driving means such as a motor and locked in the state by a lock pin or the like. Furthermore, according to the cancellation switch 42 illustrated in FIG. 4B, the button icons 422B and 423B corresponding to "RELAX 2" and "CANCEL" may be hidden or displayed as inoperable objects. This makes it possible to prevent an option whose degree of relaxation exceeds a predetermined level ("CANCEL" or "RELAX 2") from being selected.

Figure 27:
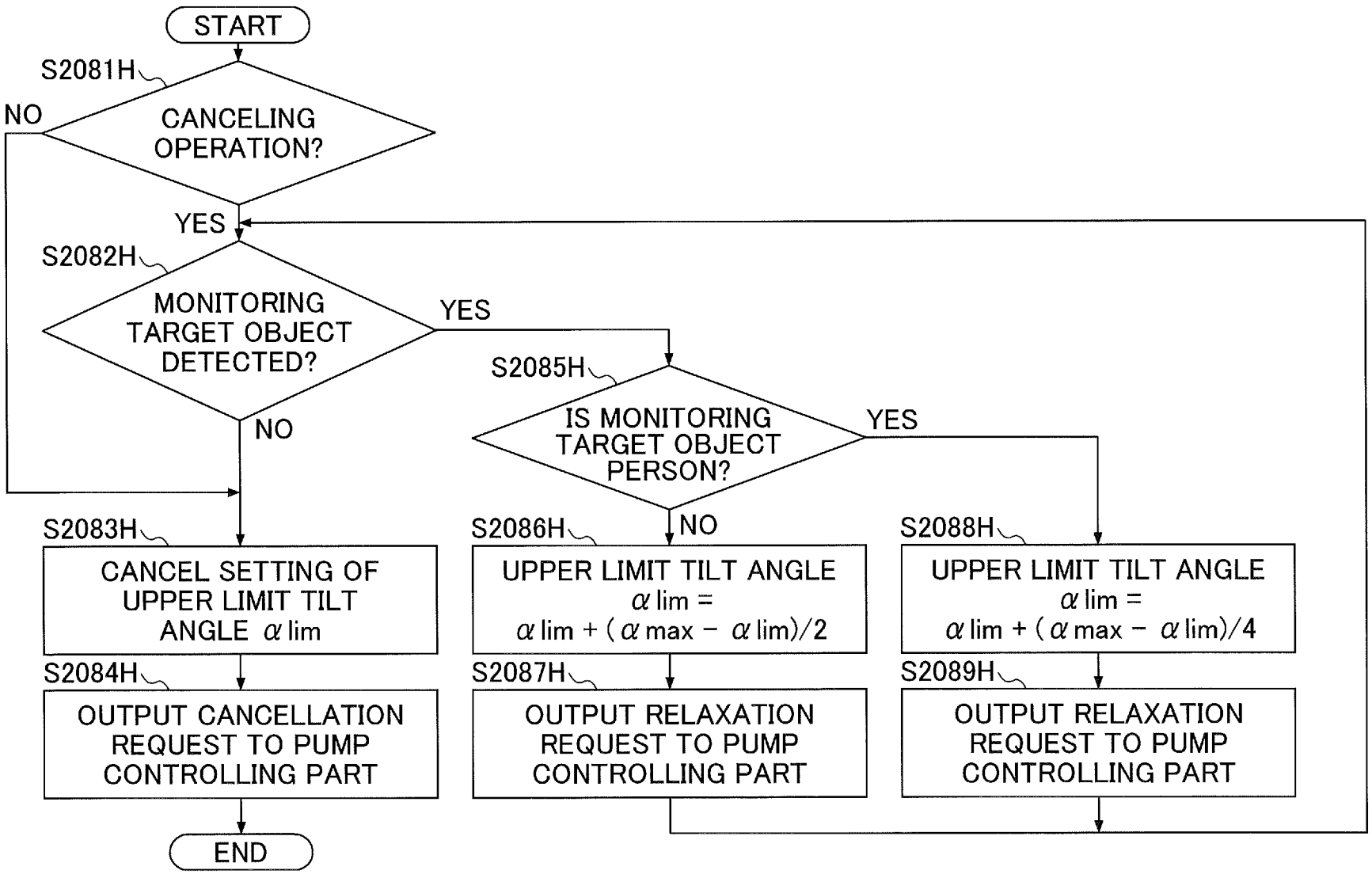
FIG. 27 is a flowchart schematically illustrating an eighth example of the restriction canceling process by the surroundings monitoring system.

Next, FIG. 27 is a flowchart schematically illustrating an eighth example of the restriction canceling process by the canceling process part 305.

A description of the process of steps S2081H through S2084H, which is the same as that of steps S2081A through S2084A of FIG. 20, is omitted.

If the monitoring target object is detected by the detecting part 301 at step S2082H, the canceling process part 305 proceeds to step S2085H.

At step S2085H, the canceling process part 305 determines whether the monitoring target detected by the detecting part 301 is a person or an obstacle other than a person. The canceling process part 305 proceeds to step S2086H if the monitoring target object detected by the detecting part 301 is an obstacle other than a person, and proceeds to step S2088H if the monitoring target object detected by the detecting part 301 is a person.

A description of the process of steps S2086H through S2089H, which is the same as that of steps S2086F and S2089F of FIG. 25, is omitted.

According to this example, when the detected monitoring target is an obstacle other than a person, the motion restriction of the shovel is relaxed with a relatively high degree of relaxation, but the motion restriction of the shovel may alternatively be canceled. That is, if the condition of determination of step S2085H is not met (if No), it is possible to proceed to step S2083H.

Thus, according to this example, in the case where the cancellation switch 42 is operated after the start of the motion restriction of the shovel, the canceling process part 305 relaxes or cancels the motion restriction of the shovel in a different manner according to whether the monitoring target object is a person or an obstacle other than a person when the monitoring target object is detected by the detecting part 301. Specifically, when the cancellation switch 42 is operated after the start of the motion restriction of the shovel, the canceling process part 305, in the case where the monitoring target object detected by the detecting part 301 is a person, further considers safety and relaxes the motion restriction of the shovel in a manner lower in the degree of relaxation than in the case where the monitoring target object detected by the detecting part 301 is an obstacle other than a person. This makes it possible to further increase the safety of the shovel.

Figure 28:
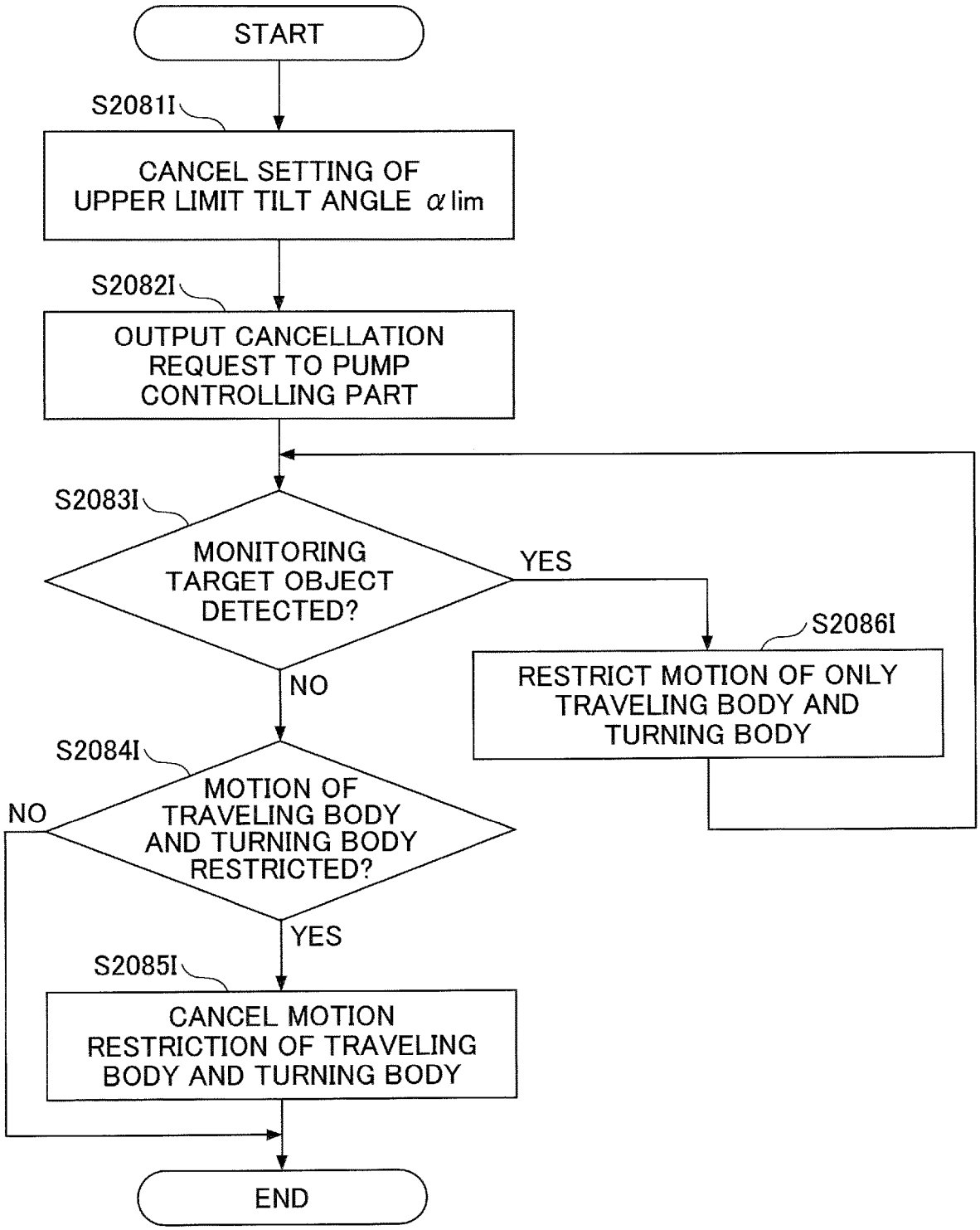
FIG. 28 is a flowchart schematically illustrating a ninth example of the restriction canceling process by the surroundings monitoring system.

Next, FIG. 28 is a flowchart schematically illustrating a ninth example of the restriction canceling process by the canceling process part 305.

A description of the process of steps S2081I and S2082I, which is the same as that of steps S2083A and S2084A of FIG. 20, is omitted. By this, a restriction on the flow rate of the main pump 14 is canceled.

At step S2083I, the canceling process part 305 determines whether the monitoring target object is detected by the detecting part 301. The canceling process part 305 proceeds to step S2084I if the monitoring target object is not detected by the detecting part 301, and proceeds to step S2086I if the monitoring target object is detected.

At step S2084I, the canceling process part 305 proceeds to step S2085I if the motion of the lower traveling body 1 and the upper turning body 3 is restricted by the below-described process of step S2086I, and otherwise, ends the process of this time.

At step S2085I, the canceling process part 305 cancels the motion restriction of the lower traveling body 1 and the upper turning body 3, and ends the process of this time. Specifically, the canceling process part 305 stops such control of control valves in the control valve 17 as to control the flow rate and direction of hydraulic oil supplied to the hydraulic actuators ACT corresponding to the lower traveling body 1 and the upper turning body 3. As a result, each control valve starts to operate in accordance with the state of operation by the operator or the like, and therefore, the motion restriction of the lower traveling body 1 and the upper turning body 3 is canceled.

At step S2086I, the canceling process part 305 separately restricts the motion of the lower traveling body 1 and the upper turning body 3. Specifically, the canceling process part 305 performs such control of control valves in the control valve 17 as to control the flow rate and direction of hydraulic oil supplied to the hydraulic actuators ACT corresponding to the lower traveling body 1 and the upper turning body 3 as described above. This makes it possible for the canceling process part 305 to control a secondary side pilot pressure acting on the control valves independent of the state of the operator's operation. Therefore, it is possible to continue the motion restriction of the lower traveling body 1 and the upper turning body 3.

According to this example, only the motion restriction of the attachment is canceled, but the motion restriction of the attachment may be relaxed. In this case, for example, instead of the process of steps S2081I and S2082I, the process of steps S2086F and S2087F of FIG. 25 may be performed. Furthermore, according to this example, the motion restriction is continued so that neither the lower traveling body 1 nor the upper turning body 3 is moved by the operator's operation, while the motion restriction of only one of the lower traveling body 1 and the upper turning body 3 may be continued and the motion restriction of the other may be relaxed or canceled.

Thus, according to this example, the canceling process part 305 relaxes or cancels the motion restriction of only the attachment among operating elements. Specifically, in the case where the cancellation switch 42 is operated after the start of the motion restriction of the shovel, the canceling process part 305 relaxes or cancels the motion restriction of only the attachment when the monitoring target is detected by the detecting part 301. As a result, in a situation where the monitoring target object may be present around the shovel, it is possible to ensure safety by continuing the motion restriction of an operating element that may move toward a blind spot of the operator, such as the lower traveling body 1 or the upper turning body 3. Furthermore, even in a situation where the monitoring target object may be present around the shovel, by relaxing or canceling the motion restriction with respect to an operating element whose motion is visible from the operator, such as the attachment, it is possible to ensure the workability of the shovel while visually ensuring safety by the operator. That is, it is possible to achieve both safety and workability of the shovel.

Figure 29:
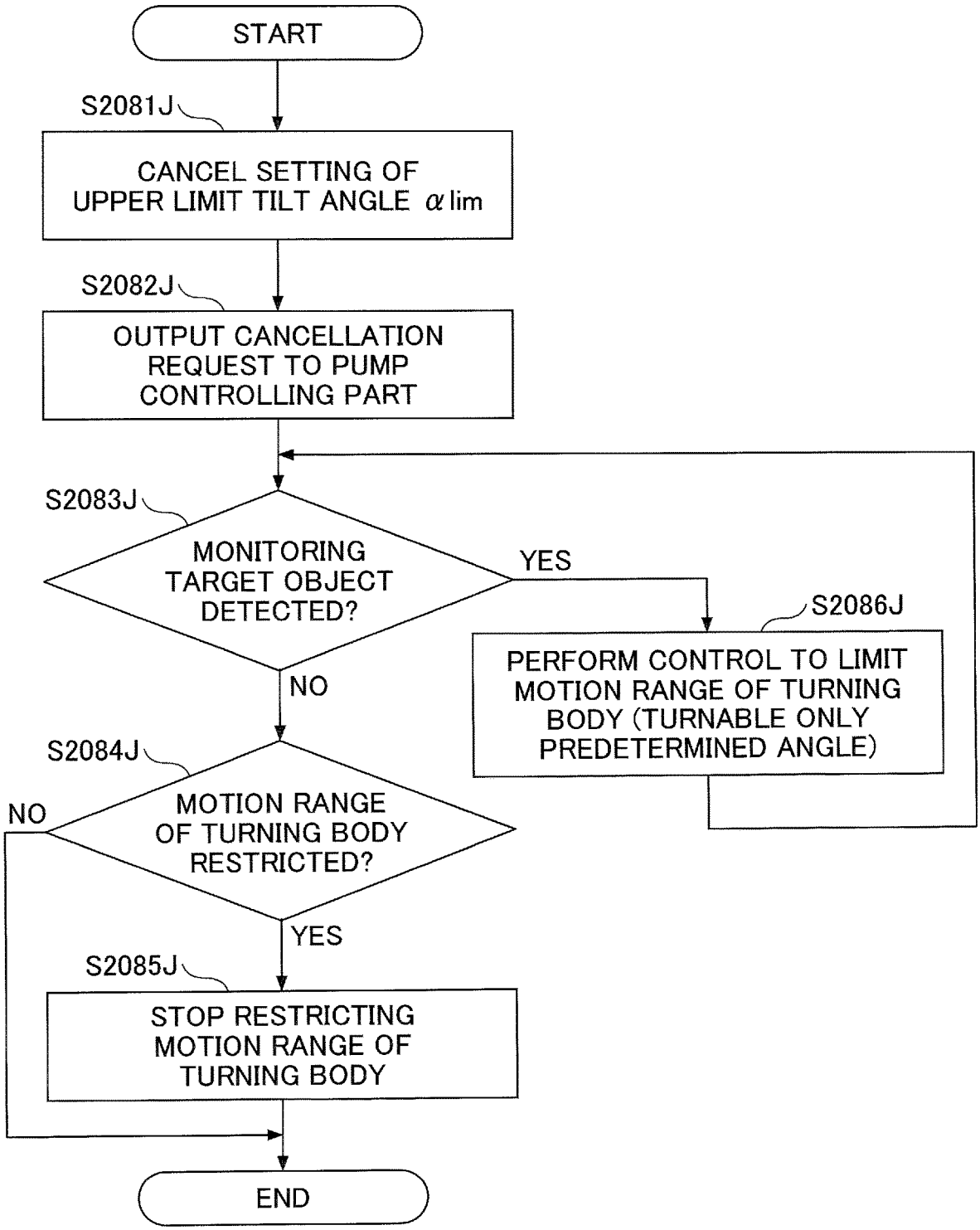
FIG. 29 is a flowchart schematically illustrating a tenth example of the restriction canceling process by the surroundings monitoring system.

Next, FIG. 29 is a flowchart schematically illustrating a tenth example of the restriction canceling process by the canceling process part 305.

A description of the process of steps S2081J through S2083J, which is the same as that of steps S2081I through S2083I, is omitted.

If the monitoring target object is detected by the detecting part 301 at step S2083J, the canceling process part 305 proceeds to step S2084J.

At step S2084J, the canceling process part 305 determines whether the motion range of the upper turning body 3 is being restricted by the below-described process of step S2086J. The canceling process part 305 proceeds to step S2085J if the motion range of the upper turning body 3 is being restricted, and ends the process of this time if the motion range of the upper turning body 3 is not being restricted.

At step S2085J, the canceling process part 305 stops restricting the motion range of the upper turning body 3, and ends the process of this time. Specifically, the canceling process part 305 stops performing such control of a control valve in the control valve 17 as to control the flow rate and direction of hydraulic oil supplied to the hydraulic actuator ACT corresponding to the upper turning body 3. As a result, each control valve starts to operate in accordance with the state of operation by the operator or the like, and therefore, the motion restriction of the upper turning body 3 is canceled, the motion restriction that has been relaxed is completely canceled.

At step S2086J, the canceling process part 305 relaxes the motion restriction of the upper turning body 3 separately. Specifically, the canceling process part 305 performs such control of a control valve in the control valve 17 as to control the flow rate and direction of hydraulic oil supplied to the hydraulic actuator ACT corresponding to the upper turning body 3 as described above. This makes it possible for the canceling process part 305 to control a secondary side pilot pressure acting on the control valve independent of the state of the operator's operation. Therefore, while relaxation is performed such that the upper turning body 3 can operate according to the operator's operation, it is possible to limit the motion range of the upper turning body 3 to a predetermined angle (for example, 45° or the like).

When the upper turning body 3 is driven by an electric motor as described above, the canceling process part 305 may limit the motion range of the upper turning body 3 to a predetermined angle by directly controlling a control command to the electric motor.

Thus, according to this example, in the case where the cancellation switch 42 is operated after the start of the motion restriction of the shovel, the canceling process part 305 relaxes the motion restriction of the shovel such that the upper turning body 3 can turn only a predetermined angle. As a result, in a situation where the monitoring target object may be present around the shovel although the cancellation switch 42 is operated, it is possible to relax the motion restriction in such a manner as to limit the motion range of the upper turning body 3, which can move toward a blind spot of the operator. Therefore, it is possible to increase the safety of the shovel. Furthermore, because the motion restriction of the shovel is relaxed, although to the extent limited to a predetermined angle, it is possible to ensure the workability of the shovel. That is, it is possible to achieve both safety and workability of the shovel.

An embodiment of the present invention is described in detail above. The present invention, however, is not limited to the specifically disclosed embodiment, and variations and modifications may be made without departing from the scope of the present invention.

For example, when the cancellation switch 42 is operated with the operating apparatus 26 being operated for the hydraulic actuator ACT, the operation may be invalidated to prevent the canceling process part 305 from canceling the motion restriction. This makes it possible to prevent the hydraulic actuator ACT of the shovel from suddenly accelerating when the motion restriction is canceled.

Furthermore, for example, in the case where the operating apparatus 26 continues to be operated for the hydraulic actuator ACT after the start of the outputting of an alarm and the motion restriction, the canceling process part 305 may equate it with the operation of the cancellation switch 42 and cancel the motion restriction. This makes it possible to cancel the motion restriction in line with the operator's intention to continue the operation of the hydraulic actuator ACT in a situation where the motion restriction is imposed by the erroneous detection of the detecting part 301 although no monitoring target object is present around the shovel. Furthermore, in this case, the canceling process part 305 may increase the discharge flow rate Q of the main pump 14 more gradually than in the case of canceling the motion restriction with no operation being performed on the operating apparatus 26, the same as in the fifth example (FIG. 24) of the restriction canceling process. This makes it possible to reduce the impact caused by an increase in the discharge flow rate Q of the main pump 14 (the acceleration of the hydraulic actuator ACT) and control the degradation of operability. Furthermore, it is possible to prevent the hydraulic actuator ACT from suddenly accelerating when the motion restriction is canceled, so that it is possible to further increase the safety of the shovel.

The invention claimed is:

1. A construction machine comprising:

a hydraulic actuator; and a processor configured to detect a predetermined object present within a predetermined area around the construction machine;

impose a motion restriction on the construction machine by decreasing a flow rate of hydraulic oil supplied to the hydraulic actuator, in response to detection of the object present within the predetermined area; and relax or cancel the motion restriction by increasing the flow rate to a level lower than before a start of the motion restriction or a level substantially same as before the start of the motion restriction, in response to the object being no longer detected within the predetermined area, after the start of the motion restriction.

2. The construction machine as claimed in claim 1, further comprising:

a hydraulic pump configured to supply the hydraulic oil to the hydraulic actuator;

an engine configured to drive the hydraulic pump; and a control valve configured to drive the hydraulic actuator using the hydraulic oil discharged from the hydraulic pump, wherein the processor is configured to impose the motion restriction by controlling one or more among the hydraulic pump, the engine, and the control valve, and relax or cancel the motion restriction by controlling one or more among the hydraulic pump, the engine, and the control valve.

3. The construction machine as claimed in claim 1, wherein the processor is further configured to relax or cancel the motion restriction by increasing the flow rate to the level lower than before the start of the motion restriction or the level substantially same as before the start of the motion restriction, in response to a predetermined operation for relaxing or canceling the motion restriction being performed, and to increase the flow rate at a lower rate in a case where the predetermined operation is performed with the object being detected than in a case where the predetermined operation is performed with the object being undetected, after the start of the motion restriction.

4. The construction machine as claimed in claim 1, wherein the processor is further configured to relax or cancel the motion restriction by increasing the flow rate to the level lower than before the start of the motion restriction or the level substantially same as before the start of the motion restriction, in response to a predetermined operation for relaxing or canceling the motion restriction being performed, and to increase the flow rate at a lower rate as a distance between the object detected at the start of the motion restriction and the construction machine is higher or an alarm level of an alarm output based on the detection of the object at the start of the motion restriction is higher, in response to the predetermined operation being performed or in response to the object being no longer detected within the predetermined area, after the start of the motion restriction.

5. The construction machine as claimed in claim 1, further comprising:

a turning body, wherein the processor is further configured to relax or cancel the motion restriction by increasing the flow rate to the level lower than before the start of the motion restriction or the level substantially same as before the start of the motion restriction, in response to a predetermined operation for relaxing or canceling the motion restriction being performed, and to increase the flow rate at a lower rate with the object detected at the start of the motion restriction having been present within a turning range of the turning body than with said object having being present outside the turning range, in response to the predetermined operation being performed or in response to the object being no longer detected within the predetermined area, after the start of the motion restriction.

6. The construction machine as claimed in claim 1, wherein the processor is further configured to relax or cancel the motion restriction by increasing the flow rate to the level lower than before the start of the motion restriction or the level substantially same as before the start of the motion restriction, in response to a predetermined operation for relaxing or canceling the motion restriction being performed, and to increase the flow rate at a lower rate as an amount of operation of the hydraulic actuator is greater, in response to the predetermined operation being performed or in response to the object being no longer detected within the predetermined area, after the start of the motion restriction.

7. The construction machine as claimed in claim 1, wherein the processor is further configured to relax or cancel the motion restriction by increasing the flow rate to the level lower than before the start of the motion restriction or the level substantially same as before the start of the motion restriction, in response to a predetermined operation for relaxing or canceling the motion restriction being performed, and to relax or cancel the motion restriction such that an amount of increase of the flow rate is smaller with the object being detected than with the object being undetected, in response to the predetermined operation being performed after the start of the motion restriction.

8. The construction machine as claimed in claim 1, further comprising:

an operating part configured to enable a setting of a condition for the flow rate in a case of relaxing or canceling the motion restriction, wherein the processor is further configured to relax or cancel the motion restriction by increasing the flow rate to the level lower than before the start of the motion restriction or the level substantially same as before the start of the motion restriction, in response to a predetermined operation for relaxing or canceling the motion restriction being performed with the operating part.

9. The construction machine as claimed in claim 1, wherein the processor is further configured to relax or cancel the motion restriction by increasing the flow rate to the level lower than before the start of the motion restriction or the level substantially same as before the start of the motion restriction, in response to a predetermined operation for relaxing or canceling the motion restriction being performed, and to relax or cancel the motion restriction with respect to only one or some operating elements among a plurality of operating elements of the construction machine, or to relax or cancel the motion restriction in a manner different for each of the plurality of operating elements, in response to the predetermined operation being performed after the start of the motion restriction.

10. The construction machine as claimed in claim 9, further comprising:

a turning body, wherein the processor is further configured to relax or cancel the motion restriction by increasing the flow rate to the level lower than before the start of the motion restriction or the level substantially same as before the start of the motion restriction, in response to a predetermined operation for relaxing or canceling the motion restriction being performed, and to relax the motion restriction in such a manner as to allow the turning body to turn only a predetermined angle, in response to the predetermined operation being performed after the start of the motion restriction.

11. The construction machine as claimed in claim 9, wherein the processor is further configured to relax or cancel the motion restriction by increasing the flow rate to the level lower than before the start of the motion restriction or the level substantially same as before the start of the motion restriction, in response to a predetermined operation for relaxing or canceling the motion restriction being performed, and to relax or cancel the motion restriction with respect to an attachment, the attachment including a boom, an arm, and a bucket among the plurality of operating elements of the construction machine, in response to the predetermined operation being performed after the start of the motion restriction.

12. The construction machine as claimed in claim 1, wherein the processor is further configured to relax or cancel the motion restriction by increasing the flow rate to the level lower than before the start of the motion restriction or the level substantially same as before the start of the motion restriction, in response to a predetermined operation for relaxing or canceling the motion restriction being performed, determine whether the object present within the predetermined area is a person or an obstacle other than a person, and relax or cancel the motion restriction in a different manner according to whether the object is the person or the obstacle with the object being detected, in response to the predetermined operation being performed after the start of the motion restriction.

13. The construction machine as claimed in claim 1, wherein the processor is further configured to relax or cancel the motion restriction by increasing the flow rate to the level lower than before the start of the motion restriction or the level substantially same as before the start of the motion restriction, in response to a predetermined operation for relaxing or canceling the motion restriction being performed, and the predetermined operation is a continuous operation of the hydraulic actuator.

14. The construction machine as claimed in claim 1, further comprising:

a turning body;

a hydraulic pump configured to supply the hydraulic oil to the hydraulic actuator; and an engine configured to drive the hydraulic pump, wherein the processor is configured to decrease the flow rate by changing a tilt angle of a swash plate of the hydraulic pump when a distance between the object and the construction machine is greater than a predetermined threshold, when an alarm level of an alarm output based on the detection of the object is lower than a predetermined level, or when the object is present outside a turning range of the turning body, and to decrease the flow rate by changing the tilt angle of the swash plate and decreasing a rotational speed of the engine when the distance is less than or equal to the predetermined threshold, when the alarm level is higher than or equal to the predetermined level, or when the object is present within the turning range, in response to the detection of the object present within the predetermined area.

15. The construction machine as claimed in claim 1, further comprising:

a hydraulic pump configured to supply the hydraulic oil to the hydraulic actuator; and an engine configured to drive the hydraulic pump, wherein the processor is configured to decrease the flow rate by changing a tilt angle of a swash plate of the hydraulic pump when an operation to move the hydraulic actuator is performed, and to decrease the flow rate by changing the tilt angle of the swash plate and decreasing a rotational speed of the engine when the operation to move the hydraulic actuator is not performed, in response to the detection of the object present within the predetermined area.

16. The construction machine as claimed in claim 1, further comprising:

a turning body, wherein the processor is configured to decrease the flow rate by a greater amount as a distance between the object and the construction machine is smaller, as an alarm level of an alarm output based on the detection of the object is higher, or with the object being present within a turning range of the turning body than with the object being present outside the turning range, in response to the detection of the object present within the predetermined area.

17. The construction machine as claimed in claim 1, wherein the processor is configured to impose the motion restriction on only one or some operating elements among a plurality of operating elements of the construction machine, or to impose the motion restriction in a manner different for each of the plurality of operating elements, in response to the detection of the object present within the predetermined area.

18. The construction machine as claimed in claim 17, further comprising:

a traveling body, wherein the processor is configured to restrict a motion of the traveling body such that the traveling body is allowed to travel away from the object, and is prevented from traveling toward the object or allowed to travel slower toward the object than away from the object, in response to the detection of the object present within the predetermined area.

19. The construction machine as claimed in claim 17, further comprising:

an attachment including a boom, an arm, and a bucket, wherein the processor is configured to impose the motion restriction in such a manner as to allow the attachment to perform excavating work, in response to the detection of the object present within the predetermined area.

20. The construction machine as claimed in claim 1, wherein the processor is configured to decrease the flow rate at a lower rate as an amount of operation of the hydraulic actuator is greater, in response to the detection of the object present within the predetermined area.

* * * * *